US006878408B2

(12) United States Patent
Leonard et al.

(10) Patent No.: US 6,878,408 B2
(45) Date of Patent: Apr. 12, 2005

(54) COATING DEVICE AND METHOD USING PICK-AND-PLACE DEVICES HAVING EQUAL OR SUBSTANTIALLY EQUAL PERIODS

(75) Inventors: William K. Leonard, River Falls, WI (US); David W. Leonard, River Falls, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 337 days.

(21) Appl. No.: 10/044,237

(22) Filed: Jan. 10, 2002

(65) Prior Publication Data

US 2002/0090457 A1 Jul. 11, 2002

Related U.S. Application Data

(63) Continuation-in-part of application No. 09/757,955, filed on Jan. 10, 2001, now Pat. No. 6,737,113.

(51) Int. Cl.[7] ..... B05D 3/12
(52) U.S. Cl. ..... 427/355; 427/359
(58) Field of Search ..... 427/355, 359; 118/110

(56) References Cited

U.S. PATENT DOCUMENTS

| | | | | |
|---|---|---|---|---|
| 1,043,021 A | | 10/1912 | Mayer | |
| 2,105,488 A | | 1/1938 | Massey et al. | |
| 2,105,981 A | | 1/1938 | Massey et al. | |
| 2,229,620 A | | 1/1941 | Bradner | |
| 2,229,621 A | | 1/1941 | Bradner | |
| 2,237,045 A | | 4/1941 | Bradner | |
| 2,245,045 A | | 6/1941 | Bradner | |
| 2,388,339 A | * | 11/1945 | Paxton et al. | 427/364 |
| 2,977,243 A | * | 3/1961 | Meier | 427/365 |
| 3,018,757 A | | 1/1962 | Loppnow | |
| 3,169,081 A | | 2/1965 | Nelson et al. | |
| 3,718,117 A | | 2/1973 | Lewicki, Jr. | |
| 3,920,862 A | | 11/1975 | Damschroder et al. | |
| 4,020,194 A | | 4/1977 | McIntyre et al. | |
| 4,102,301 A | * | 7/1978 | Reade et al. | 118/67 |

(Continued)

FOREIGN PATENT DOCUMENTS

| | | | |
|---|---|---|---|
| DE | 2304987 | | 8/1974 |
| EP | 1 088 595 A2 | | 4/2001 |
| GB | 1 278 099 | * | 6/1972 |
| WO | WO 01/96661 A1 | | 12/2001 |

OTHER PUBLICATIONS

Definitions of "smooth" and "uniform" from Merriam–Webster's Collegiate Dictionary, 10th Edition, © 1998 by Meriam–Webster, Inc., pp. 1109 and 1292, respectively.*

(Continued)

*Primary Examiner*—Shrive P. Beck
*Assistant Examiner*—William Phillip Fletcher, III
(74) *Attorney, Agent, or Firm*—Brian E. Szymanski

(57) ABSTRACT

A sufficient number of pick-and-place devices (e.g., rolls) whose periods of contact with a substrate are equal or substantially equal to one another are used to form continuous void-free uniform coatings despite the occurrence of unintended or intended coating caliper surges, depressions or voids. The wetted surfaces of the devices contact and re-contact the coating at positions on the substrate that are different from one another. Extremely uniform and extremely thin coatings can be obtained at very high rates of speed. The pick-and-place devices also facilitate drying and reduce the sensitivity of drying ovens to coating caliper surges. Equipment containing the pick-and-place devices is simple to construct, set up and operate, and can easily be adjusted to alter coating thickness and compensate for coating caliper variations.

32 Claims, 38 Drawing Sheets

U.S. PATENT DOCUMENTS

| | | | | |
|---|---|---|---|---|
| 4,267,215 | A | | 5/1981 | Riggs |
| 4,354,449 | A | | 10/1982 | Zink |
| 4,378,390 | A | | 3/1983 | Yoshida et al. |
| 4,569,864 | A | | 2/1986 | McIntyre |
| 4,748,043 | A | | 5/1988 | Seaver et al. |
| 4,830,873 | A | | 5/1989 | Benz et al. |
| 5,326,598 | A | | 7/1994 | Seaver et al. |
| 5,332,797 | A | | 7/1994 | Kessel et al. |
| 5,409,732 | A | * | 4/1995 | Leonard et al. ..... 427/10 |
| 5,447,474 | A | | 9/1995 | Chang |
| 5,460,120 | A | | 10/1995 | Paul et al. |
| 5,536,314 | A | | 7/1996 | Rannestad |
| 5,585,545 | A | | 12/1996 | Bennett et al. |
| 5,599,602 | A | | 2/1997 | Leonard et al. |
| 5,620,514 | A | | 4/1997 | Munter et al. |
| 5,702,527 | A | | 12/1997 | Seaver et al. |
| 5,733,608 | A | | 3/1998 | Kessel et al. |
| 5,871,585 | A | | 2/1999 | Most et al. |
| 5,954,907 | A | | 9/1999 | LaRose et al. |
| 6,117,237 | A | | 9/2000 | Yapel et al. |
| 6,589,594 | B1 | | 7/2003 | Hembree |

OTHER PUBLICATIONS

Booth, G.L., "The Coating Machine", *Pulp and Paper Manufacture*, vol. 8, pp. 76–87, Third Edition, 1990.

Booth, G.L., *Evolution of Coating*, vol. 1, Gorham International Incorporated.

Gutoff, Edgar R. and Cohen, Edward D., "Problems Associated with Roll Coating an Related Processes", *Coating and Drying Defects*, pp. 74–95, 1995.

Benjamin, Dean F., Anderson, Todd J., and Scriven, L.E., "Multiple Roll Systems: Steady–State Operation", AlChE Journal, V41, pp. 1045–1060, 1995.

Benjamin, Dean F., Anderson, Todd J., and Scriven, L.E., "Multiple Roll Systems: Residence Times and Dynamic Response", AlChE Journal, V41, pp. 2198–2211, 1995.

U.S. Appl. No. 09/757,955, filed Jan. 10, 2001, "Coating Device and Method", pp 1–47 (20 sheets of drawings).

U.S. Appl. No. 09/841,380, filed Apr. 24, 2001, "Electrostatic Spray Coating Apparatus and Method", pp. 1–46 (17 sheets of drawings).

U.S. Appl. No. 09/841,381, filed Apr. 24, 2001, "Variable Electrostatic Spray Coating Apparatus and Method", pp. 1–44 (17 sheets of drawings).

* cited by examiner

COATING DEVICE AND METHOD USING PICK-AND-PLACE DEVICES HAVING EQUAL OR SUBSTANTIALLY EQUAL PERIODS

CROSS-REFERENCE TO RELATED APPLICATION

This application is a continuation-in-part of application Ser. No. 09/757,955 filed Jan. 10, 2001, entitled COATING DEVICE AND METHOD (now U.S. Pat. No. 6,737,113 B1), the entire disclosure of which is incorporated by reference herein.

FIELD OF THE INVENTION

This invention relates to devices and methods for coating substrates and for improving the uniformity of non-uniform or defective coatings.

BACKGROUND

There are many known methods and devices for coating a moving web and other fixed or moving substrates, and for smoothing the resulting coating. Several are described in Booth, G. L., "The Coating Machine", *Pulp and Paper Manufacture*, Vol. 8, *Coating, Converting and Processes*, pp 76–87 (Third Edition, 1990) and in Booth, G. L., *Evolution of Coating*, Vol. 1 (Gorham International Inc.). For example, gravure roll coaters (see, e.g. U.S. Pat. No. 5,620,514) can provide relatively thin coatings at relatively high run rates. Attainment of a desired specific average caliper usually requires several trials with gravure rolls of different patterns. Runtime factors such as variations in doctor blade pressure, coating speed, temperature, or liquid viscosity can cause overall coating weight variation and uneven localized caliper in the machine or transverse directions.

Barmarks and chatter marks are bands of light or heavy coating extending across the web. These are regarded as defects, and can be caused by factors such as vibration, flow pulsation, web speed oscillation, gap variation and roll drive oscillation. Chatter marks are commonly repeating, but barmarks can occur as the result of random system upsets. Gutoff and Cohen, *Coating and Drying Defects* (John Wiley & Sons, New York, 1995) discusses many of the sources of cross web marks and emphasizes their removal by identifying and eliminating the fundamental cause. This approach can require substantial time and effort.

Under some gravure roll coating run conditions, a gravure roll pattern appears in the wet coating. Gravure roll marks can be removed with an arcuate flexible smoothing film located down web from the gravure roll (see, e.g., U.S. Pat. No. 5,447,747); with a smoothing roll or rolls bearing against an intermediate coating roll (see, e.g., U.S. Pat. No. 4,378,390) or with a set of smoothing rolls located down web from the gravure roll (see, e.g., U.S. Pat. No. 4,267,215).

Very thin coatings (e.g., about 0.1 to about 5 micrometers) can be obtained on gravure roll coaters by diluting the coating formulation with a solvent. Solvents are objectionable for health, safety, environmental and cost reasons.

Multiroll coaters (see, e.g., U.S. Pat. Nos. 2,105,488; 2,105,981; 3,018,757; 4569,864 and 5,536,314) can also be used to provide thin coatings. Multiroll coaters are shown by Booth and are reviewed in Benjamin, D. F., Anderson, T. J. and Scriven, L. E. "Multiple Roll Systems: Steady-State Operation", AIChE J., V41, p. 1045 (1995); and Benjamin, D. F., Anderson, T. J. and Scriven, L. E., "Multiple Roll Systems: Residence Times and Dynamic Response", AIChE J., V41, p. 2198 (1995). Commercially available forward-roll transfer coaters typically use a series of three to seven counter rotating rolls to transfer a coating liquid from a reservoir to a web via the rolls. These coaters can apply silicone release liner coatings at wet coating thickness as thin as about 0.5 to about 2 micrometers. The desired coating caliper and quality are obtained by artfully setting roll gaps, roll speed ratios and nipping pressures. Another type of coating device that could be described as a multiroll coater is shown in U.S. Pat. No. 4,569,864, which describes a coating device in which a thick, continuous premetered coating is applied by an extrusion nozzle to a first rotating roll and then transferred by one or more additional rolls to a faster moving web.

SUMMARY OF THE INVENTION

Some of the above-mentioned coating devices employ a series of smoothing brushes that contact the applied wet coating on a web and help to reduce coating irregularities. According to page 76 of the Booth article entitled "The Coating Machine", from 4 to 10 smoothing brushes were used in early coating machines. Smoothing brushes smear the coating under the brush, but do not contact and then re-contact the wet coating.

Rolls have sometimes also been used for smoothing. Usually these are counter-rotating rolls whose direction of motion is opposite that of a moving web. Page 77 of the Booth article shows a squeeze roll coater equipped with four "reverse running" (counter rotating) smoothing rolls located down web from an applicator roll. Examples 1–7 and 10 of U.S. Pat. No. 4,267,215 patent show the application of a continuous coating to a plastic film wherein the wet coating is contacted by an undriven corotating stabilizing roll 68 (whose direction of motion in the contact zone is the same as that of the moving plastic film) and a set of three equal diameter counter rotating spreading rolls 70. The respective diameters of the stabilizing roll and spreading rolls are not disclosed but appear from the Drawing to stand in a 2:1 ratio. In Example 10 of the '215 patent, the applicator roll speed was increased until the uniformity of the coating applied to the web began to deteriorate (at a peripheral applicator roll speed of 0.51 m/s) and surplus coating liquid began to accumulate on the web surface upstream of the rolls 70 (at a peripheral applicator roll speed of 0.61 m/s). Coatings having thicknesses down to 1.84 micrometers were reported. Coating devices employing smoothing rolls such as those described above could contact and then re-contact the wet coating on a moving web, but only a relatively small number (e.g., four or less) of such rolls appear to have been employed.

During continuous web coating operations, unintended surges in coating caliper sometimes occur. Surges can arise from a variety of causes including operator error, system control failures, machinery failures and increases in the supply (or reductions in the viscosity) of the coating liquid. This can lead to a temporary large increase in coating caliper (e.g., by a factor of 2 or even 10 or more). One typical example is a momentary loss of the hydraulic pressure that holds closed the metering gap of a reverse roll coater. Unless the drying section of a coating process line is designed with significant overcapacity, the occurrence of such a surge can cause wet web to be wound up at the end of the process line. This can make the entire wound roll unusable. In addition, if the coating liquid contains a flammable solvent, then flammable concentrations of solvent paper can arise at the winder. Since the roll winding station often causes substantial static electrical discharges, fires or explosions can occur.

Occasionally an unintended gross deficiency in coating caliper will occur during a continuous web coating operation. Defects of this nature can arise from a variety of causes including operator error, air entrainment, system control failures, machinery failures, interruptions in the supply (or sudden increases in the viscosity) of the coating liquid, and changeover of the web or coating roll. This can cause significant portions of a web to be uncoated and can generate undesirable scrap.

The improvement brushes and smoothing roll devices described above generally are not able to compensate adequately for gross coating defects such as a substantial coating caliper surge or a complete absence of coating over a significant portion of a web.

In the above-mentioned U.S. Pat. No. 6,737,113 B1, repeating and random coating defects are eliminated or at least significantly reduced through the use of pick-and-place contacting devices. Rotating rolls (and especially undriven rolls that can corotate with the substrate as it passes by the rolls) are a preferred type of pick-and-place device in the patent. Rolls having periods of contact (defined as the time between successive contacts by a point on the device with the substrate) that were equal to one another were not preferred. Instead, the preferred pick-and-place devices were differently sized rolls, or rolls operated at different speeds, with the sizes or speeds (and thus the periods of contact) not being periodically related to one another.

The present invention provides, in one aspect, coating devices and methods using a number of pick-and-place devices (e.g., rolls) whose periods of contact with a substrate are equal or substantially equal to one another. The devices can be ordered in standard sizes commonly stocked by suppliers (e.g., roll suppliers). The purchase and installation of standard size devices is inexpensive and more readily accomplished than the purchase and installation of special size devices. The use of a sufficiently large number of such pick-and-place devices facilitates the formation of continuous void-free uniform coatings despite the occurrence of unintended coating caliper surges, depressions or voids. Thus the invention provides, in one aspect, a method for improving the uniformity of a wet coating on a substrate comprising contacting and re-contacting the coating with wetted surface portions of a sufficient number of periodic pick-and-place devices having the same or substantially the same periods of contact with the substrate so that coating caliper defects ranging from a complete absence of coating to an excess of as much as 200% of the average coating caliper are converted to range from 85% to 115% of the average coating caliper.

In another aspect, the invention provides a method for improving the uniformity of a wet coating on a substrate comprising contacting and re-contacting the coating with wetted surface portions of at least five periodic pick-and-place devices having the same or substantially the same periods of contact with the substrate.

When all the pick-and-place devices have the same period of contact, the invention enables a reduction in the magnitude of random coating caliper surges or voids. When the pick-and-place devices have at least a small variation or variations in their periods of contact or when at least one other pick-and-place device having a substantially different period of contact (e.g., a period that differs by more than 1% from the average period of the other devices) is employed, the invention also enables a reduction in the magnitude of repeating coating caliper surges, depressions or voids.

In another aspect, the invention provides a method for coating a moving web comprising applying thereon a wet coating having a caliper variation and contacting and re-contacting the wet coating with wetted surface portions of one or more rolls having a period of contact with the web, wherein the period of the caliper variation, the size of the caliper variation or the periods of contact of the rolls are changed (e.g., selected or adjusted) to reduce or minimize coating defects.

In another aspect, the invention provides devices for performing the methods of the invention. In one aspect, the devices of the invention comprise an improvement station comprising a plurality of pick-and-place devices that can periodically contact and re-contact a wet coating at different positions on a substrate, wherein the coating has defects and an average coating caliper and wherein the number of pick-and-place devices having the same or substantially the same periods of contact with the substrate is sufficient so that coating caliper defects ranging from a complete absence of coating to an excess of as much as 200% of the average coating caliper are converted to range from 85% to 115% of the average coating caliper. In another aspect, the devices of the invention comprise an improvement station comprising at least five pick-and-place devices that can periodically contact and re-contact a wet coating at different positions on a substrate and have the same or substantially the same periods of contact with the substrate.

In another aspect, the devices of the invention comprise a coating apparatus comprising a coating station that applies an uneven (and preferably discontinuous) coating to a substrate and an improvement station comprising one or more pick-and-place devices that can periodically contact and re-contact the applied coating at different positions on the substrate, wherein the number of pick-and-place devices having the same or substantially the same periods of contact with the substrate is sufficient so that coating caliper defects ranging from a complete absence of coating to an excess of as much as 200% of the average coating caliper are converted to range from 85% to 115% of the average coating caliper. In yet another aspect, the devices of the invention comprise a coating apparatus comprising a coating station that applies an uneven (and preferably discontinuous) coating to a substrate and an improvement station comprising at least five pick-and-place devices that can periodically contact and re-contact the applied coating at different positions on the substrate and have the same or substantially the same periods of contact with the substrate.

In a particularly preferred aspect of the above-mentioned devices, the applied coating has a periodic caliper variation and the period of the caliper variation, the size of the caliper variation or the period of contact of one or more of the devices is changeable (e.g., selectable or adjustable) to reduce or minimize coating defects.

In yet a further aspect, the coating apparatus further comprises a transfer station for transferring the coating from the first substrate to a second substrate.

In yet a further aspect, the coating apparatus further comprises a drying station.

DETAILED DESCRIPTION

Figure 1:
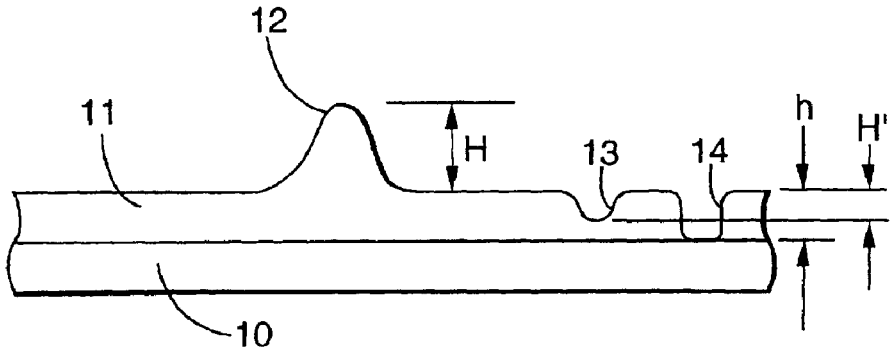
FIG. 1 is a schematic side view of coating defects on a web.

Referring to FIG. 1, a coating of liquid 11 of nominal caliper or thickness h is present on a substrate (in this instance, a continuous web) 10. If a random local spike 12 of height H above the nominal caliper is deposited for any reason, or if a random local depression (such as partial cavity 13 of depth H' below the nominal caliper or void 14 of depth h) arises for any reason, then a small length of the coated substrate will be defective and not useable. In the present invention, the coating-wetted surfaces of a suitably large number of pick-and-place improvement devices (not shown in FIG. 1) are brought into periodic (e.g., cyclic) contact with coating 11, whereby uneven portions of the coating such as spike 12 can be picked off and placed at other positions on the substrate, or whereby coating material can be placed in uneven portions of the coating such as cavity 13 or void 14. The pick-and-place devices can if desired be brought into contact with the coating only upon appearance of a defect. Alternatively, the pick-and-place devices can contact the coating whether or not a defect is present at the point of contact.

Figure 2:
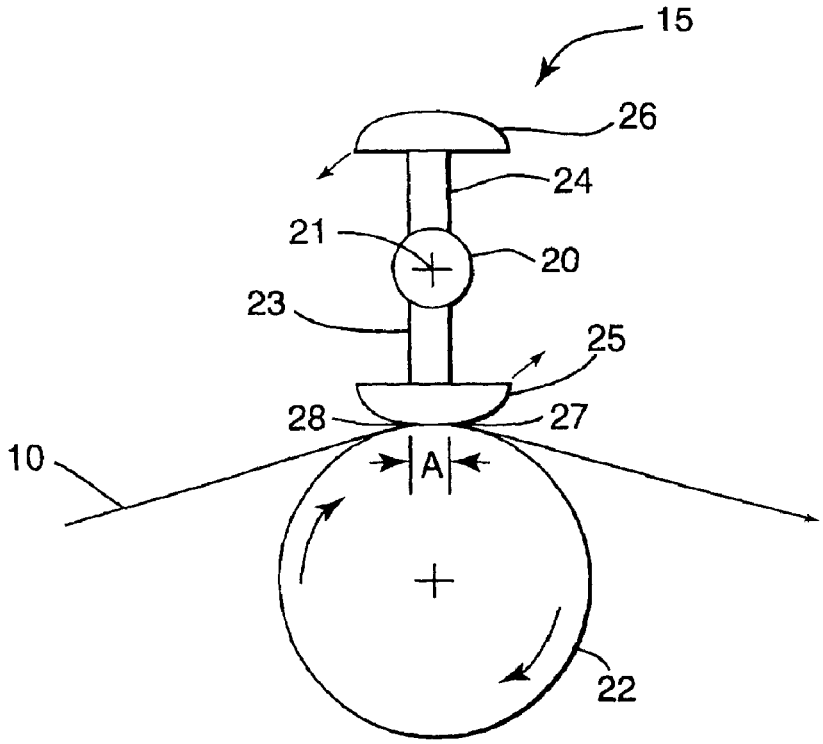
FIG. 2 is a schematic side view of a pick-and-place device.

A type of pick-and-place device 15 that can be used in the present invention to improve a coating on a moving web 10 is shown in FIG. 2. Device 15 has a hub 20 to permit device 15 to rotate about a central axis 21. The hub 20 and axis 21 extend across the coated width of the moving web 10, which is transported past hub 20 on roll 22. Extending from hub 20 are two radial arms 23 and 24 to which are attached pick-and-place surfaces 25 and 26. Surfaces 25 and 26 are curved to produce a singular circular arc in space when surfaces 25 and 26 are rotated about axis 21. Because of their rotation and spatial relation to the web 10, pick-and-place surfaces 25 and 26 periodically contact web 10 opposite roll 22. Wet coating (not shown in FIG. 2) on web 10 and surfaces 25 and 26 fill a contact zone of width A on web 10 from starting point 28 to split point 27. At the split point, some liquid stays on both web 10 and surface 25 as the pick-and-place device 15 continues to rotate and web 10 translates over roll 22. Upon completing one revolution, surface 25 places the split liquid at a new longitudinal position on web 10. Web 10 meanwhile will have translated a distance equal to the web speed multiplied by the time required for one rotation of the pick-and-place surface 25. In this manner, a portion of a liquid coating can be picked up from one web position and placed down on a web at another position and at another time. Both the pick-and-place surfaces 25 and 26 produce this action.

The period of a pick-and-place device can be expressed in terms of the time required for the device to pick up a portion of wet coating from one position along a substrate and then lay it down on another position, or by the distance along the substrate between two consecutive contacts by a surface portion of the device. For example, if the device shown in FIG. 2 is rotated at 60 rpm and the relative motion of the substrate with respect to the device remains constant, then the period is one second. The present invention employs a suitably large number of pick-and-place devices having the same or substantially the same placement periods, that is, devices whose placement periods are the same to a desired degree of precision. That desired degree of precision will vary depending on the overall number of such pick-and-place devices and upon the desired coating caliper uniformity. In general, the more devices employed, the better the results obtained at a given degree of precision in device placement periods. For example, the device periods can be within ±0.01%, ±0.05%, ±0.1%, ±0.5% or ±1% of one another, with greater precision (e.g., ±0.05%) in the periods of a large number of devices providing results that will in a general correspond to those obtainable using less precision (e.g., ±0.5%) in the periods of a smaller number of devices.

The period of a pick-and-place device can be altered in many ways. For example, the period can be altered by changing the diameter of a rotating device; by changing the speed of a rotating or oscillating device; by repeatedly (e.g., continuously) translating the device along the length of the substrate (e.g., up web or down web) with respect to its initial spatial position as seen by a fixed observer; or by changing the translational speed of the substrate relative to the speed of rotation of a rotating device. The periods of individual devices do not need to remain constant over time, and if varied do not need to vary according to a smoothly varying function.

Many different mechanisms can produce a periodic contact with the liquid coated substrate, and many different shapes and configurations can be used to form the pick-and-place devices. For example, a reciprocating mechanism (e.g., one that moves up and down) can be used to cause the coating-wetted surfaces of a pick-and-place device to oscillate into and out of contact with the substrate. Preferably the pick-and-place devices rotate, as it is easy to impart a rotational motion to the devices and to support the devices using bearings or other suitable carriers that are relatively resistant to mechanical wear.

Although the pick-and-place device shown in FIG. 2 has a dumbbell shape and two noncontiguous contacting surfaces, the pick-and-place device can have other shapes, and need not have noncontiguous contacting surfaces. As is explained in more detail below, the pick-and-place devices can be a series of rolls that contact the substrate, or an endless belt whose wet side contacts a series of wet rolls and the substrate, or a series of belts whose wet sides contact the substrate, or combinations of these. These rotating pick-and-place devices preferably remain in continuous contact with the substrate, with portions of the devices periodically contacting and re-contacting the substrate.

The invention is especially useful for, but not limited to, coating moving endless webs and belts. For brevity and unless the context requires otherwise, such a moving endless web or belt will be collectively referred to herein as a "web". The web can be previously uncoated, or can bear a previously-applied hardened coating, or can bear a previously-applied and unhardened wet coating. Rotating pick-and-place devices are preferred for improving coating quality or minimizing coating defects on such webs. The devices can translate (e.g., rotate) at the same peripheral speed as the moving web, or at a lesser or greater speed. If desired, the devices can rotate in a direction opposite to that of the moving web. Preferably, the rotating pick-and-place devices have the same direction of rotation. More preferably, for applications involving the improvement of a coating on a substrate having a direction of motion, the direction of rotation of at least two such pick-and-place devices is the same as the direction of substrate motion. Most preferably, such pick-and-place devices rotate in the same direction as and at substantially the same speed as the substrate. This can conveniently be accomplished by using corotating undriven rolls that bear against the substrate and are carried with the substrate in its motion.

When initially contacting the coating with a pick-and-place device like that shown in FIG. 2, a length of defective material is produced. At the start, the pick-and-place transfer surfaces 25 and 26 are dry. At the first contact, device 15 contacts web 10 at a first position on web 10 over a region A. At the split point 27, roughly half the liquid that entered region A at the starting point 28 will wet the transfer surface 25 or 26 with coating liquid and be removed from the web. This splitting creates a spot of low and defective coating caliper on web 10 even if the entering coating caliper was uniform and equal to the desired average caliper. When the transfer surface 25 or 26 re-contacts web 10 at a second position, a second coating liquid contact and separation occurs, and a second defective region is created. However, it will be less deficient in coating than the first defective region. Each successive contact produces smaller defective regions on the web with progressively smaller deviations from the average caliper until an equilibrium is reached. Thus the initial contacting produces periodic variations in caliper for a length of time. This represents a repeating defect, and by itself, ordinarily would be undesirable.

There is no guarantee that the liquid split ratio between the web and the surface will remain always at a constant value. Many factors can influence the split ratio, but these factors tend to be unpredictable. If the split ratio changes abruptly, a repeating down web caliper variation will result even if the pick-and-place device has been running for a long time. If foreign material lodges on a transfer surface of the pick-and-place device, the device may create a repeating down web defect at each contact. Thus use of only a single pick-and-place device can potentially create large lengths of scrap material.

The invention employs a sufficient number of pick-and-place devices having the same or substantially the same period of contact in order to achieve a desired degree of coating uniformity. The desired degree and thus the preferred number of devices will depend on the intended use of the coated substrate and the nature of the applied coating. Preferably, five or more pick-and-place devices having the same or substantially the same period of contact are used. More preferably, six or more, eight or more, ten or more, twenty or more or even 40 or more such devices are employed.

When coating a moving web, the pick-and-place devices can be arranged down web from a coating station in an array that will be referred to as an "improvement station." After the coating liquid on the pick-and-place transfer surfaces has built to an equilibrium value, a random high or low coating caliper spike may pass through the station. When this happens, and if the defect is contacted, then the periodic contacting of the web by a single pick-and-place device, or by an array of only a few pick-and-place devices having the same contact period, will repropagate a repeating down web defect in the caliper. Again scrap will be generated and those skilled in coating would avoid such an apparatus. It is in general much better to have just one defect in a coated web rather than a length of web containing multiple images of the original defect.

A random severe initial defect (e.g., a large coating surge, or a complete absence of coating) can be significantly diminished by an improvement station of the invention. The input defects can be diminished to such an extent that they are no longer objectionable. By using the methods and devices of the invention, a new down web coating profile can be created at the exit from the improvement station. That is, by using multiple pick-and-place devices, the multiple defect images that are propagated and repropagated by the first device are modified by additional multiple defect images that are propagated and repropagated by the second and subsequent devices. This can occur in a constructively and destructively additive manner so that the net result is a more uniform caliper or a controlled caliper variation. In effect, multiple waveforms are added together in a manner so that the constructive and destructive addition of each waveform combines to produce a desired degree of uniformity. Viewed somewhat differently, when a coating upset passes through the improvement station a portion of the coating from the high spots is in effect picked off and placed back down in the low spots.

Figure 3:
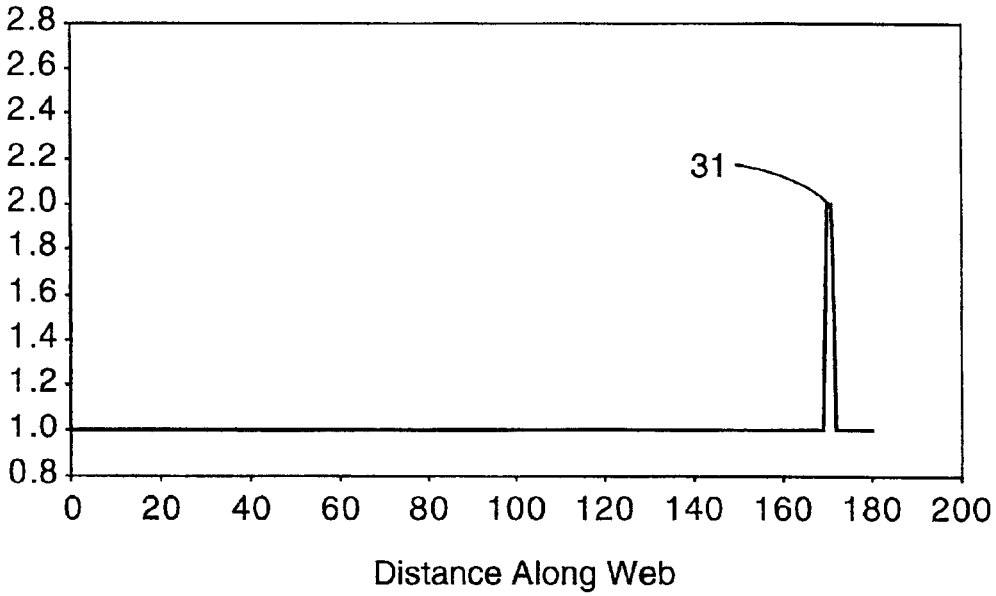
FIG. 3 is a graph of coating caliper vs. web distance for a single large caliper spike on a web.

Mathematical modeling of the improvement process of the invention is helpful in gaining insight and understanding. The modeling is based on fluid dynamics, and provides good agreement to observable results. FIG. 3 shows a graph of liquid coating caliper vs. lengthwise (machine direction) distance along a web for a solitary random spike input 31 located at a first position on the web approaching a periodic contacting pick-and-place transfer device (not shown in FIG. 3). FIG. 4 through FIG. 9 show mathematical model results illustrating the liquid coating caliper along the web when spike input 31 encounters one or more periodic pick-and-place contacting devices.

Figure 4:
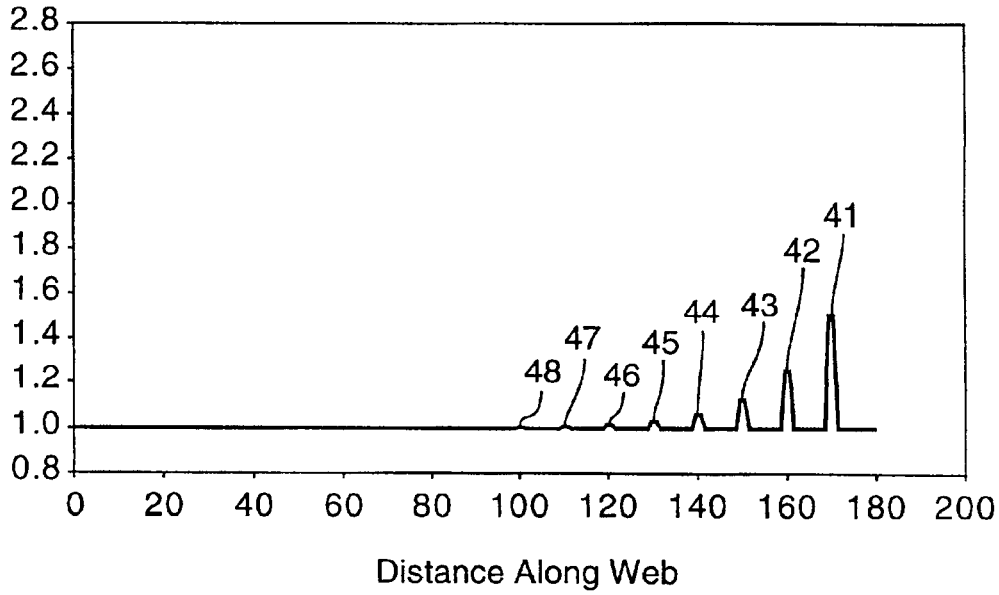
FIG. 4 is a graph of coating caliper vs. web distance when the spike of FIG. 3 encounters a single periodic pick-and-place device having a period of 10.

FIG. 4 shows the amplitude of the reduced spike 41 that remains on the web at the first position and the repropagated spikes 42, 43, 44, 45, 46, 47 and 48 that are placed on the web at second and subsequent positions when spike input 31 encounters a single periodic pick-and-place contacting device. The peak of the initial input spike 31 is one length unit long and two caliper units high. The contacting device period is equivalent to ten length units. The images of the input defect are repeated in 10 unit increments over a length longer than sixty length units. Thus, the length of defectively coated or "reject" web is greatly increased compared to the length of the input defect. The exact defective length, of course, depends on the acceptable coating caliper variability for the desired end use.

Figure 5:
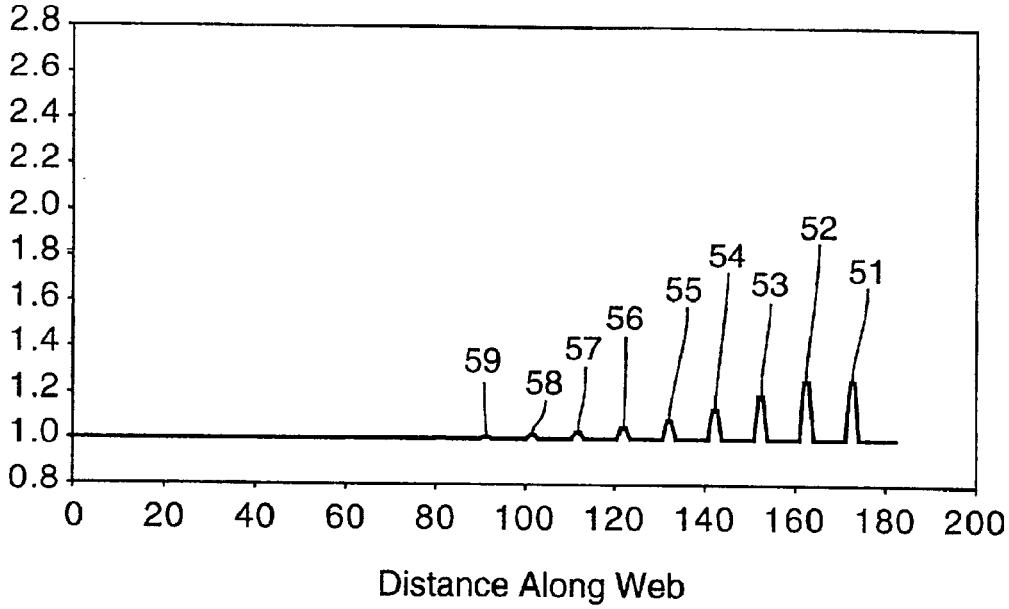
FIG. 5 is a graph of coating caliper vs. web distance when the spike of FIG. 3 encounters two periodic pick-and-place devices having a period of 10.

FIG. 5 shows the amplitude of the reduced spike 51 that remains on the web at the first position and some of the repropagated spikes 52, 53, 54, 55, 56, 57, 58 and 59 that are placed on the web at second and subsequent positions when spike input 31 encounters two periodic, sequential, synchronized pick-and-place transfer devices each having a period of 10 length units. Compared to the use of a single periodic pick-and-place device, a lower amplitude spike image occurs over a longer length of the web.

Figure 6:
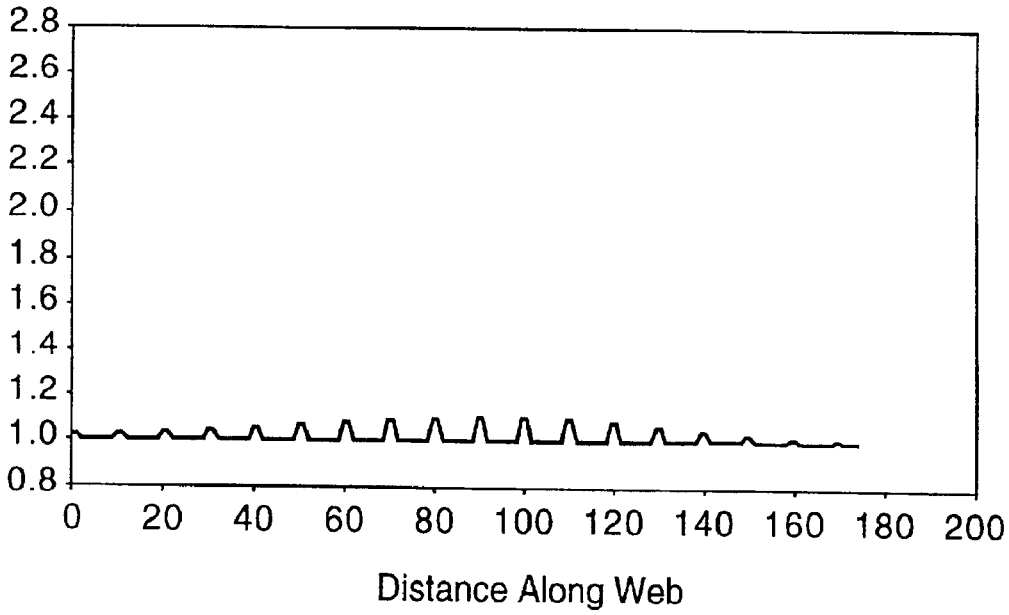
FIG. 6 is a graph of coating caliper vs. web distance when the spike of FIG. 3 encounters eight periodic pick-and-place devices having a period of 10.

FIG. 6 shows the results for a train of eight contacting devices having a period of 10. As can be seen by comparing FIG. 6 and FIG. 5, the improvement station of FIG. 6 tends to produce a longer length of defective web than the improvement station of FIG. 5, but the overall magnitude of the spike images is significantly reduced in FIG. 6.

Similar coating improvement results are obtained when the random defect is a depression (e.g., an uncoated void) or bar mark rather than a spike. The graphs have a similar but inverted appearance and the caliper change is negative rather than positive.

The random spike and depression defects discussed above are one general class of defect that may be presented to the improvement station. The second important class of defect is a repeating defect. Of course, in manufacturing coating facilities it is common to have both classes occurring simultaneously. If a repeating train of high or low coating spikes or depressions is present on a continuously running web, the coating equipment operators usually seek the cause of the defect and try to eliminate it. A single periodic pick-and-place device as illustrated in FIG. 2 may not help and may even further deteriorate the quality of the coating. However, intermittent contacting of the coating by devices similar in function to that exemplified in FIG. 2 produces a desirable improvement in coating uniformity in grossly defective coatings when a suitable number of devices whose periods are the same or substantially the same are employed. Improvements are found for both random and repeating variations and combinations of the two. In general, better results will be obtained when rolls running in continuous contact with the coating are employed. Because every increment of a roll surface running on a web periodically contacts the web, a roll surface can be considered to be a series of connected intermittent periodic contacting surfaces. Similarly, a rotating endless belt can perform the same function as a roll. If desired, a belt in the form of a Mobius strip can be employed. Those skilled in the art of coating will recognize that other devices such as elliptical rolls or rotating brushes can be adapted to serve as periodic pick-and-place devices in the present invention. Exact periodicity of the devices is not required. Mere repeating contact will suffice.

Figure 7:
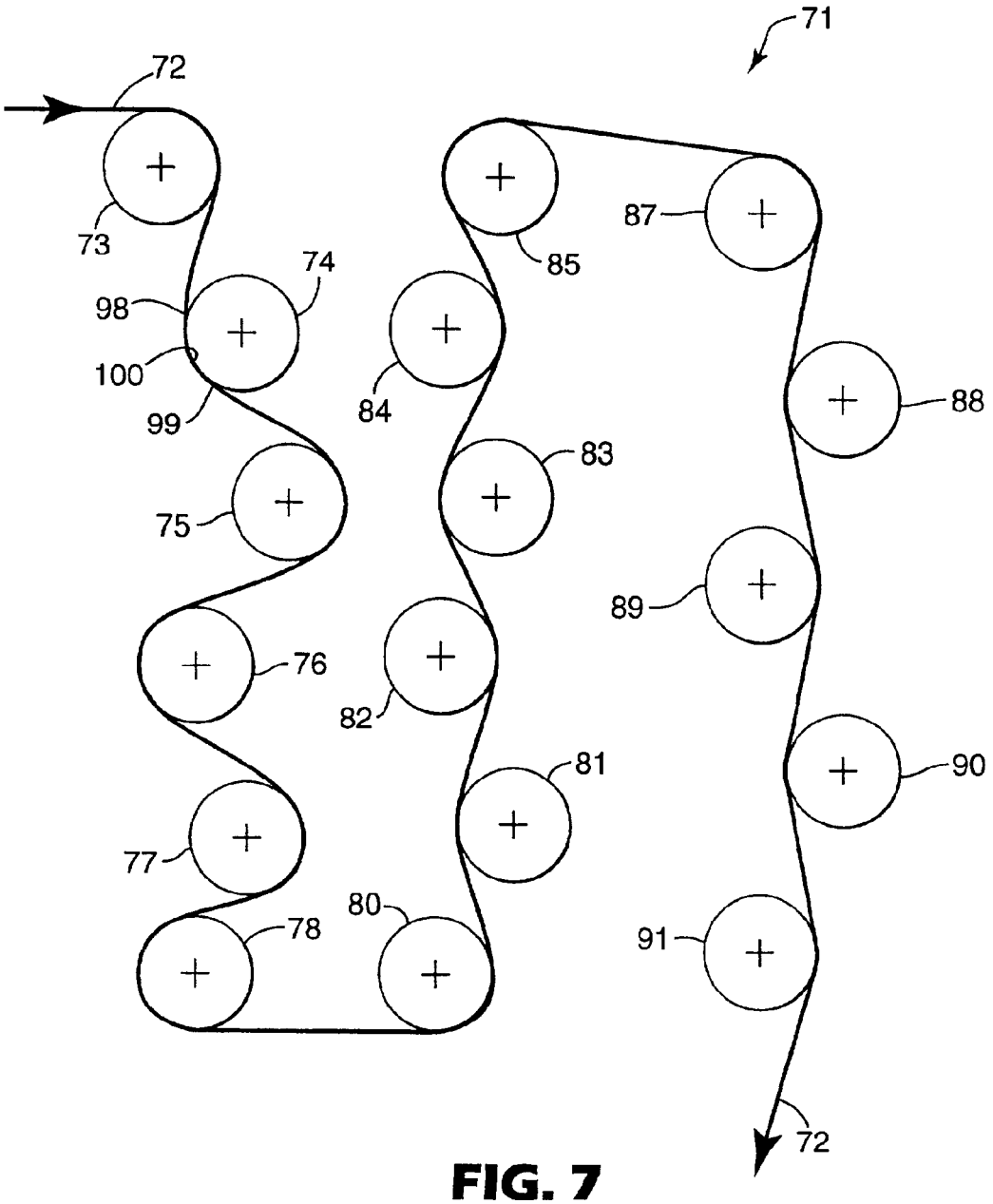
FIG. 7 is a schematic side view of a portion of a pick-and-place device that employs a set of twenty equal diameter undriven contacting rolls.

FIG. 7 shows a uniformity improvement station 71 that uses a train of twenty pick-and-place roll contactors, eight of which are shown in FIG. 7. Liquid-coated web 72 is coated on its upper surface prior to entering improvement station 71 using a coating device not shown in FIG. 7. Liquid coating caliper on web 72 spatially varies in the down-web direction at any instant in time as it approaches idler roll 73 and pick-and-place contactor roll 74. To a fixed observer, the coating caliper would exhibit time variations. This variation may contain transient, random, repeating, and transient repeating components in the down web direction. Web 72 is directed along a path through station 71 and into contact with the pick-and-place contactor rolls 74, 76, 78, 80, 82, 84, 88 and 90 by idler rolls 73, 75, 77, 81, 83, 85, 87, 89 and 91. The path is chosen so that the wet coated side of the web comes into physical contact with the pick-and-place rolls. Pick-and-place rolls 74, 76, 78, 80, 82, 84, 88 and 90 (which as shown in FIG. 7 all have the same diameter) are undriven and corotate with the motion of web 72. Web 72 continues past an additional 12 pick-and-place rolls (and additional idler rolls as needed), but not shown in FIG. 7.

Referring for the moment to pick-and place roll 74, the liquid coating splits at lift off point 99. A portion of the coating travels onward with the web and the remainder travels with roll 74 as it rotates away from lift off point 99. Variations in coating caliper just prior to lift off point 99 are mirrored in both the liquid caliper on web 72 and the liquid caliper on the surface of roll 74 as web 72 and roll 74 leave lift off point 99. After the coating on web 72 first contacts roll 74 and roll 74 has made one revolution, the liquid on roll 74 and incoming liquid on web 72 meet at the initial contact point 98, thereby forming a liquid filled nip region 100 between points 98 and 99. Region 100 is without air entrainment. To a fixed observer, the flow rate of the liquid entering this nip contact region 100 is the sum of the liquid entering on the web 72 and the liquid entering on the roll 74. The net action of roll 74 is to pick material from web 72 at one position and place a portion of the material down again at another position.

In a similar fashion, the liquid coating splits at lift off points on the pick-and-place contactor rolls throughout the remainder of improvement station 71. A portion of this split coating re-contacts web 72 and is reapplied thereto at contact points throughout the remainder of station 71.

As with the trains of intermittent pick-and-place contacting devices discussed above, random or repeating variations in the liquid coating caliper on the incoming web will be reduced in severity and desirably the variations will be substantially eliminated by the pick-and-place action of the periodic contacting rolls.

Figure 8:
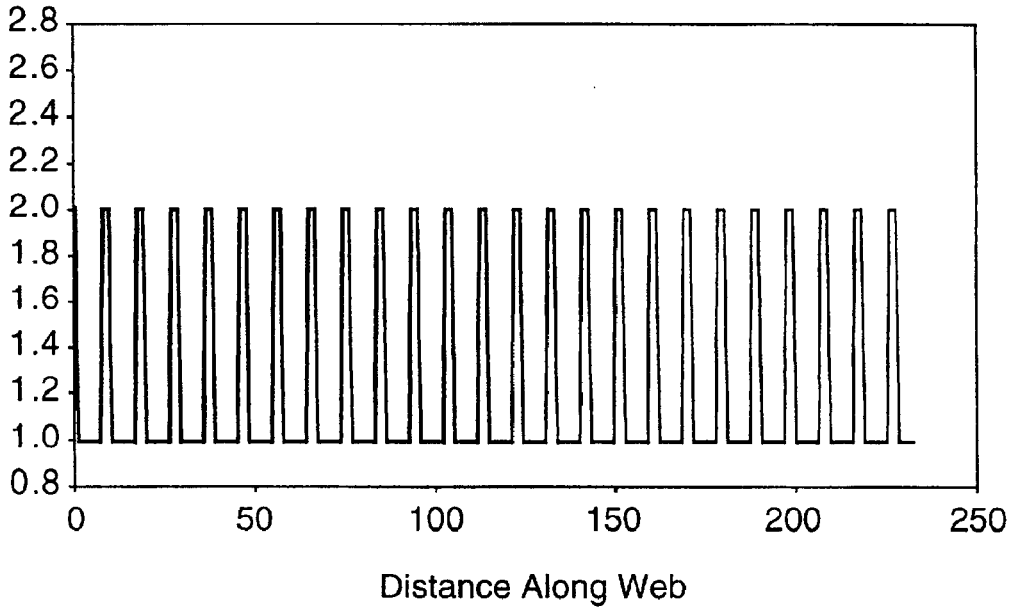
FIG. 8 is a graph of coating caliper vs. web distance for a repeating spike defect having a period of 10.
Figure 9:
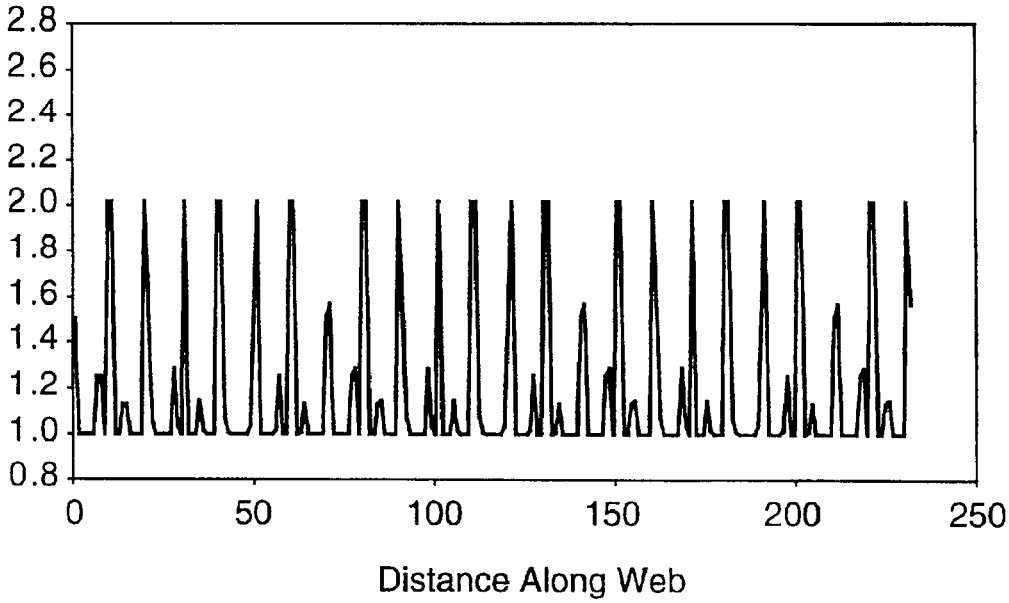
FIG. 9 is a graph of coating caliper vs. web distance when the spike of FIG. 8 encounters a periodic pick-and-place roll device having a period of 7.

FIG. 8 shows a graph of liquid coating caliper vs. distance along a web for a succession of equal amplitude repeating spike inputs approaching a periodic contacting pick-and-place transfer device. If a pick-and-place device periodically and synchronously contacts this repeating defect and if the period exactly equals the defect period, there is no change produced by the device after the initial start-up. This is also true if the period of the device is some integer multiple of the defect period. Simulation of the contacting process shows that a single device will produce more defective spikes if the period is shorter than the input defect period. FIG. 9 shows this result when a repeating defect having a period of 10 encounters a periodic pick-and-place roll device having a period of 7.

Figure 10A:
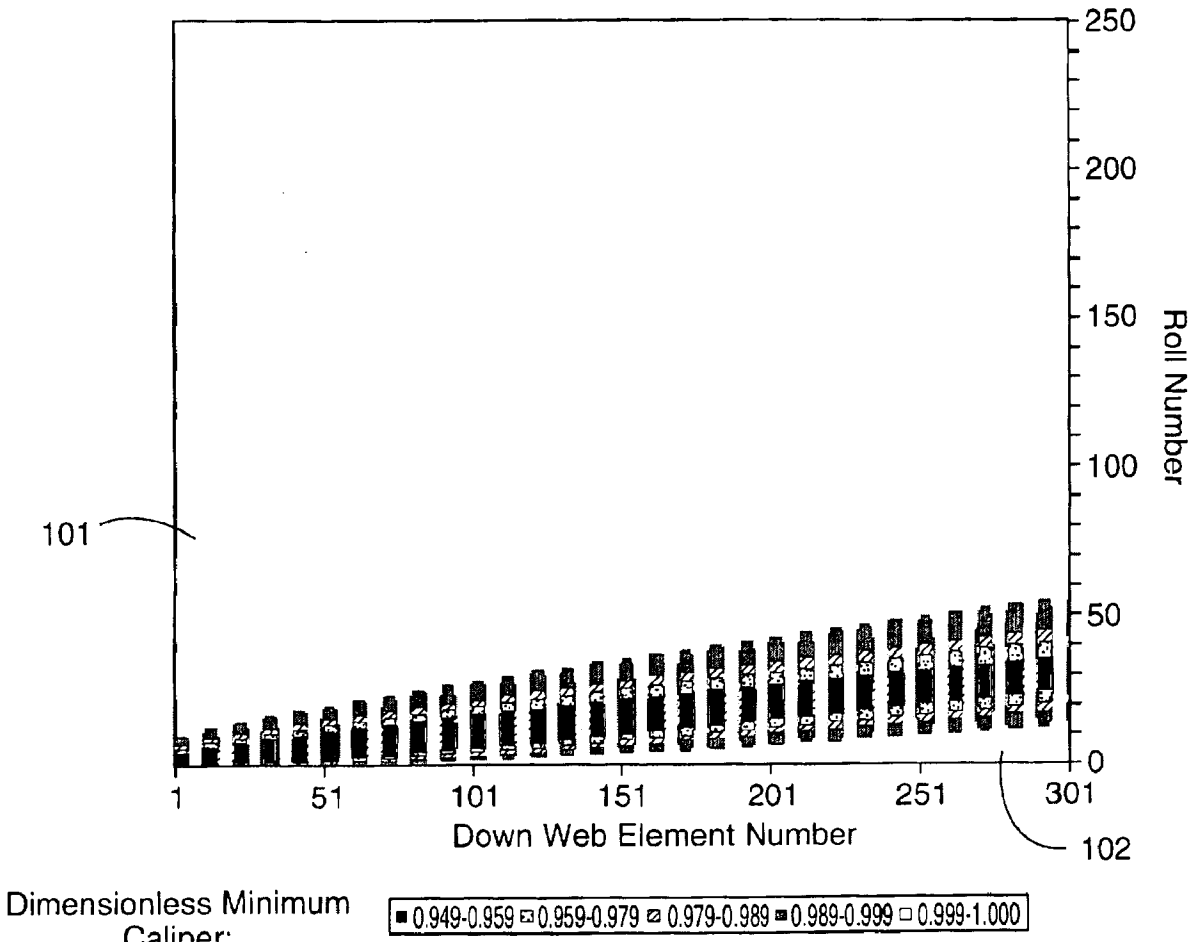
FIGS. 10*a* though 10*d* are patterned contour plots of coating caliper vs. web distance when a single severe void passes through an improvement station containing 250 equally-sized rolls each having a period of 10 dimensionless web length elements.
Figure 10B:
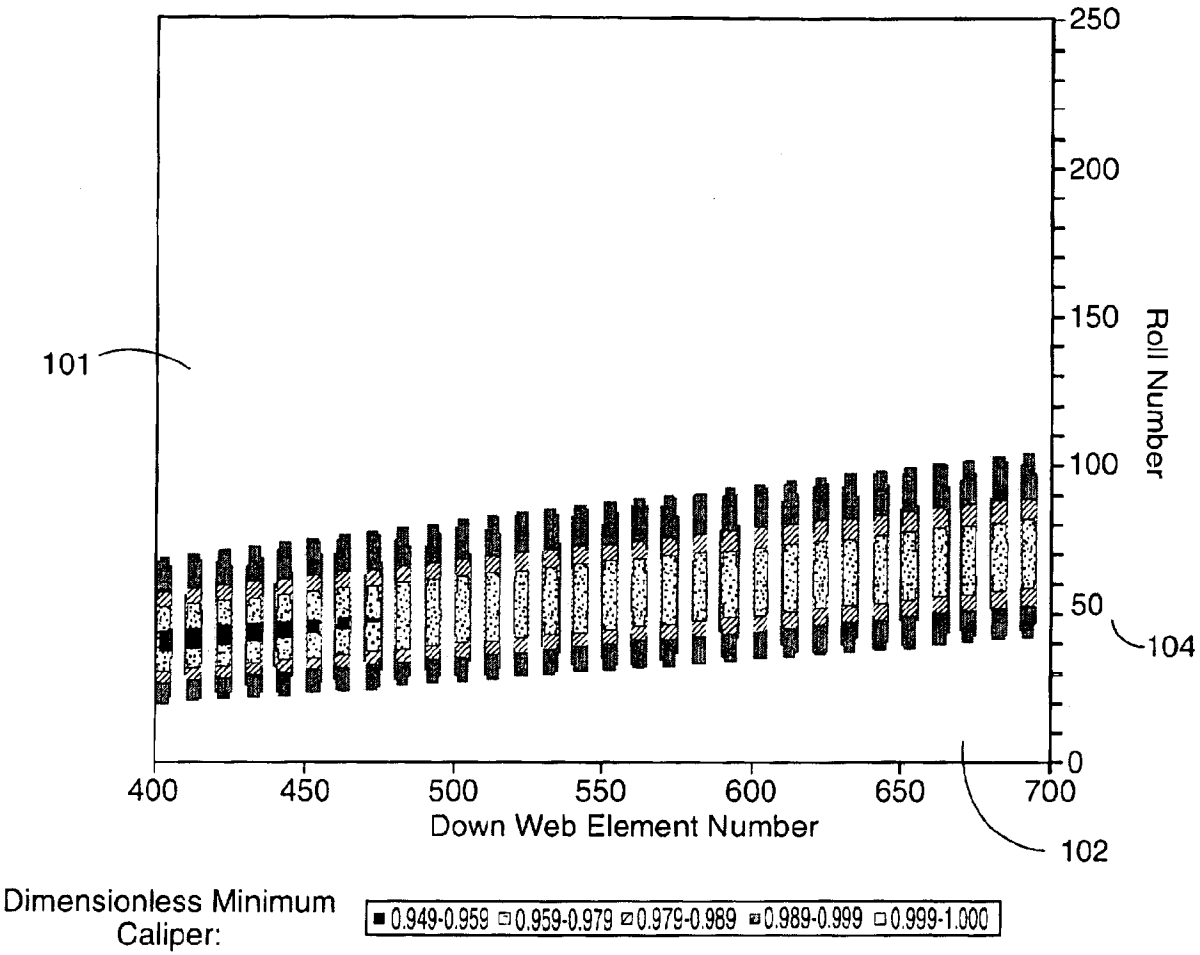
FIGS. 10*e* through 10*g* are line plots illustrating the down web caliper profile as the void of FIGS. 10*a* through 10*d* contacts the first through third, fourth through fifth and sixth through ninth rolls of the improvement station.
Figure 10C:
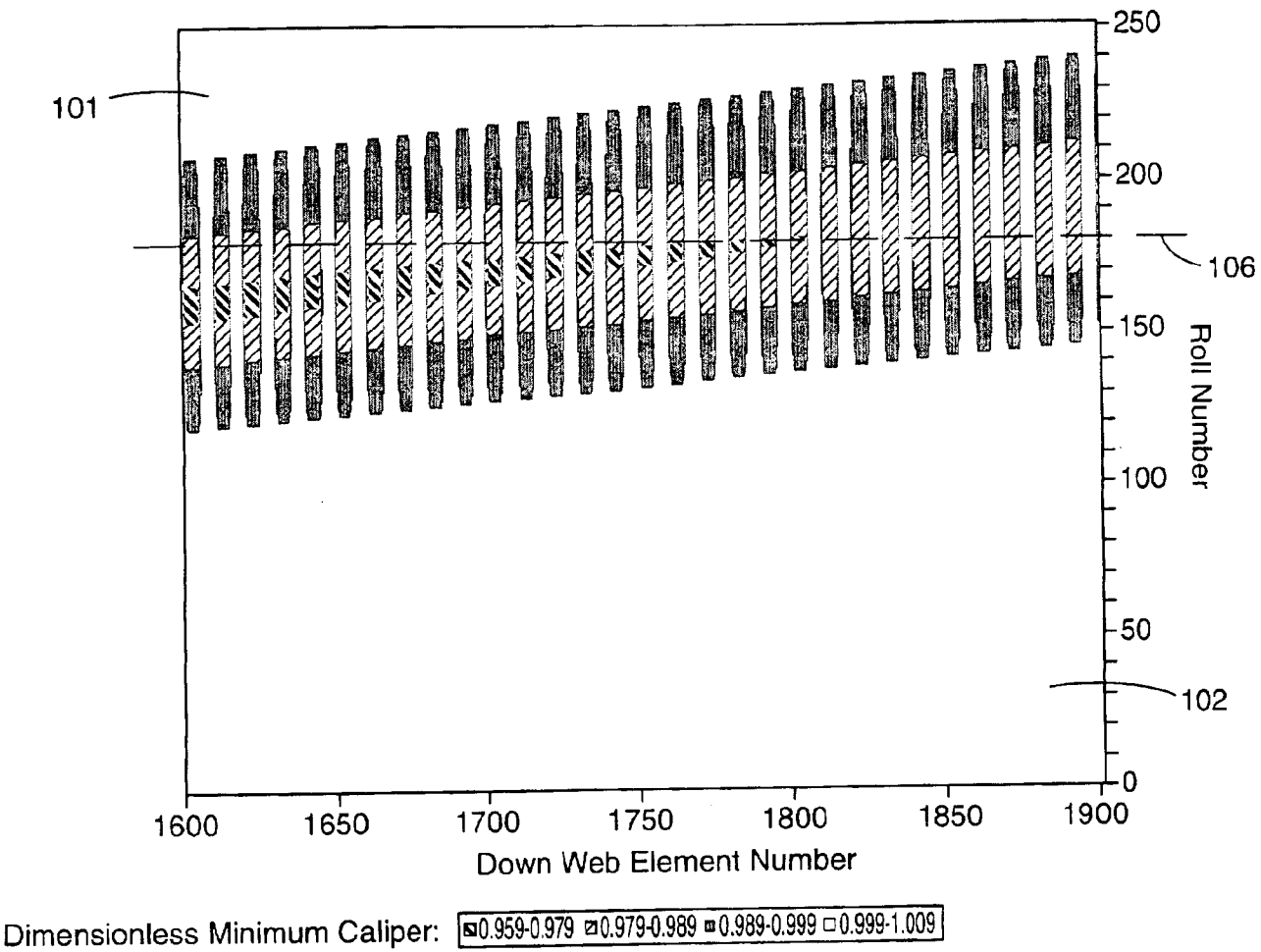
Figure 10D:
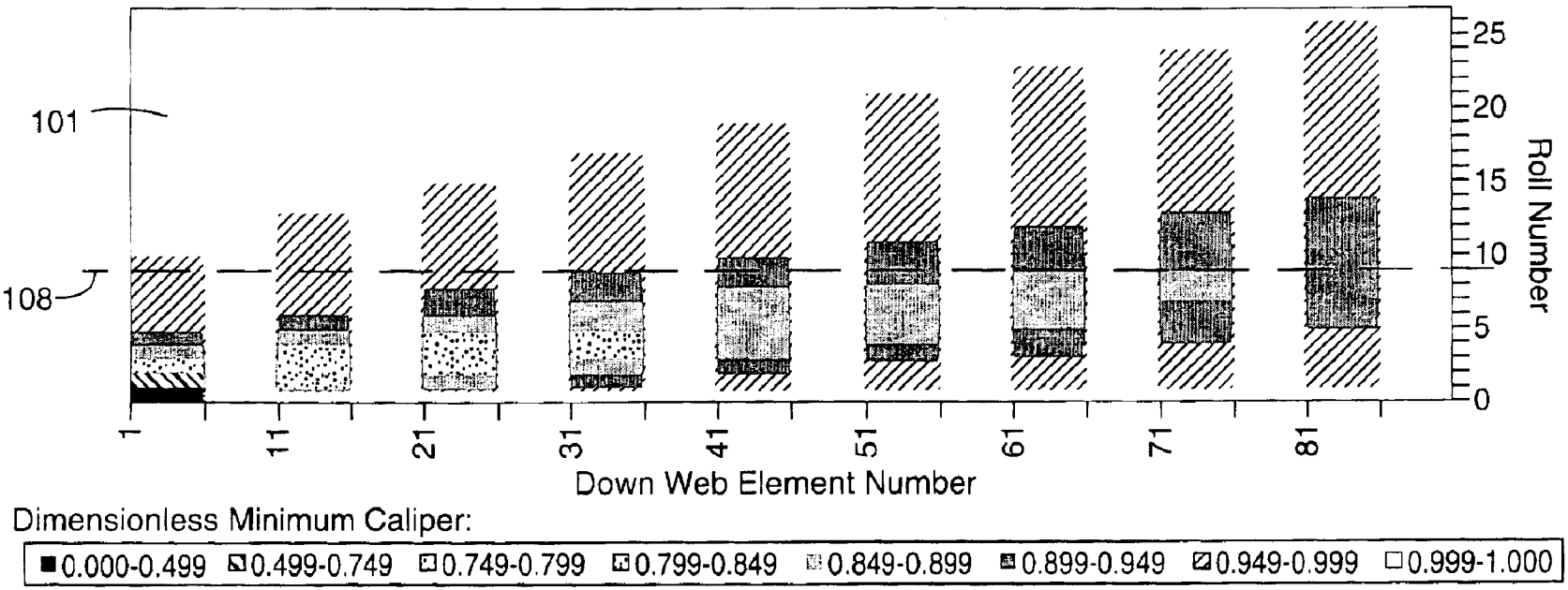

However, by using a suitably large number of devices, the quality of even a grossly non-uniform input coating can be improved. The simulation shown in FIGS. 10*a* through FIG. 10*d* illustrates the effect of uniform size rolls on a void. FIGS. 10*a* through 10*d* are patterned contour plots of coating caliper. FIGS. 10*a* through 10*c* illustrate the down web coating caliper that results when a single, random, relatively severe void interrupts a uniform steady coating and passes through an improvement station containing 250 equally-sized rolls each having a period of 10 dimensionless web length elements. The simulation calculated the coating caliper of each of 1900 successive down web length elements following the first element containing the void as it passes through the improvement station. FIG. 10*a* depicts the results for down web length elements 1 through 301. FIG. 10*b* depicts the results for down web length elements 400 through 700. FIG. 10*c* depicts the results for down web length elements 1600 through 1900. FIG. 10*d* provides a higher resolution view of a portion of FIG. 10*a*, together with a change in scaling the contours to show the results for only the first 85 down web length elements and only the first 26 rolls of the improvement station. The initial void was assumed to be a complete absence of coating for a period equal to 50% of the rotation period of the rolls. Such a void can be generated by accidentally lifting a running web Out of contact with a gravure roll for an instant during continuous coating. The x-axis in FIGS. 10*a* through 10*d* represents dimensionless length elements of the down web coating lane commencing with the void. The web length elements pass sequentially from a specified roll of the improvement station to subsequent rolls in the improvement station. The coating calipers of individual web length elements are normalized by dividing by the uniform, void-free coating caliper.

The dimensionless caliper or caliper range is plotted in FIGS. 10*a* through 10*d* by shading or patterning each element of the web length of interest according to its coated caliper. For FIG. 10*a* and FIG. 10*b*, the shades or patterns depict dimensionless caliper ranges of 0.949 to 0.959, 0.959 to 0.979, 0.979 to 0.989, 0.989 to 0.999 and 0.999 to 1.000. For FIG. 10*c*, the shades or patterns depict dimensionless caliper ranges of 0.959 to 0.979, 0.979 to 0.989, 0.989 to 0.999 and 0.999 to 1.000. For FIG. 10*d*, the shades or patterns depict dimensionless caliper ranges of 0.000 to 0.499, 0.499 to 0.749, 0.749 to 0.799, 0.799 to 0.849, 0.849 to 0.899, 0.899 to 0.949, 0.949 to 0.999 and 0.999 to 1.000. Each element of the web length of interest is shown after it has been contacted by the contacting rolls. A plot is generated by stacking coated caliper element strings along the y-axis. For example, the shaded plot area from web element 1 to web element 2 and from roll 0 to roll 1 depicts the caliper of the first web element before it passes the first roll. Advancing along or parallel to the x-axis of FIGS. 10*a* through 10*d* gives the dimensionless caliper along a contiguous group of length elements down the web. Advancing up or parallel to the y-axis gives the dimensionless caliper history for a particular web length element after it passes roll after roll for a series of 251 rolls. Images of the initial void propagate along the web and are modified as the web elements pass each roll. A diminished image of the void is produced upon each successive roll as the void passes by each roll. This diminished image re-contacts succeeding elements on the web, producing more diminished images on the web which in turn produce yet more diminished images on the succeeding rolls.

The white regions 101 and 102 in FIGS. 10*a* through 10*c* and the white region 101 in FIG. 10*d* have a dimensionless caliper between 0.999 and 1.0000 (99.9% to 100.00% of the average void-free caliper), and thus represent regions of very uniform coating caliper. As shown by dashed line 106 in FIG. 10*c*, after passing approximately 180 rolls the web element containing the initial void and successive elements all have a dimensionless caliper between 0.959 and 1.000 (95.9% to 100.0% of the average void-free caliper). If a less uniform coating is acceptable, such as a range from 94.9% to 100% of the average void-free caliper, then as shown by dashed line 104 in FIG. 10*b*, only 49 rolls are required. Likewise, if a range from 84.9% to 100% of the average void-free caliper is acceptable, then as shown by dashed line 108 in FIG. 10*d*, only 9 rolls are required.

Figure 10E:
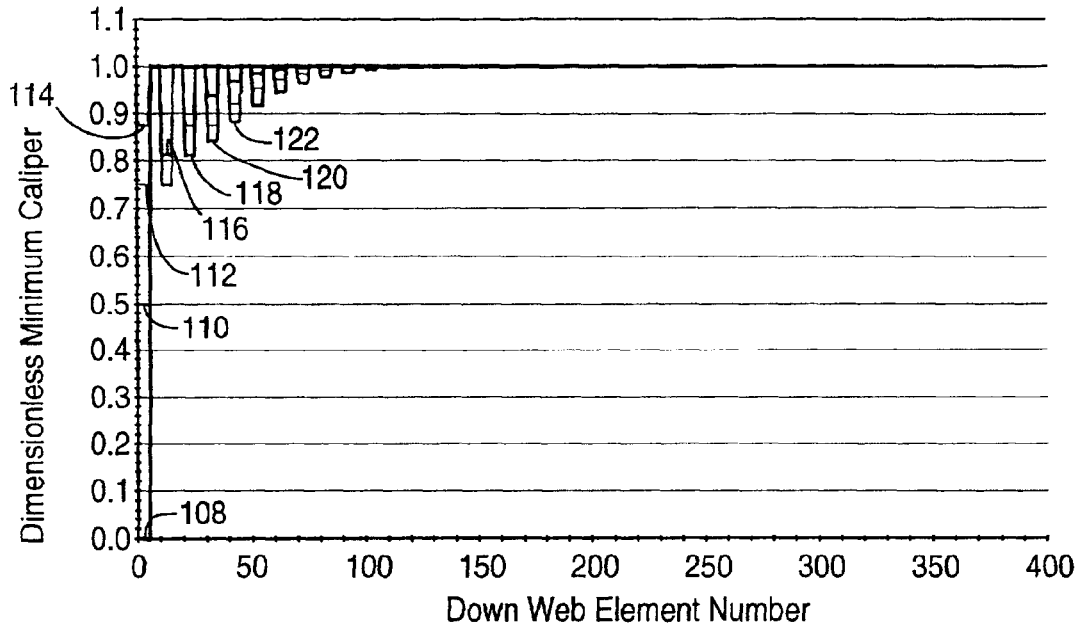
Figure 10F:
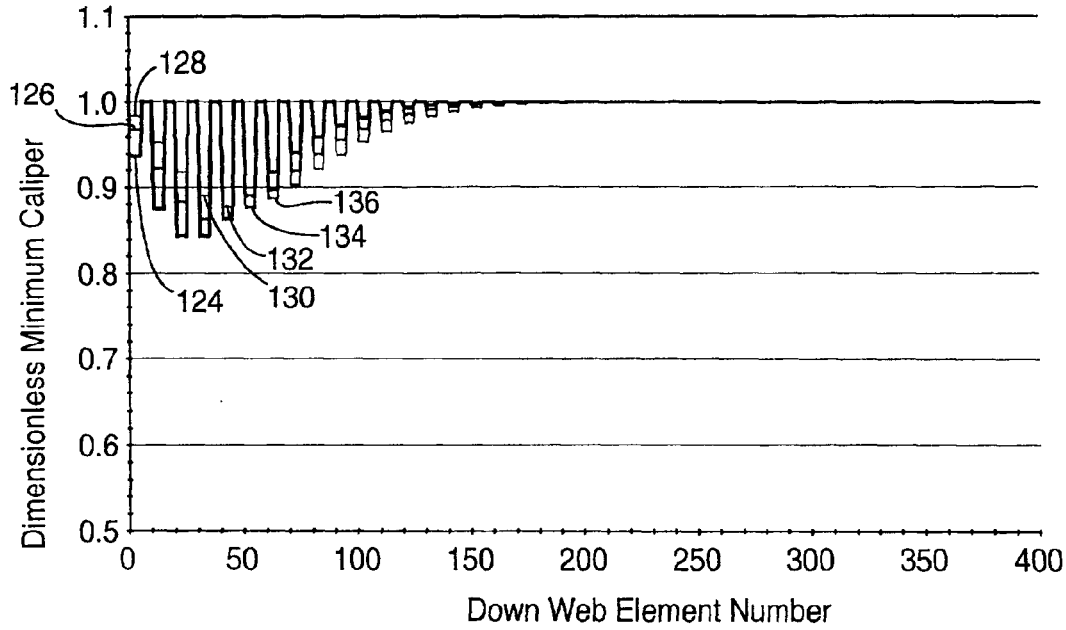
Figure 10G:
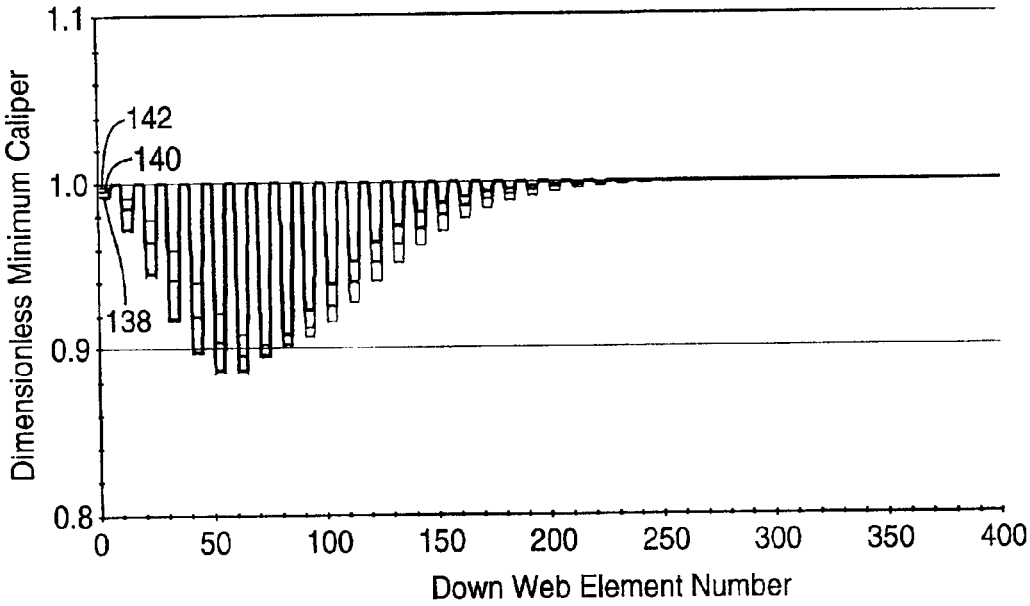

FIGS. 10*e* through 10*g* further illustrate the down web caliper profile as the void of FIGS. 10*a* through 10*d* contacts the first nine rolls of the improvement station, in the form of line plots tracing the dimensionless caliper at each web element location for the first 400 web elements following the void. A different line is plotted for the coating profile after passage by each roll. Results for each passage often fall on top of one another. In order better to illustrate the outcome, different and successively more refined dimensionless caliper scales were used in FIGS. 10*e* through 10*g*. The void images decrease in depth and the dimensionless caliper improves following passage of a suitable number of the web elements past the improvement station rolls.

FIG. 10*e* shows the initial caliper (plot 108) before and the down web caliper profile after the first 400 web elements pass the first roll (plot 110), second roll (plot 112) and third roll (plot 114). After the third roll, the initial 5 element long void has propagated as five images 114, 116, 118, 120 and 122 having a caliper less than 90% of the average void-free caliper, with images 116, 118 and 120 having a caliper less than 85% of the average void-free caliper.

FIG. 10*f* shows the profile after passing the fourth roll (plot 124), fifth roll (plot 126) and sixth roll (plot 128). After the sixth roll the initial void is still mirrored as four images 130, 132, 134 and 136 having calipers less than 90% of the average void-free caliper, but with no images having a caliper less than 85% of the average void-free caliper.

FIG. 10*g* shows the profile after passing the seventh roll (plot 138), eighth roll (plot 140) and ninth roll (plot 142). After nine rolls, all images of the initial void have calipers greater than 90% of the average void-free caliper. Thus in this fashion an initial severe defect has been greatly reduced in severity, thereby permitting recovery of miscoated web that would otherwise have to be scrapped.

Comparable results are found for coating defects characterized by coating excesses rather than voids. For example, if a coating surge results in an initial dimensionless caliper of 2.0 (200% of the average void-free caliper), then use of an improvement station having a sufficient number of rolls as described above can provide coated web in which images of the defect are less than 115% (using six rolls) or less than 110% (using nine rolls) of the average void-free caliper. Thus a web having instantaneous coating caliper defects ranging from a void of 0% to an excess of 200% of a desired or target average caliper value can be converted using a six roll improvement station of the invention into a web whose coating caliper is between 85% and 115% of the desired average caliper value. For coatings of modest uniformity requirements, variations of 85 to 115 percent of the target can be adequately functional. Methods that achieve this degree of uniformity represent a preferred aspect of the invention. In the same fashion, a web having instantaneous coating caliper defects ranging from 0% to 200% of the desired average caliper value can be converted using a nine roll improvement station of the invention into a web whose coating caliper is between 90% and 110% of the desired average caliper value. Methods that achieve this degree of uniformity represent a more preferred aspect of the invention. The invention is of course not limited to use with coatings having the above-mentioned ranges of coating defects. The coating defects can span a smaller or greater overall range. However, examination of the manner in which wet coating defects ranging from a specified minimum value to a specified maximum value are affected by the pick-and-place devices serves as a useful metric for characterizing the nature of the improvement provided by the present invention.

Factors such as drying, curing, gellation, crystallization or a phase change occurring with the passage of time can impose limitations on the number of rolls employed. If the coating liquid contains a volatile component, the time necessary to translate through many rolls may allow drying to proceed to the extent that the liquid may solidify. Drying is actually accelerated by the present invention, providing certain advantages discussed in more detail below. In any event, if a coating phase change occurs on the rolls for any reason during operation of the improvement station, this will usually lead to disruptions and patterns in the coating on the web. Therefore, in general it is preferred to produce the desired degree of coating uniformity using as few rolls as possible. However, under the right conditions very large numbers of rolls (e.g., as many as 10, 20, 50, 100 or even 1000 or more rolls) can be employed in the invention. Drying can be discouraged by placing the improvement station (and optionally the coating station and drying station, if employed) of the coating apparatus in a suitable enclosure and flooding the inside of the enclosure with vapors of any solvents present in the coating liquid. A preferred technique for discouraging such drying is to circulate a non-reactive gas saturated with such vapors through the enclosure as described, for example, in U.S. Pat. No. 6,117,237.

By using multiple pick-and-place rolls, it is possible simultaneously to reduce the amplitude of and to merge successive spikes or depressions together to form a continuously slightly varying but spike- and depression-free coating of good uniformity. As shown above, this can be accomplished by using roll devices of equal diameters that are undriven and corotate with the web at equal speeds. Improvements in coating uniformity can also be obtained by varying the diameters of a train of roll devices. If the rolls are not rotated by the traction with the web, but instead are independently driven, then the period of each roll is related to its diameter and rate of rotation.

The desired caliper will of course depend on the particular application. For example, the requirements for coated abrasives, tape and optical films will all differ from one another. The requirements will also differ within a class of products. For example, coarse abrasives used for woodworking have a less stringent caliper uniformity requirement than microabrasives used for polishing disk drive parts. In general, the thinner the average caliper, the more stringent the uniformity requirement.

Figure 11:
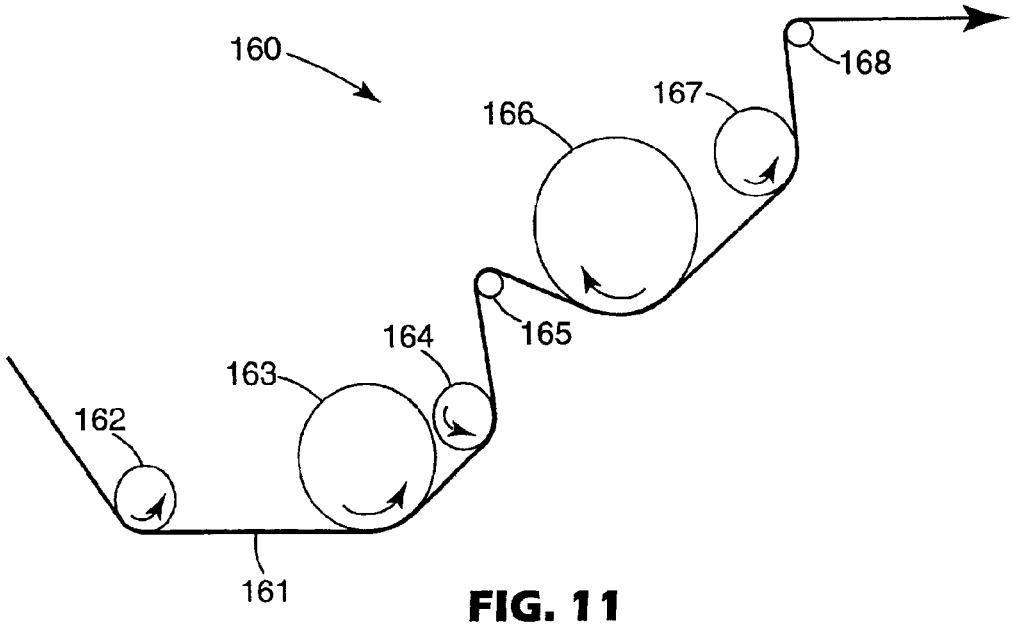
FIG. 11 shows a uniformity improvement station that uses a train of five driven pick-and-place roll contactors having different diameters but equal periods.

FIG. 11 shows a uniformity improvement station 160 that uses a train of five driven pick-and-place roll contactors having different diameters but equal periods. Liquid-coated web 161 is coated on its upper surface prior to entering improvement station 160 using a coating device not shown in FIG. 11. Web 161 is directed along a path through station 160 and into contact with the corotating driven pick-and-place contactor rolls 162, 163, 164 and 167 and the counter rotating driven pick-and-place contactor roll 166 by idler rolls 165 and 168. The speeds of pick-and-place contactor rolls 162, 163, 164, 166 and 167 are adjusted using speed regulation devices (not shown in FIG. 11) so that each pick-and-place contactor roll has the same period.

Figure 12:
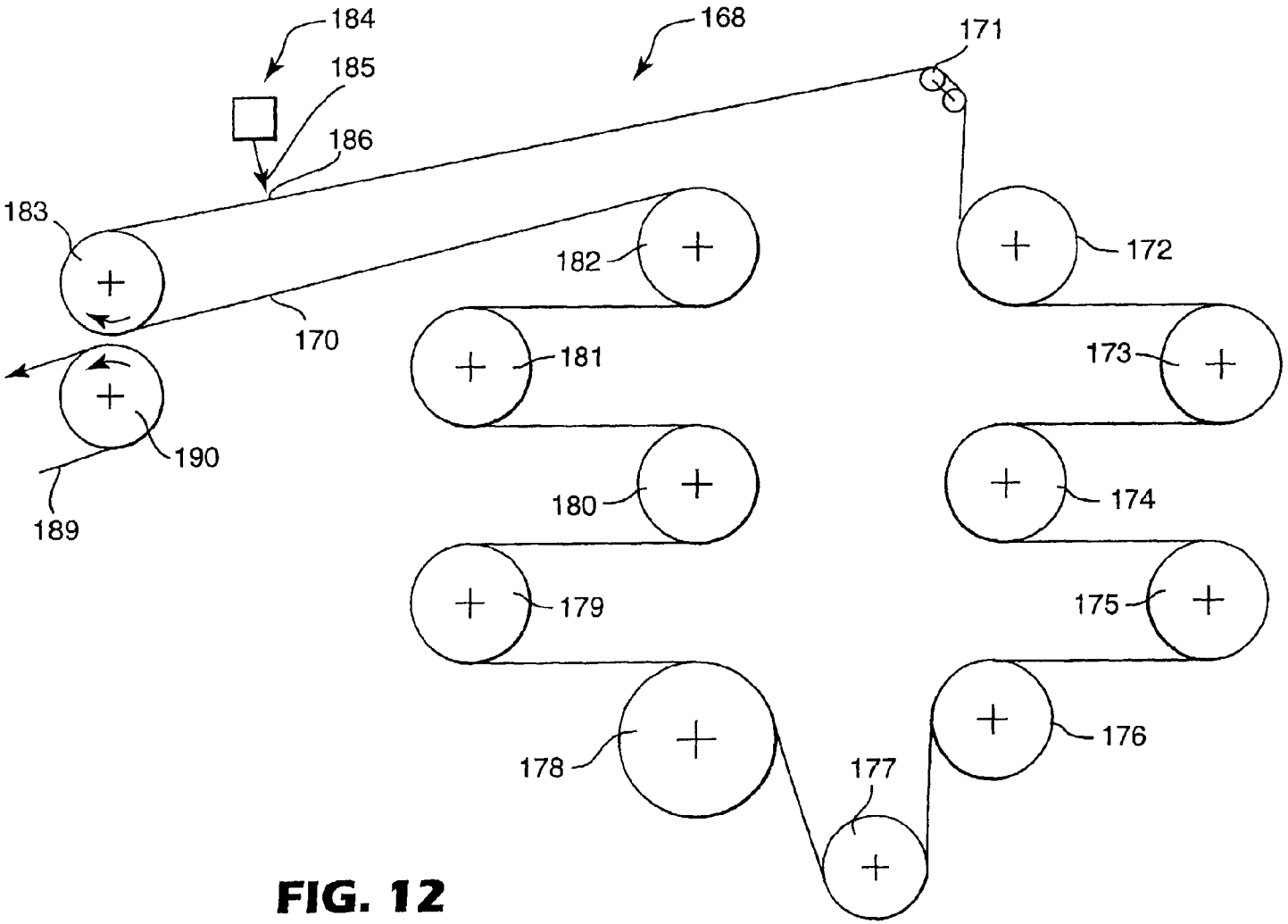
FIG. 12 is a schematic side view of a pick-and-place device that employs a transfer belt.

FIG. 12 shows a coating apparatus of the invention 168 employing a belt 170. Belt 170 circulates on steering unit 171; idlers 173, 175, 177, 179, and 181; undriven corotating pick-and-place rolls 172, 174, 176, 178, 180 and 182 and back-up roll 183. Rolls 172, 174, 176, 180 and 182 are all the same size and have the same period. Roll 178 is larger than the other pick-and-place rolls and has a much longer period. Improvement station 168 thus contains five pick-and-place contacting devices having substantially the same contact period. Intermittent coating station 184 oscillates a hypodermic needle 185 back and forth across belt 170 at stripe coating region 186. The applied stripe forms a zig-zag pattern upset across belt 170, thereby creating an intermittent coating defect downstream from station 184. Following startup of the equipment and a few rotations of belt 170, belt 170 will become wet across its entire surface with an uneven coating. If the speed of the belt and the traversing period and fluid delivery rate of the needle are held constant, then to a fixed observer viewing a point atop the belt just downstream from region 186, the coating caliper on the belt will range from a minimum to a maximum value and back. If the speed of the belt or the needle traversing period or delivery rate are not held constant, then the observed coating could contain additional transient, random, repeating, or transient repeating components in the belt length direction. In either case, the coating will be very uneven. The advantages of such a stripe coating belt station are discussed in more detail below.

As belt 170 circulates past the pick-and-place rolls 172, 174, 176, 178, 180 and 182, the coating liquid on belt 170 contacts the surfaces of pick-and-place rolls 172, 174, 176, 178, 180 and 182. Following startup of the equipment and a few rotations of belt 170, the coating liquid wets the surfaces of pick-and-place rolls 172, 174, 176, 178, 180 and 182. The liquid coating splits at the trailing end (the lift-off points) of the liquid-filled nip regions where belt 170 contacts pick-and-place rolls 172, 174, 176, 178, 180 and 182. A portion of the coating remains on the pick-and-place rolls 172, 174, 176, 178, 180 and 182 as they rotate away from the lift-off points. The remainder of the coating travels onward with belt 170. Variations in the coating caliper just prior to the lift-off points will be mirrored in both the liquid caliper variation on belt 170 and on the surfaces of the pick-and-place rolls 172, 174, 176, 178, 180 and 182 after they leave lift-off points. Following further movement of belt 170, the liquid on the pick-and-place rolls 172, 174, 176, 178, 180 and 182 will be redeposited on belt 170 in new positions along belt 170.

The embodiment of FIG. 12 as so far described can be used to produce a uniform coating on the belt itself, or to improve coating uniformity on a previously coated belt. The wet belt 170 can also be used to transfer the coating to a target web substrate 189. For example, target web 189 can be driven by powered roll 190 and brought into contact with belt 170 as belt 170 circulates around back-up roll 183. To coat web 189, rolls 183 and 190 are nipped together, thus forcing belt 170 into face-to-face contact with web 189. Upon passing from this nip region and separating from belt 170, some portion of the liquid coating will be transferred to the surface of web 189. When using the device to continuously coat the target web 189, liquid is preferably constantly added to belt 170 at region 186 on each revolution of the belt, and continuously removed at the nip point between rolls 183 and 190. Because following startup, belt 170 will already be coated with liquid, there will not be a three phase (air, coating liquid and belt) wetting line at stripe coating region 186. This makes application of the coating liquid much easier than is the case for direct coating of a dry web. Since only about one half the liquid is transferred at the 183, 190 roll nip, the percentage of caliper non-uniformity downstream from region 186 will generally be much smaller (e.g., by as much as much as half an order of magnitude) than when stripe coating a dry web without a transfer belt and passing the thus-coated web through an improvement station of the invention having the same number of rolls.

When the amount of liquid necessary for the desired average coating caliper is applied intermittently to wet belt 170 or to some other target substrate, the period and number of pick-and-place rolls preferably is chosen to accommodate the largest spacing between any two adjacent, down web deposits of coating. A significant advantage of such a method is that it is often easy to produce heavy cross web stripes or zones of coating on a belt or other target substrate but difficult to produce thin, uniform and continuous coatings. Another important attribute of such a method is that it has pre-metering characteristics, in that coating caliper can be controlled by adjusting the amount of liquid applied to the belt or other target substrate.

Although a speed differential can be employed between belt 170 and any of the other rolls shown in FIG. 12, or between belt 170 and web 189, preferably no speed differential is employed between belt 170 and pick-and-place rolls 172, 174, 176, 178, 180 and 182, or between belt 170 and web 189. This simplifies the mechanical construction of the device.

Figure 13:
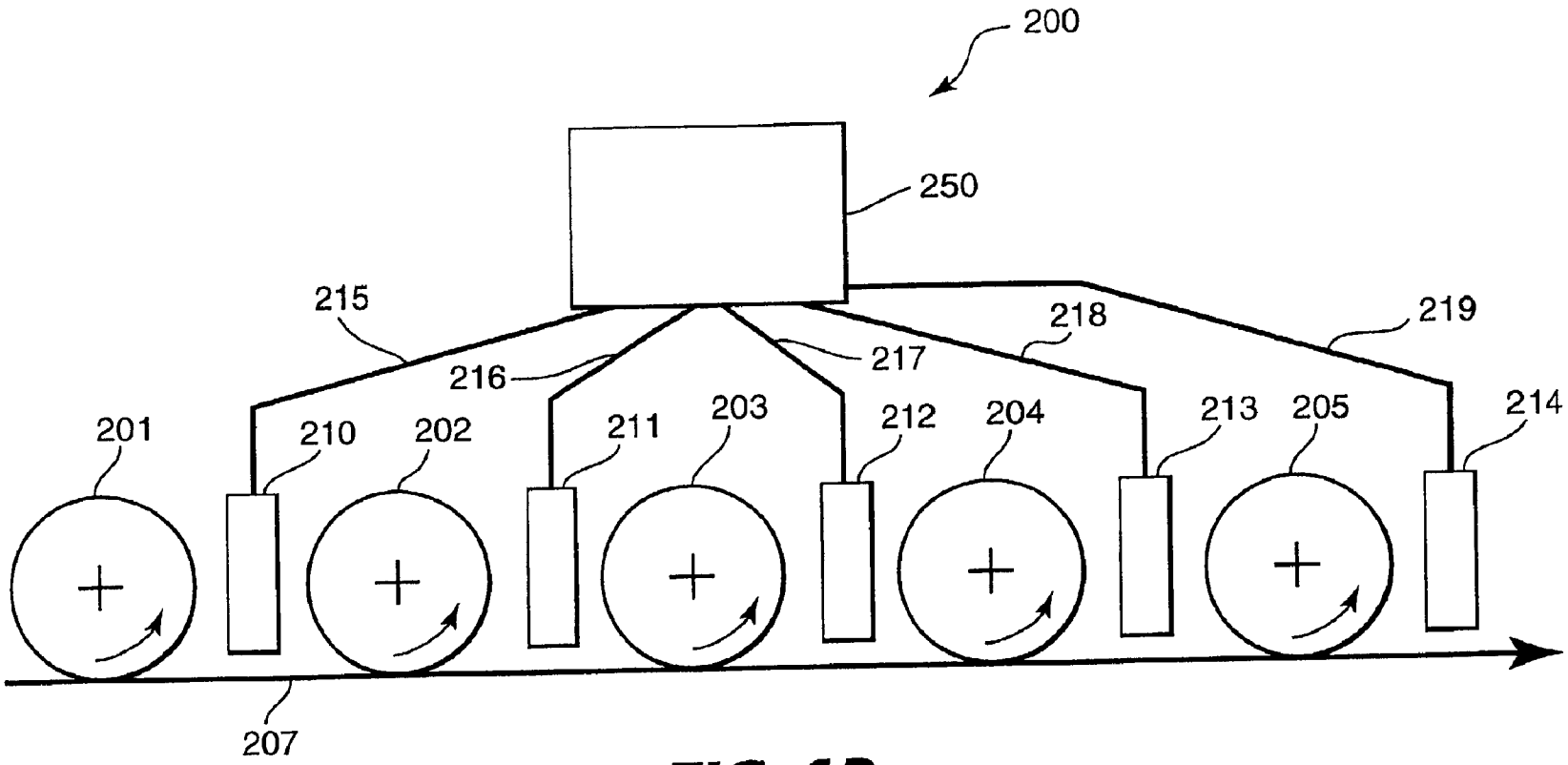
FIG. 13 is a schematic side view of a control system for a pick-and-place improvement station.

FIG. 13 shows a caliper monitoring and control system for use in an improvement station 200 of the invention. This system permits monitoring of the coating caliper variation and adjustment in the period of one or more of the pick-and-place devices in the improvement station, thereby permitting improvement or other desired alteration of the coating uniformity. This will be especially useful if the period of the incoming deviation changes. Referring to FIG. 13, pick-and-place transfer rolls 201, 202, 203, 204 and 205 are attached to powered driving systems (not shown in FIG. 13) that can independently control the rates of rotation of the rolls in response to a signal or signals from controller 250. The rates of rotation need not all exactly match one another and need not match the speed of the substrate 207. Sensors 210, 211, 212, 213 and 214 can sense one or more properties (e.g., caliper) of substrate 207 or the coating thereon, and can be placed before and after each pick-and-place roll 201, 202, 203, 204 and 205. Sensors 210, 211, 212, 213 and 214 are connected to controller 250 via signal lines 215, 216, 217, 218 and 219. Controller 250 processes signals from one or more of sensors 210, 211, 212, 213 and 214, applies the desired logic and control functions, and produces drive control signals that are sent to the motor drives for one or more of pick-and-place transfer rolls 201, 202, 203, 204 and 205 to produce adjustments in the speeds of one or more of the rolls. In one embodiment, the automatic controller 250 can be a microprocessor that is programmed to compute the standard deviation of the coating caliper at the output side of roll 201 and to implement a control function to seek the minimum standard deviation of the improved coating caliper. Depending on whether or not rolls 201, 202, 203, 204 and 205 are controlled individually or together, appropriate single or multi-variable closed-loop control algorithms from sensors positioned after the remaining pick-and-place rolls can also be employed to control coating uniformity. Sensors 210, 211, 212, 213 and 214 can employ a variety of sensing systems, such as optical density gauges, beta gauges, capacitance gauges, fluorescence gauges or absorbance gauges.

As mentioned in connection with FIG. 12, a stripe coater can be used to apply an uneven coating to a belt or other target substrate, followed by passage of the uneven coating through an improvement station of the invention. This represents another aspect of the present invention, in that when the input coating liquid caliper is uneven (e.g., repeatedly varying, discontinuous or intermittent), a series of a sufficient number of properly chosen pick-and-place rolls will spread the uneven coating into a continuous down-web coating of good uniformity. Many methods can be used to produce an uneven coating on a web. Ordinarily such coatings are regarded as undesirable and are avoided. They can however be used advantageously in the present invention. A significant advantage of the present invention is that it is easy to produce an uneven and ordinarily defective coating but difficult to produce thin, uniform continuous coatings in one step. Also, it is easier to meter an uneven coating than a thin, uniform coating. Thus the present invention teaches the formation of a metered, uniform coating from an uneven or discontinuous coating. Combining a deliberate uneven coating step with a uniformity improvement step enables production of continuous coatings, and especially production of thin, uniform continuous coatings, at high precision and with simple, low cost equipment. Most known coating methods can be operated in non-preferred operating modes to apply uneven down web coatings. For example, a gravure coater can be operated so that it deliberately produces a coating with gravure marks, bar marks, or chatter. Also many gravure coaters produce these defects unintentionally because of improper design or installation. All such methods for producing an uneven coating fall within the scope of this invention. Application of a discontinuous set of cross web coating stripes is especially preferred. The cross web coating stripes need not be perpendicular to the web edge. They may be diagonal to the web path. Periodic initial placement of liquid onto the web is preferred, but it is not necessary. The stripes are easily applied. For example, a simple hose or number of hoses periodically swept back and forth across the web width can be used to apply a metered amount of coating discontinuously. This represents a very low cost and easily constructed coating device. It has a premetering capability, in that the overall final coating caliper can be calculated in advance and varied as needed by metering the stripe period or stripe width or the instantaneous flow rate to the stripe applicator. Metering or otherwise manipulating the stripe period or stripe width while maintaining a constant mass or volumetric flow to the stripe applicator is especially useful. This advantageously permits variation and control of coating caliper using simple, low-cost equipment, and avoids the need to use metering pumps or other expensive equipment for controlling or varying the liquid flow rate.

Coating liquids can be applied in a variety of uneven patterns other than stripes, and by using methods that involve or do not involve contact between the applicator and the surface to which the coating is applied. For example, an oscillating needle applicator such as described above in connection with FIG. 12 can contact or not contact the surface to which the coating is applied. A roll coater (e.g., a gravure roll) can repeatedly be brought into and out of contact with a moving substrate. A pattern of droplets can be sprayed onto the substrate using a suitable non-contacting spray head or other drop-producing device. Such drop-producing devices will be discussed in somewhat greater detail.

If a fixed flow rate to a drop-producing device is maintained, the substrate translational speed is constant, and most of the drops deposit upon the substrate, then the average deposition of liquid will be nearly uniform. However since the liquid usually deposits itself in imperfectly spaced drops, there will be local variations in the coating caliper. If the drop deposition frequency is low or the drop size is low, the drops may not touch, thus leaving uncoated areas in between. Sometimes these sparsely placed drops will spontaneously spread and merge into a continuous coating, but this may take a long time or occur in a manner that produces a non-uniform coating. The use of exactly uniform or substantially uniform contact roll periods is especially useful for improving sparsely deposited droplet- or spray-deposited thin coatings. If the drops in such coatings do not overlap, the total length of all the wetting contact lines around all the individual drops will be very large. The act of contacting the drop-covered substrate surface with a roll is immensely powerful in speeding drop spreading. The resulting enhancement in the rate of drop spreading and wetting will be independent of the rotational period of the rolls and will primarily be influenced by the total wetting line length present. In contrast to coatings applied using a stripe coater, the wetting line length per unit area will be orders of magnitude greater for a coating applied as sparsely deposited drops. For example, if droplets are deposited on a one meter wide web in square, sparse arrays with one millimeter spacing and coverage of 10 percent of the web surface, then the drops in total will have a perimeter length (a cumulative wetting line length) of 1,120 meters per square meter of web surface. As the percent coverage approaches 100%, the wetting line length approaches 4 million meters per square meter of web surface. If a single stripe is applied at 10 percent coverage parallel to two of the edges of a 1 meter square piece of web, the total wetting line length will be 2 meters. As the stripe coverage approaches 100%, the wetting line length will remain at 2 meters. Thus the use of a roll to bring about an enhanced spreading rate can be vastly more important for drops than for stripes. Enhancement of spreading by translation of the wetting line amounts to a second mechanism of uniformity improvement in addition to the pick and place liquid separation/replacement mechanism already described above. This wetting line spreading mechanism is not primarily dependent upon the roll size or size uniformity. Instead, it primarily depends on the presence of contacting devices. If the spraying deposition rate is large enough to produce a continuous coating, the statistical nature of spraying will produce non-uniformities in the coating caliper. Here too, the use of rolls or other selected periodic pick-and-place devices can improve coating uniformity.

Accordingly, an improvement station of the present invention can be advantageously used with a non-uniform coating, e.g., a coating of stripes or drops. The improvement station can convert the non-uniform coating to a continuous coating, or improve the uniformity of the coating, or shorten the time and machine length needed to accomplish spreading, and especially drop spreading. The act of contacting discontinuous drops with rolls or other selected periodic pick-and-place devices, removing a portion of the drop liquid, then placing that removed portion back onto the substrate in some other position increases the surface coverage on the substrate, reduces the distance between coated spots and increases the drop population density. The contacting action also creates pressure forces on the drop and substrate, thereby accelerating the rate of drop spreading. Contact in the area around and at a drop may produce a high liquid interface curvature at or near the spreading line and thereby enhance the rate of drop spreading. Thus the use of selected periodic pick-and-place devices makes possible rapid spreading of drops applied to a substrate and improves the uniformity of the final coating.

Spraying can be accomplished using many different types of devices. Examples include point source nozzles such as airless, electrostatic, spinning disk and pneumatic spray nozzles. Line source atomization devices are also known and useful. The droplet size may range from very large (e.g., greater than 1 millimeter) to very small. The nozzle or nozzles can be oscillated back and forth across the substrate, e.g. in a manner similar to the above-described needle applicator. Particularly preferred drop deposition devices are described in copending U.S. patent application Ser. No. 09/841,380 entitled ELECTROSTATIC SPRAY COATING APPARATUS AND METHOD and Ser. No. 09/841,381 entitled VARIABLE ELECTROSTATIC SPRAY COATING APPARATUS AND METHOD (now U.S. Pat. No. 6,579,574 B1), both filed Apr. 24, 2001, the entire disclosures of which are incorporated by reference herein.

The beneficial application of the periodic pick-and-place devices of the present invention can be tested experimentally or simulated for each particular application. Many criteria can be applied to measure coating uniformity improvement. Examples include caliper standard deviation, ratio of minimum (or maximum) caliper divided by average caliper, range (defined as the maximum caliper minus the minimum caliper over time at a fixed observation point), and reduction in void area. For example, through the use of the present invention, range reductions of greater than 75%, greater than 80%, greater than 85% or even greater than 90% can be obtained. For discontinuous coatings (or in other words, coatings that initially have voids), the invention enables reductions in the total void area of greater than 50%, greater than 75%, greater than 90% or even greater than 99%. The application of this method can produce void-free coatings. Those skilled in the art will recognize that the desired degree of coating uniformity improvement will depend on many factors including the type of coating, coating equipment and coating conditions, and the intended use for the coated substrate.

Through the use of the invention, 100% solids coating compositions can be converted to void-free or substantially void-free cured coatings with very low average calipers. For example, coatings having thicknesses less than 5 micrometers, less than 1 micrometer, less than 0.5 micrometer or even less than 0.1 micrometer can readily be obtained. Coatings having thicknesses greater than 5 micrometers can also be obtained. In such cases it may be useful to groove, knurl, etch or otherwise texture the surfaces of one or more (or even all) of the pick-and-place devices so that they can accommodate the increased wet coating thickness.

Figure 14A:
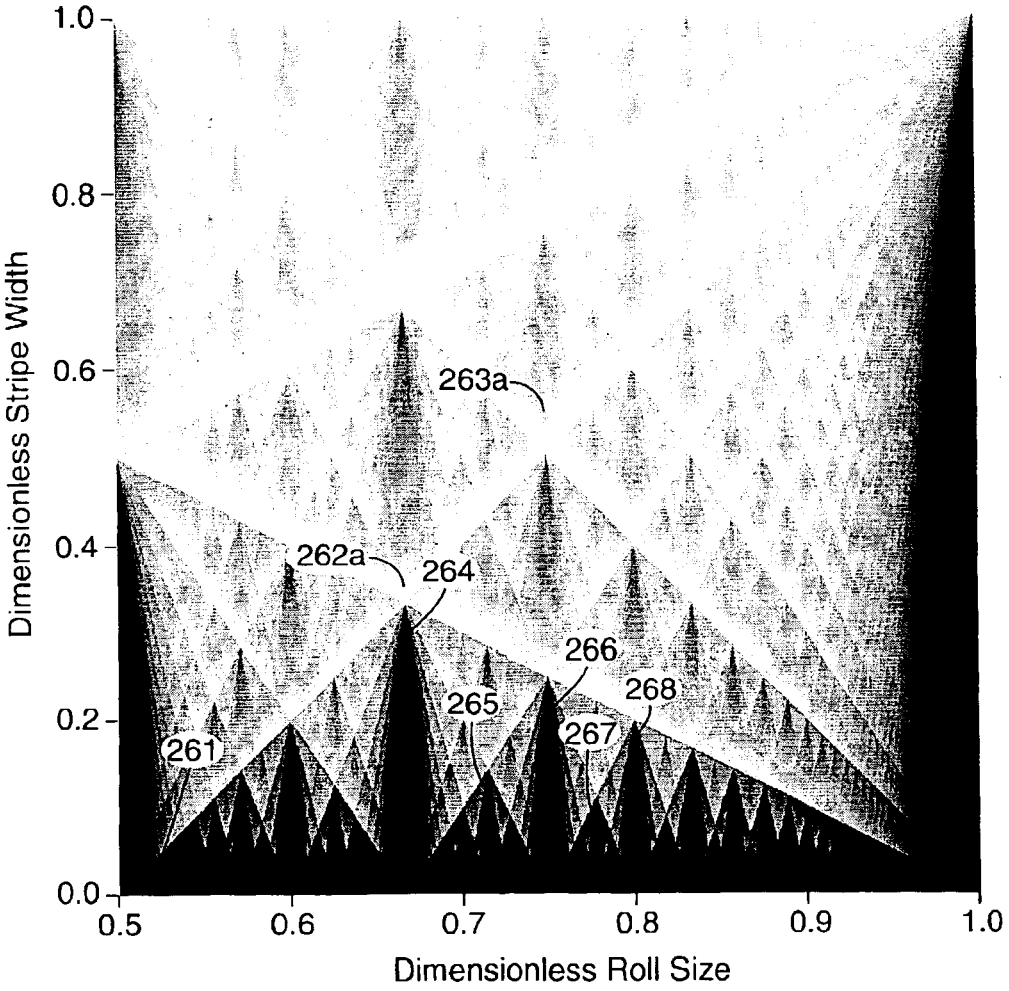
FIGS. 14*a* through 14*n* are improvement diagrams illustrating the relationship between dimensionless roll size, dimensionless stripe width and the minimum caliper that can be obtained by periodically applying cross-web coating stripes to a moving web and passing the coated web through an improvement station containing one or more rolls.

As discussed above, one aspect of the invention involves first applying stripes interspersed with voids and then using rolls to pick and place the applied liquid and create a continuous coating. These stripes may extend from one edge to the other edge of a continuous web, or they may extend only across one or more of a number of down web lanes. Further understanding of this aspect of the invention and the manner in which stripe periods and roll diameters can be selected can be obtained by reviewing FIG. 14*a*. FIG. 14*a* is an improvement diagram in the form of a linear continuous gray scale plot, prepared through extensive computer modeling of a very large number of operational modes for a system using 20 rolls. The improvement diagram in FIG. 14*a* is symmetric about a line drawn at X=0.5. In order to improve the resolution of the improvement diagram, only the region along the X-axis from X=0.5 to X=1.0 is shown in FIG. 14*a*, it being understood that the region from X=0 to X=0.5 is a mirror image of the region shown in FIG. 14*a*. The improvement diagram illustrates the influence that applied stripe width and roll diameter have upon coating continuity and caliper uniformity. The coatings are initially formed with deliberately uneven caliper by applying periodic cross web stripes to a down-web lane on a substrate. The resulting uneven coatings contain repeating variations including voids. The coatings are fed into a 20 roll improvement station in which all rolls have the same diameter and period. The coating calipers of individual web length elements can be normalized by dividing by the average void-free coating caliper. The quality of coating uniformity exiting from the improvement station can be evaluated by noting the minimum caliper observed for some representative length of web and dividing the minimum by the average caliper. This evaluation provides a uniformity metric that is referred to as the "dimensionless minimum caliper". Using this uniformity metric, the coating becomes more uniform as the dimensionless minimum caliper approaches 1. A dimensionless minimum caliper of 0 indicates there are one or more complete voids in the coating. The dimensionless minimum caliper plotted in FIG. 14*a* is the minimum resulting from steady state operation. The continuous gray scale shading in FIG. 14*a* identifies the dimensionless minimum caliper values. White regions in FIG. 14*a* represent regions of near perfect uniformity having a high dimensionless minimum caliper greater than 0.9999. Black regions represent voided coating with a dimensionless minimum caliper of zero. Lighter gray and gray regions represent an intermediate dimensionless minimum caliper. The X- and Y-axes are the dimensionless roll size and dimensionless stripe width. The dimensionless roll size is the time period of the roll rotation divided by the period of the input non-uniformity. If the size of a roll does not vary, and its surface speed equals the web speed, then the dimensionless roll size is equivalent to the roll circumference divided by the non-uniformity wavelength where the wavelength is the length between successive coating stripes. The wavelength was assumed to be constant. The dimensionless stripe width is the stripe machine direction width divided by the non-uniformity wavelength, or the time for the stripe to pass an observer divided by the non-uniformity period. It is possible to apply very thick caliper stripes of coating. These will often spread into wider stripes after the first passage through a nip. The stripe width for FIG. 14*a* is defined as the width immediately after passage through the first nip encountered. As noted above, the results shown in FIG. 14*a* are symmetrical about a vertical line through X=0.5. Thus for example, the dimensionless minimum caliper achieved for a stripe width and a roll size of 0.1 is identical to that obtained at the same stripe width and a roll size of 0.9. Additionally, the results will be identical for integer increments of the roll size. For example a dimensionless roll size of 0.3456 will give identical steady state results to that of sizes 1.3456, 2.3456, 3.3456 and so on.

Every point on the improvement diagram in FIG. 14*a* represents the dimensionless minimum caliper obtained via operation of the improvement station for a particular combination of dimensionless roll size and dimensionless stripe width. For some dimensionless roll size and stripe width choices the coating will not be continuous, resulting in a minimum caliper of zero. These are shown as black regions such as 261 in FIG. 14*a*. Some dimensionless roll size and stripe width choices provide continuous, high quality coatings. These are shown as white regions such as 262*a* and gray regions such as 263*a* in FIG. 14*a*.

Figure 14B:
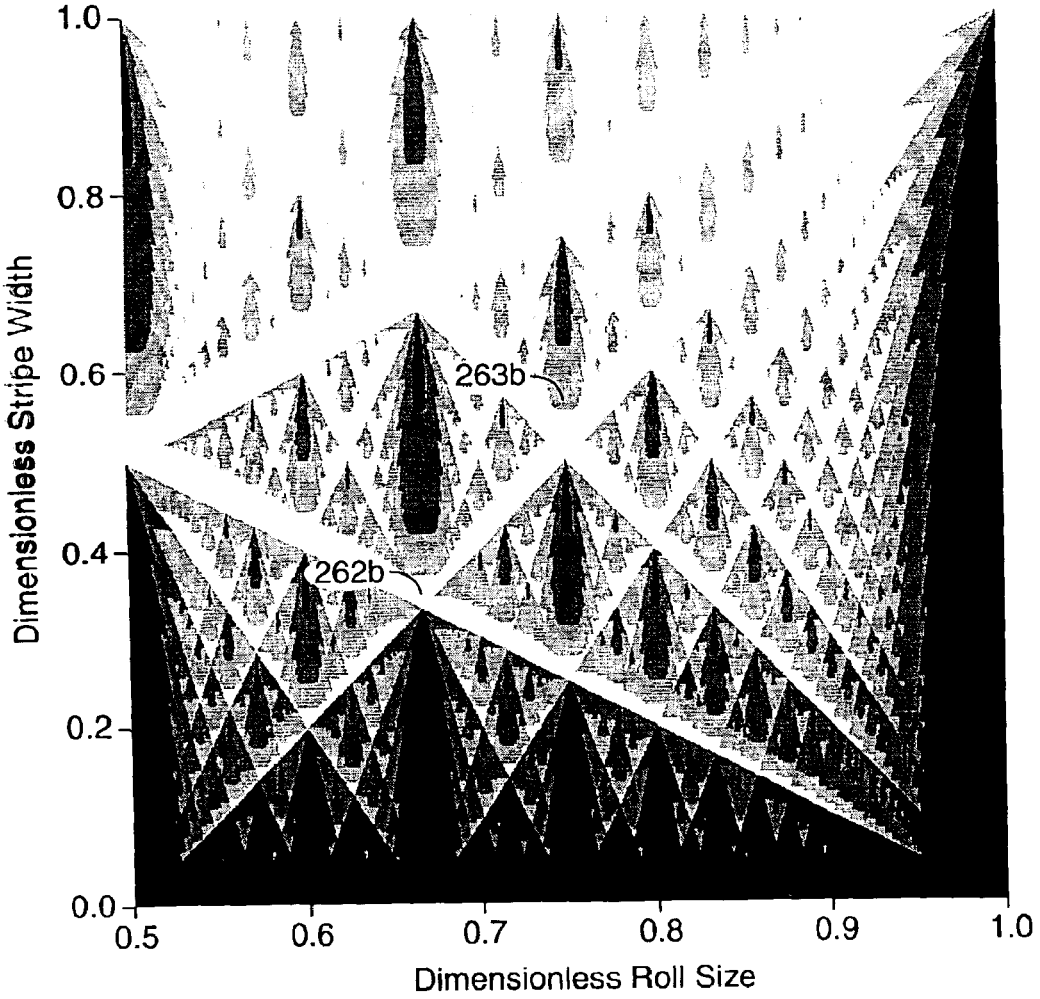

FIG. 14*b* presents the information of FIG. 14*a* as a gray scale contour plot with five discrete gray levels ranging from black to white. Each gray scale level represents a range of dimensionless minimum calipers. The black regions or islands on FIG. 14*b* indicate that the minimum caliper will range from 0.0 to 0.3. Thus choosing to operate with roll period and stripe width combinations falling within any of these black regions or islands will result in coatings whose caliper ranges between voids and a continuous coating having a minimum caliper less than 0.3. The darkest gray level indicates that the minimum caliper will be between 0.3 and 0.6. The medium gray level indicates that the minimum caliper will be between 0.6 and 0.8. The lightest gray level indicates the minimum caliper will be between 0.8 and 0.9. The white regions and islands indicate the minimum caliper will be between 0.9 and 1.0. The use of a discretely graduated gray scale in FIG. 14*b* makes it easier to see white regions such as region 262*a* of FIG. 14*a* (shown as region 262*b* in FIG. 14*b*) and gray regions such as region 263*a* of FIG. 14*a* (shown as region 263*b* in FIG. 14*b*). In some cases (e.g., region 263*b* in FIG. 14*b*) the region appears as an island bordered by a region of higher or lower caliper uniformity. The dark gray and all lighter shades of gray and white regions and islands in FIG. 14*b* identify combinations (operating conditions) of roll periods and stripe widths that will produce continuous void-free coatings. It will be understood by those skilled in the art that these regions and islands are reflected in mirror image regions and islands of the improvement diagram not shown in FIG. 14*b*. The medium gray and all lighter shades of gray and white regions and islands in FIG. 14*b* and its mirror image (about the axis X=0.5) are preferred operating conditions. The light gray and white regions and islands in FIG. 14*b* and its mirror image are more preferred operating conditions, and the white regions and islands in FIG. 14*b* and its mirror image are most preferred operating conditions.

Using FIG. 14*a* or FIG. 14*b* as a guide one may choose in combination a stripe width for the coater and a diameter for the uniform size rolls in order efficiently to produce a continuous coating. In fact the simulations show that the following procedure will produce choices that will be among the best possible choices. The simplest approach to choosing favorable combinations is to choose dimensionless roll periods R and stripe periods S that can be expressed as a fraction R/S where R and S are integers between 1 and 21, are not equal to each other, and R is less than S. For example, an R/S fraction of 1/9 means that the stripe period is exactly 9 times larger than the roll period. Sizes that are expressed by ((N·S)+R)/S where N is a low value integer will have uniformities similar to those of the R/S fractional size. Rolls chosen using these formulas preferably are used to improve coatings whose stripe width divided by the stripe period is equal to or slightly greater than 1/S', where S' is the denominator of the fraction obtained by reducing R/S to its lowest standard form R/S'. For example, if R/S=4/18 then R'/S'=2/9 and 1/S'=1/9. The value 1/S' is the "minimum dimensionless stripe width". Thus particularly preferred combinations can readily be attained if the wavelength of the non-uniformity period is known and either the roll size or stripe width can be varied.

FIG. 14*a* and FIG. 14*b* also illustrate that these dimensionless fractional roll sizes should be avoided if the stripe width is not carefully chosen. For example, the black spike shaped contour regions of FIG. 14*a* such as regions 264, 265, 266, 267 and 268 emanating from the X-axis between 0.6666 and 0.8 (corresponding to roll sizes expressed as the fractions ⅔, 5/7, ¾, 7/9 and 4/5) should be avoided. The corresponding spikes between 0 and 0.5 are ⅕, 2/9, ¼, 2/7 and ⅓ (not shown in FIG. 14*a* ). Also, the regions at 0/1 (R/S=0.0, not shown in FIG. 14*a*) and 1/1 (R/S=1.0) are very unfavorable regions for all stripe widths less than 1. Operating regions such as white region 262*a* in FIG. 14*a* (or 262*b* in FIG. 14*b*) and light gray region 263*a* in FIG. 14*a* (or 263*b* in FIG. 14*b*) appear at and above the peaks of the dark spikes. Just exceeding the minimum dimensionless stripe width by any amount will result in continuous void-free coating. This alone will not insure good uniformity. Good uniformity is obtained by more restrictive choices of stripe width combined with roll period. However, operation with a stripe width below the minimum dimensionless stripe width is shown by FIG. 14*a* and FIG. 14*b* to be a poor choice, and will likely result in voids in the coating. When there is variation in the stripe period or width upwards of plus or minus 10 percent, operation below the minimum dimensionless stripe width may give desirable results. Typically under such conditions, operation at dimensionless stripe width values exceeding 0.85 times the minimum dimensionless stripe width will give better uniformity than operation at values below 0.75 times the minimum dimensionless stripe width, although both can achieve void-free coatings. Stripe widths less than 0.5 times the minimum dimensionless stripe width will generally not produce void-free coatings. Stripe widths ranging from 1.01 to 1.1 times the minimum dimensionless stripe width are preferred when combined with fractional sized rolls.

Figure 14C:
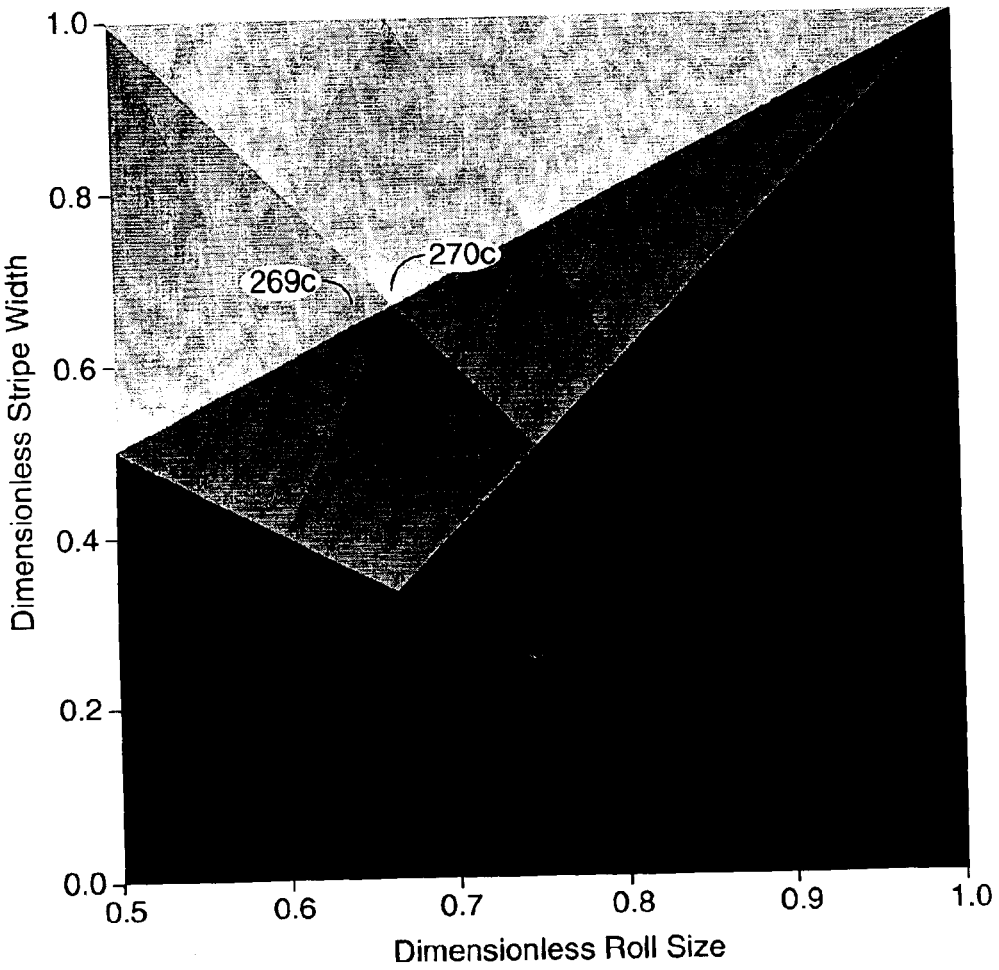
Figure 14D:
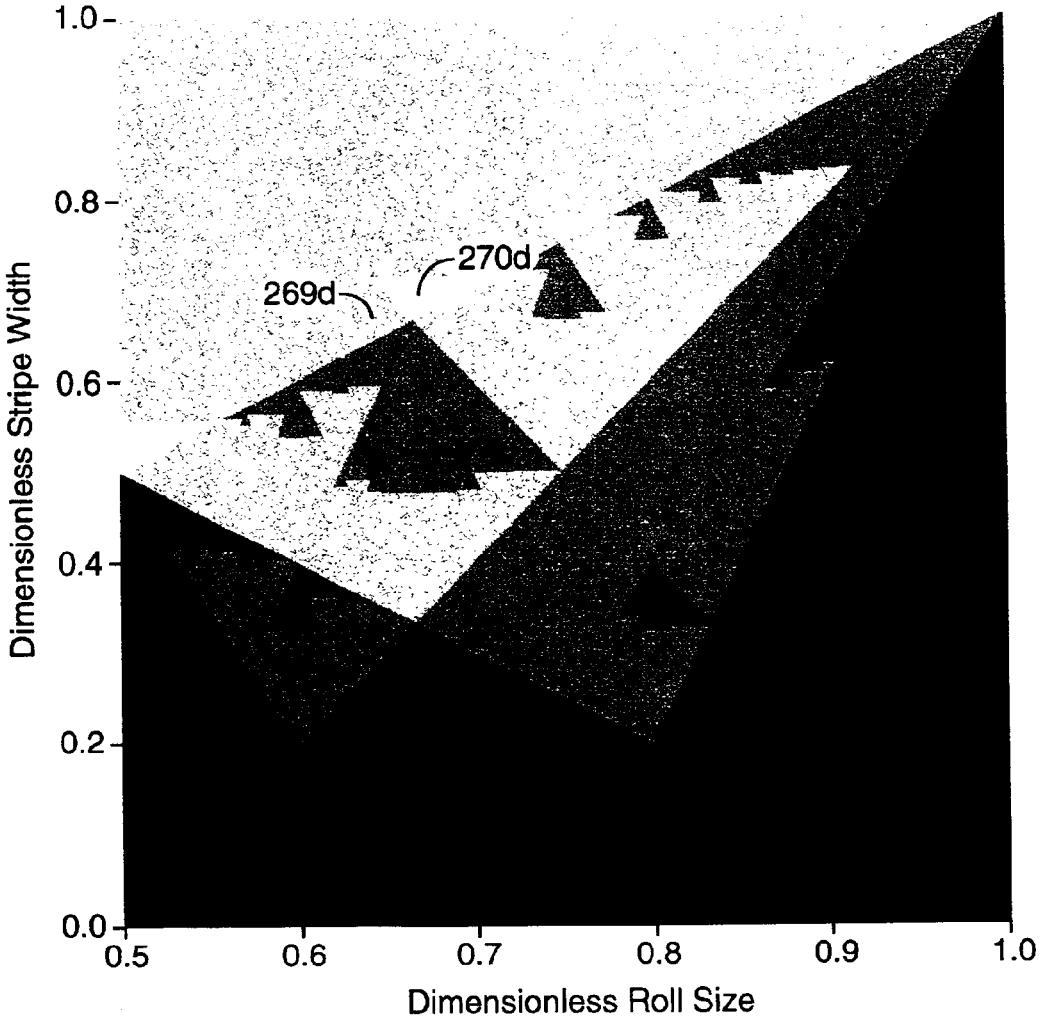

FIG. 14*c* is an improvement diagram in the form of a linear continuous gray scale plot that identifies preferred and more preferred roll sizes as a function of stripe width for a system using a single roll. As with the improvement diagram shown in FIG. 14*a* and FIG. 14*b*, the improvement diagram in FIG. 14*c* is symmetric about a line drawn at X=0.5, and thus only the region from X=0.5 to X=1.0 is shown in FIG. 14*c*. White regions in FIG. 14*c* and its mirror image represent the best possible uniformity with a dimensionless minimum caliper greater approaching 0.569. Black regions represent voided coating having a dimensionless minimum caliper of zero. The light gray regions such as region 269*c* and the white regions such as 270*c* in FIG. 14*c* and its mirror image identify more preferred roll sizes and stripe widths. These regions will produce continuous coatings having a dimensionless minimum caliper greater than 0.3 and greater than 0.6, respectively. FIG. 14*d* presents the information of FIG. 14*c* as a gray scale contour plot having five discrete gray levels ranging from black to white. The black regions or islands in FIG. 14*d* indicate minimum calipers ranging from 0.0 to 0.01. Choosing to operate with roll period and stripe width combinations falling within any of these regions or islands will result in coatings whose caliper ranges from voids to a continuous coating having a minimum caliper less than 0.01. The darkest gray level in FIG. 14*d* indicates the minimum caliper will be between 0.01 and 0.1. The medium gray level indicates the minimum caliper will be between 0.1 and 0.3. The lightest gray level indicates the minimum caliper will be between 0.3 and 0.6. The white regions and islands in FIG. 14*d* indicate the minimum caliper will be between 0.6 and 0.7. Gray regions and islands such as region 269*d* in FIG. 14*d* and its mirror image identify preferred operating conditions, and white islands such as island 270*d* in FIG. 14*d* and its mirror image identify most preferred operating conditions.

Figure 14E:
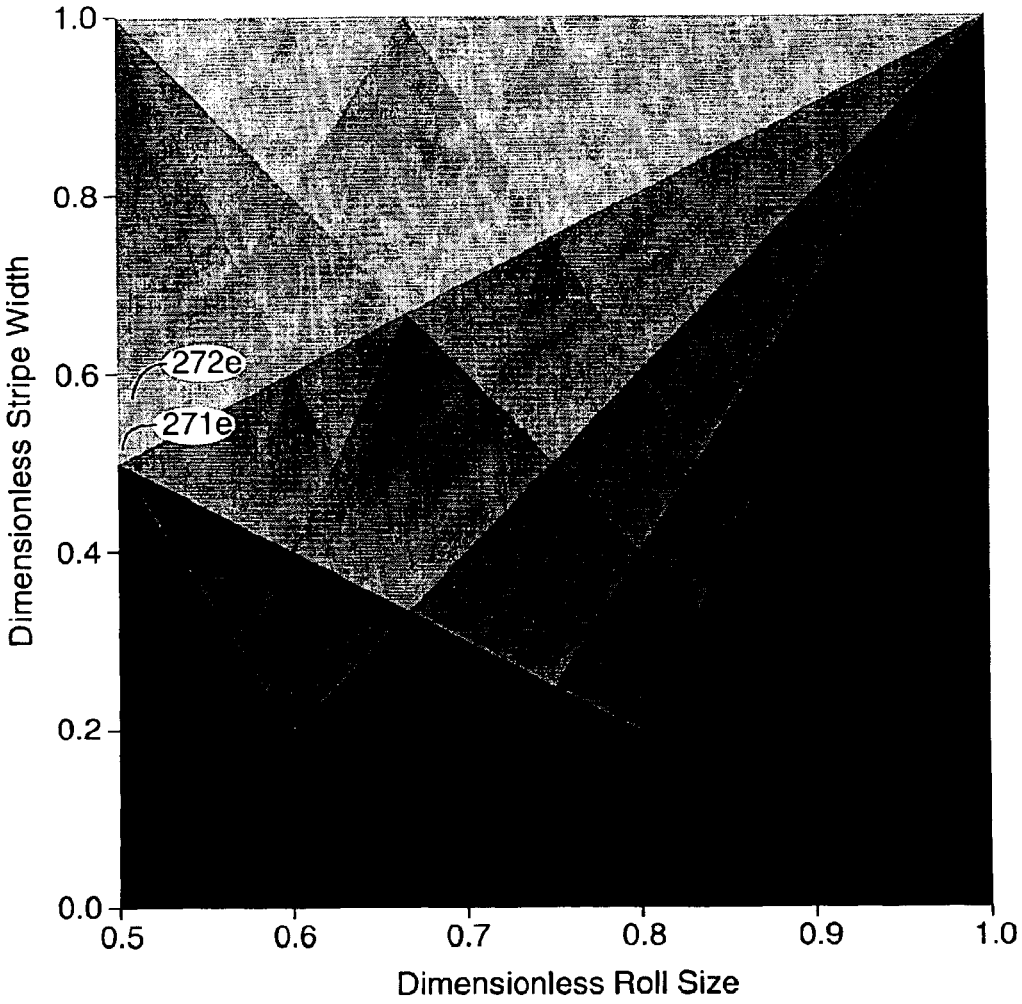
Figure 14F:
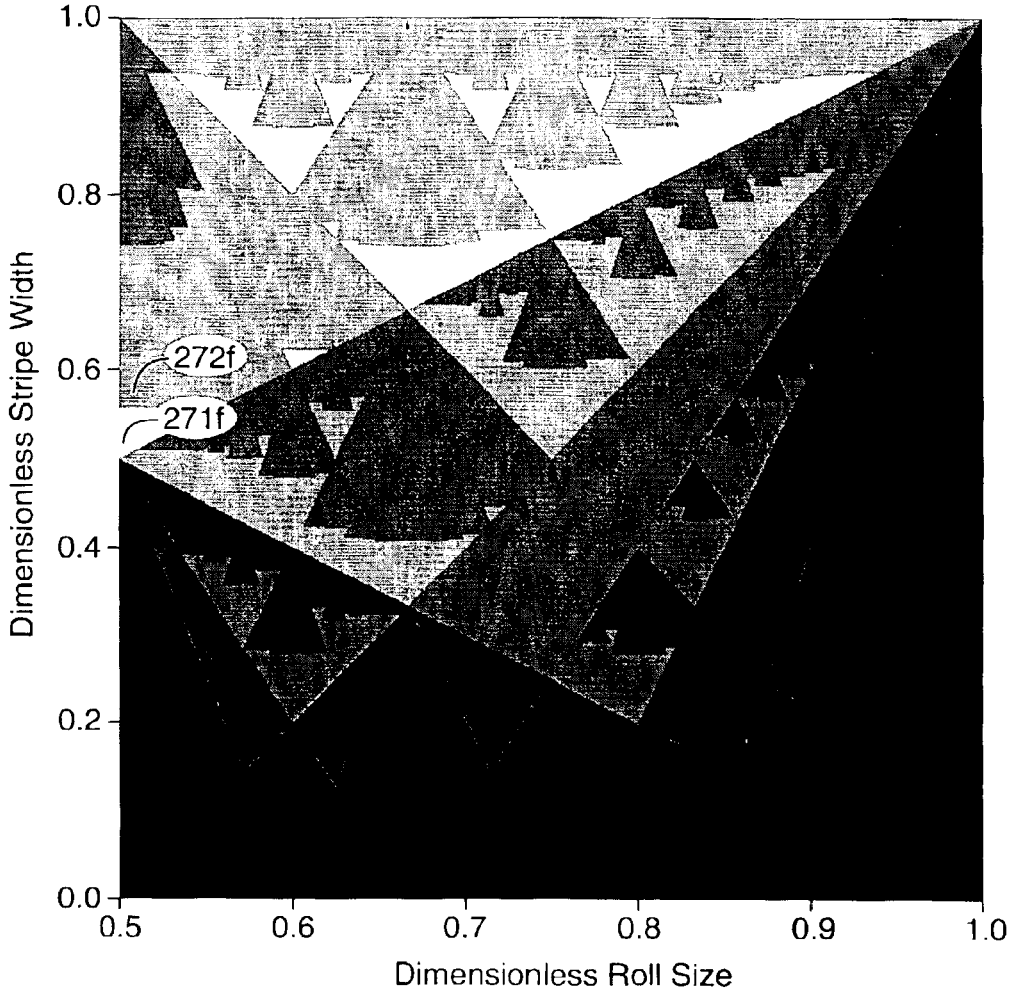

FIG. 14*e* is an improvement diagram in the form of a linear continuous gray scale plot that identifies preferred and more preferred roll sizes as a function of stripe width for a system using two rolls. As with the improvement diagrams shown in FIG. 14*a* through FIG. 14*d*, the improvement diagram in FIG. 14*e* is symmetric about a line drawn at X=0.5, and thus only the region from X=0.5 to X=1.0 is shown in FIG. 14*e*. Whiter islands such as island 271*e* in FIG. 14*e* and its mirror image represent the best possible uniformity for a two roll system with a dimensionless minimum caliper between 0.8 and 0.847. Black regions represent voided coating with a dimensionless minimum caliper of zero. Lighter grey regions such as region 272*e* will produce continuous coatings having a dimensionless minimum caliper between 0.6 and 0.8. FIG. 14*f* presents the information of FIG. 14*e* as a gray scale contour plot with five discrete gray levels ranging from black to white. The black regions of FIG. 14*f* represent voided coating with a dimensionless minimum caliper between zero and 0.1. The darkest gray level indicates the minimum caliper will be between 0.1 and 0.3. The medium gray level regions or islands indicate the minimum caliper will be between 0.3 and 0.6, and show preferred operating conditions. The light gray level regions or islands such as region 272*f* in FIG. 14*f* and its mirror image indicate the minimum caliper will be between 0.6 and 0.8, and show more preferred operating conditions. The white islands such as island 271*f* in FIG. 14*f* and its mirror image indicate the minimum caliper will be between 0.8 and 0.847 and show most preferred operating conditions.

Figure 14G:
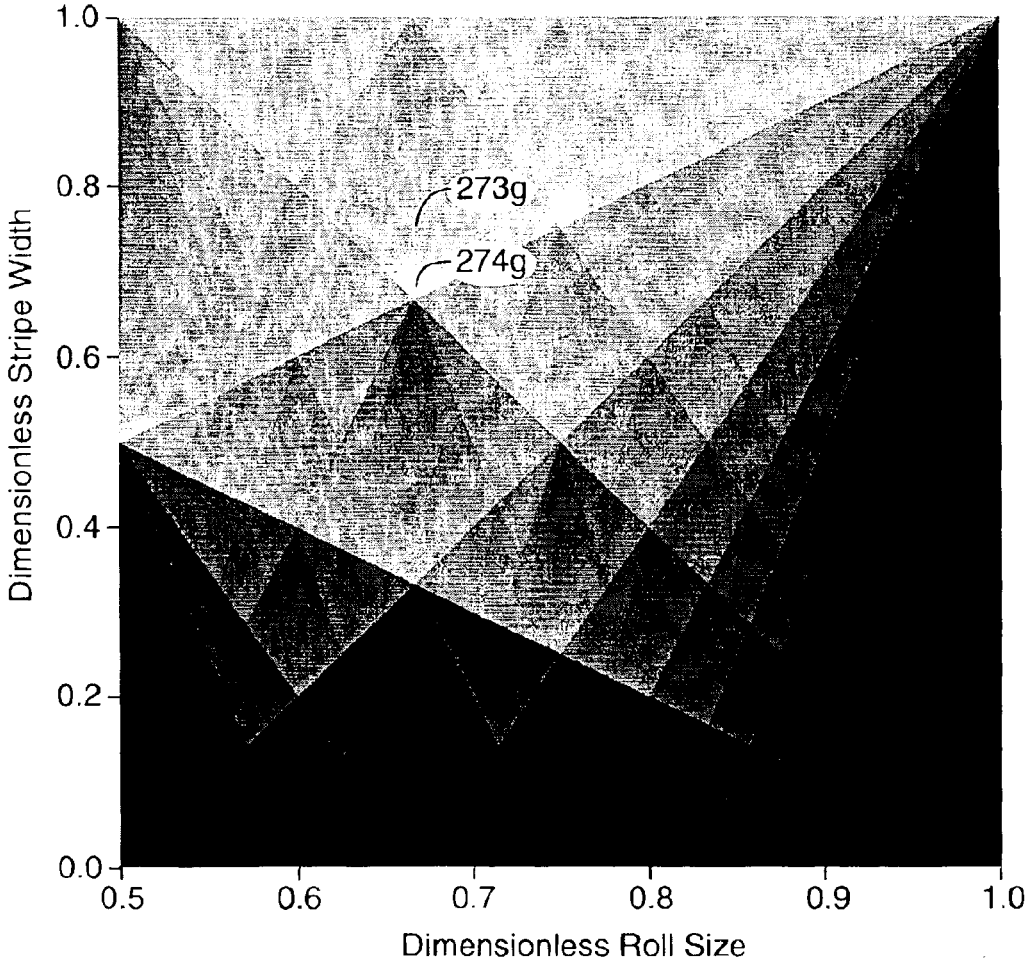
Figure 14H:
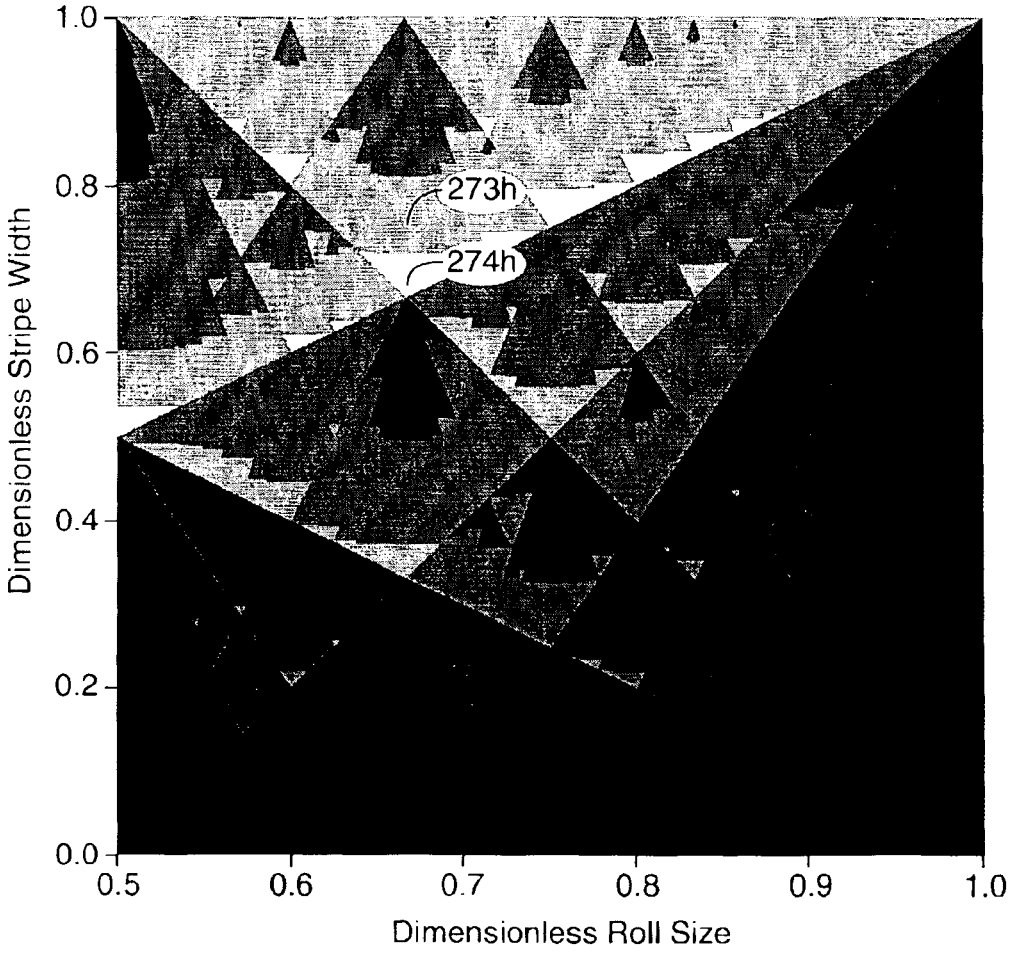

FIG. 14*g* is an improvement diagram in the form of a linear continuous gray scale plot that identifies preferred and more preferred roll sizes as a function of stripe width for a system using three rolls. As with the improvement diagrams shown in FIG. 14*a* through FIG. 14*f*, the improvement diagram in FIG. 14*g* is symmetric about a line drawn at X=0.5, and thus only the region from X=0.5 to X=1.0 is shown in FIG. 14*g*. Black regions in FIG. 14*g* represent voided coating whose dimensionless minimum caliper ranges between voids and 0.3. Lighter gray regions such as region 273*g* have dimensionless minimum calipers between 0.8 and 0.9. Whiter regions such as region 274*g* have dimensionless minimum calipers between 0.9 and 0.913. FIG. 14*h* presents the information of FIG. 14*g* as a gray scale contour plot with five discrete gray levels ranging from black to white. The black regions of FIG. 14*h* represent voided coating having a dimensionless minimum caliper between zero and 0.3. Dark gray regions or islands in FIG. 14*h* have a dimensionless minimum caliper between 0.3 and 0.6. Medium gray level regions and islands in FIG. 14*h* have a dimensionless minimum caliper between 0.6 and 0.8, and are preferred operating conditions. Lighter gray level regions or islands such as region 273*h* in FIG. 14*h* and its mirror image have a dimensionless minimum caliper between 0.8 and 0.9, and are more preferred operating conditions. White islands such as island 274*h* in FIG. 14*h* and its mirror image have a dimensionless minimum caliper between 0.9 and 0.913, and are most preferred operating conditions.

Figure 14I:
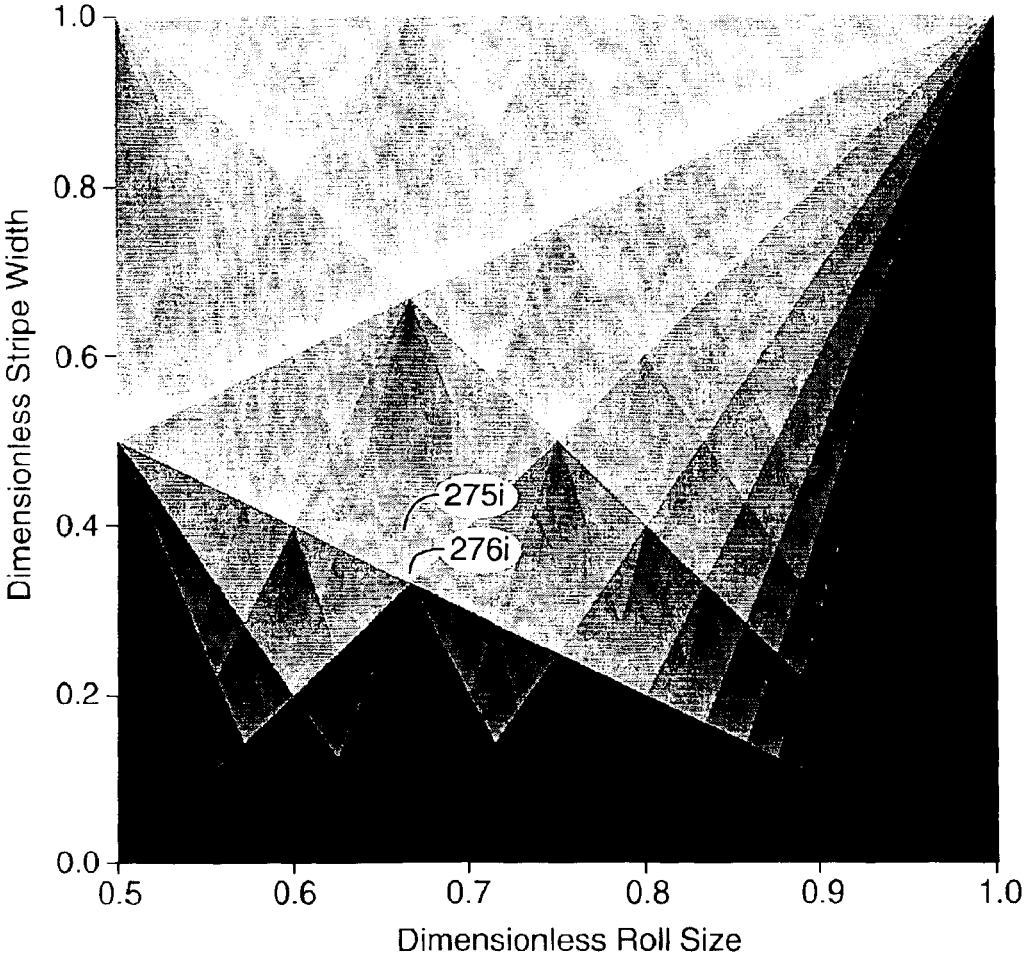
Figure 14J:
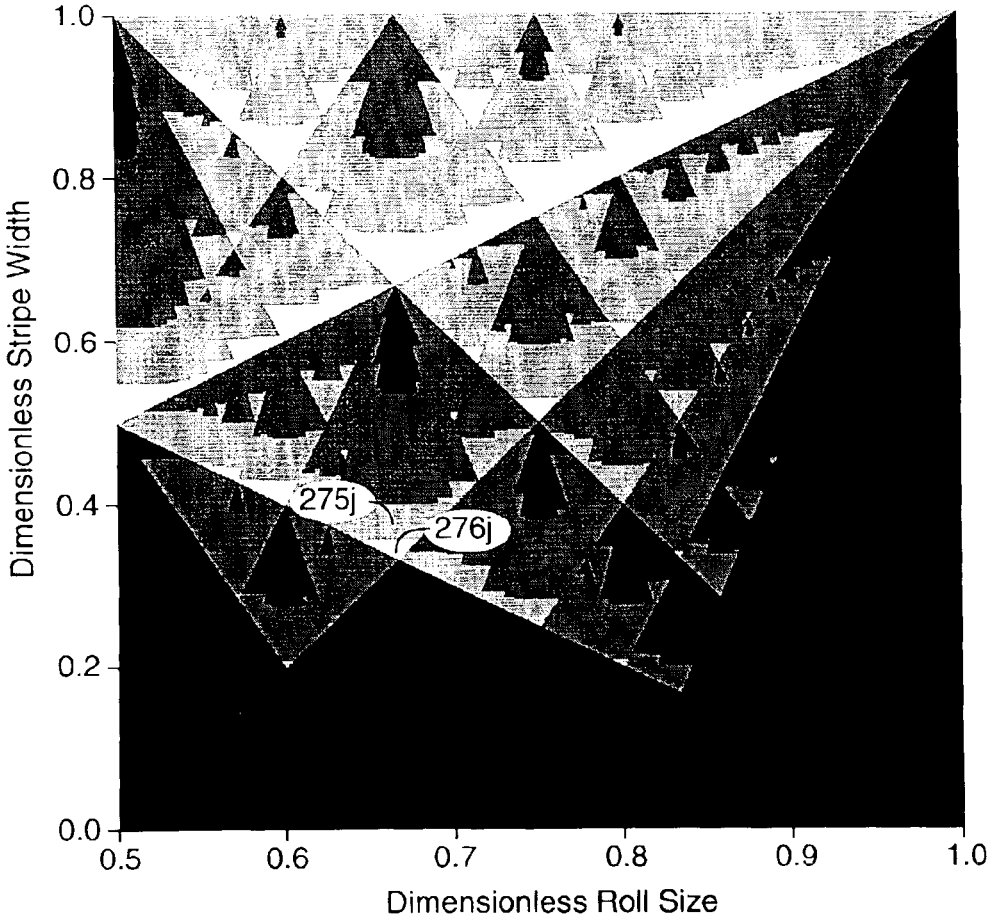

FIG. 14*i* is an improvement diagram in the form of a linear continuous gray scale plot that identifies preferred and more preferred roll sizes as a function of stripe width for a system using four rolls. As with the improvement diagrams shown in FIG. 14*a* through FIG. 14*h*, the improvement diagram in FIG. 14*i* is symmetric about a line drawn at X=0.5, and thus only the region from X=0.5 to X=1.0 is shown in FIG. 14*i*. FIG. 14*i* identifies lighter grey regions such as region 275*i* and whiter regions such as region 276*i* for a four roll system that will produce continuous coatings having a dimensionless minimum caliper greater than 0.8 and 0.9, respectively. FIG. 14*j* presents the information of FIG. 14*i* as a gray scale contour plot with five discrete gray levels ranging from black to white. The black regions of FIG. 14*j* represent voided coating having a dimensionless minimum caliper between zero and 0.3. The dark gray level regions and islands in FIG. 14*j* have a dimensionless minimum caliper between 0.3 and 0.6. Medium gray level regions or islands in FIG. 14*j* and its mirror image have a dimensionless minimum caliper between 0.6 and 0.8, and are preferred operating conditions. Light gray level regions or islands such as 275*j* in FIG. 14*j* and its mirror image have a dimensionless minimum caliper between 0.8 and 0.9, and are more preferred operating conditions. White regions or islands such as island 276*j* in FIG. 14*j* and its mirror image have a dimensionless minimum caliper between 0.9 and 0.944, and are most preferred operating conditions.

Figure 14K:
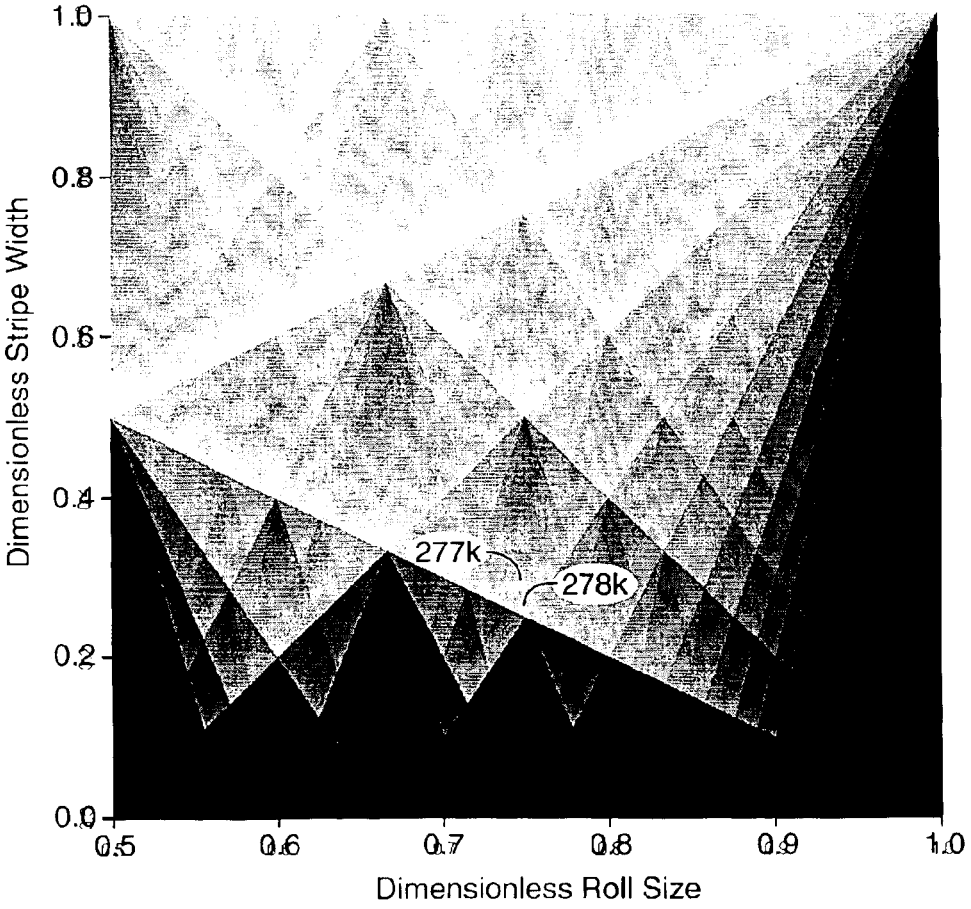
Figure 14I:
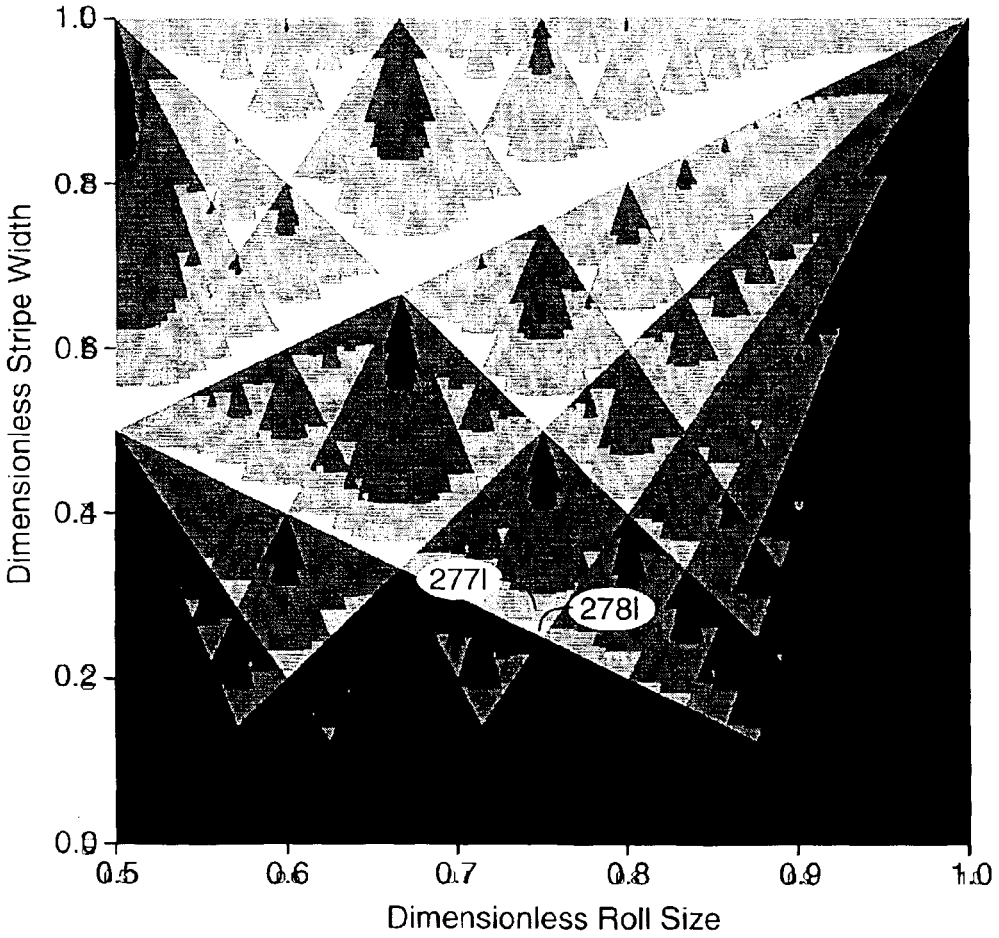

FIG. 14*k* is an improvement diagram in the form of a linear continuous gray scale plot that identifies preferred and more preferred roll sizes as a function of stripe width for a system using five rolls. As with the improvement diagrams shown in FIG. 14*a* through FIG. 14*j*, the improvement diagram in FIG. 14*k* is symmetric about a line drawn at X=0.5, and thus only the region from X=0.5 to X=1.0 is shown in FIG. 14*k*. FIG. 14*k* identifies lighter grey regions such as region 277*k* and whiter regions such as region 278*k* for a five roll system that will produce continuous coatings having a dimensionless minimum caliper greater than 0.8 and 0.9, respectively. FIG. 14*l* presents the information of FIG. 14*k* as a gray scale contour plot with five discrete gray levels ranging from black to white. The black regions of FIG. 14*l* represent voided coating having a dimensionless minimum caliper between zero and 0.3. The dark gray level regions or islands in FIG. 14*l* have a dimensionless minimum caliper between 0.3 and 0.6. The medium gray level regions or islands in FIG. 14*l* have a dimensionless minimum caliper between 0.6 and 0.8, and are preferred operating conditions. The light gray level islands or regions such as island 277*l* have a dimensionless minimum caliper between 0.8 and 0.9, and are more preferred operating conditions. The white regions or islands such as island 278*l* have a dimensionless minimum caliper between 0.9 and 0.962, and are most preferred operating conditions.

Figure 14M:
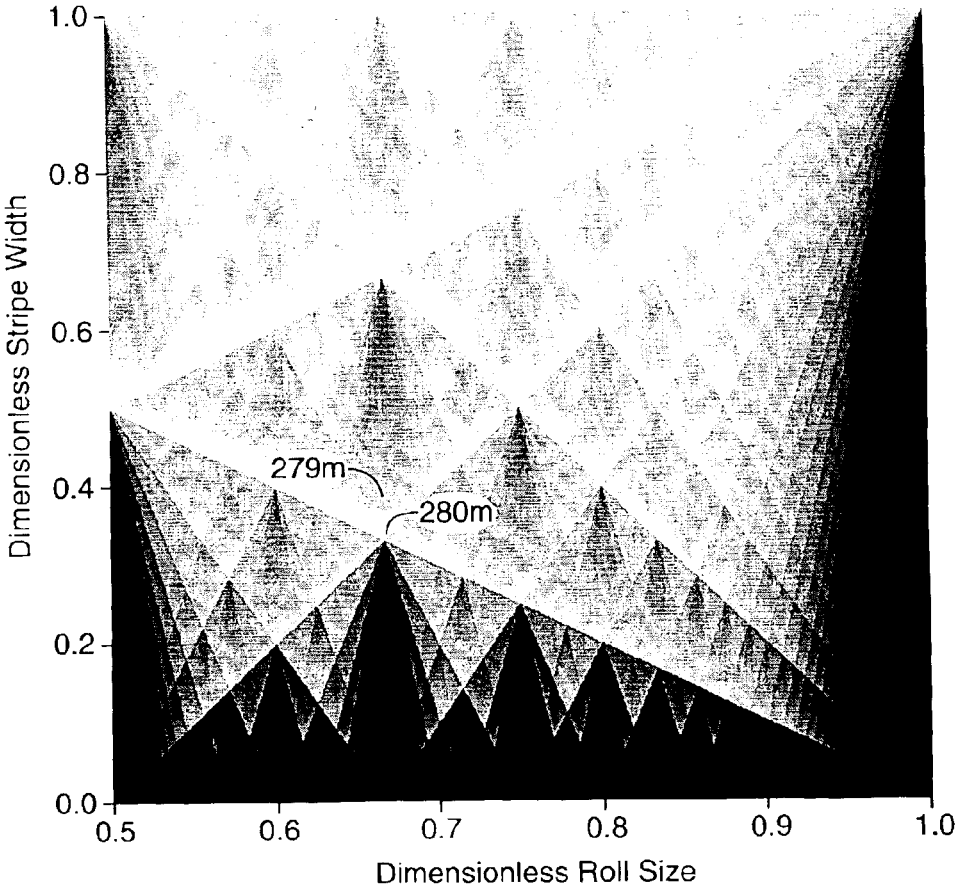
Figure 14N:
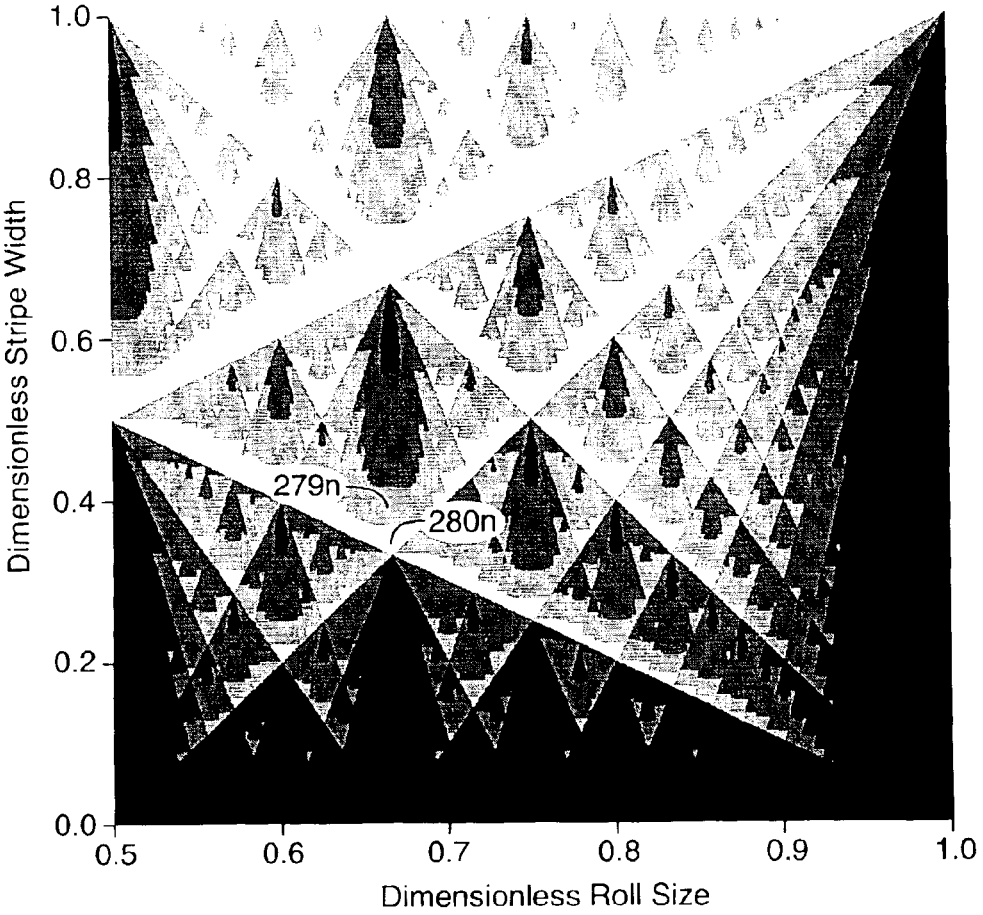

FIG. 14*m* is an improvement diagram in the form of a linear continuous gray scale plot that identifies preferred and more preferred roll sizes as a function of stripe width for a system using ten rolls. As with the improvement diagrams shown in FIG. 14*a* through FIG. 14*l*, the improvement diagram in FIG. 14*m* is symmetric about a line drawn at X=0.5, and thus only the region from X=0.5 to X=1.0 is shown in FIG. 14*m*. FIG. 14*m* identifies lighter grey regions such as region 279*m* and whiter regions such as region 280*m* for a ten roll system that will produce continuous coatings having a dimensionless minimum caliper greater than 0.9 and 0.975, respectively. FIG. 14*n* presents the information of FIG. 14*m* as a gray scale contour plot with five discrete gray levels ranging from black to white. The black regions of FIG. 14*n* represent voided coating having a dimensionless minimum caliper between zero and 0.3. The dark gray level regions or islands in FIG. 14*n* have a dimensionless minimum caliper between 0.3 and 0.6. The medium gray level regions or islands in FIG. 14*n* have a dimensionless minimum caliper between 0.6 and 0.8, and are preferred operating conditions. The light gray level islands or regions such as island 279*n* have a dimensionless minimum caliper between 0.8 and 0.9, and are more preferred operating conditions. The white regions or islands such as island 280*n* have a dimensionless minimum caliper between 0.9 and 0.994, and are most preferred operating conditions.

The discussions above have focused mainly on cases in which all the pick-and-place device periods were exactly equal with a precision of one part in approximately 10,000. Simulation experiments show that lessening this precision will influence the predicted results, generally in a favorable manner. It can be advantageous at times to employ nominally identically rolls that have measurable variations in their rotational periods. This may be accomplished in many ways.

In the laboratory or factory all mechanical parts have some limit of precision. All rotating machinery has some limit to the accuracy of the rotational instantaneous speed and the periods of successive revolutions. The resulting deviations from the nominal or set values may have very profound influences on actual experimental results or model simulations. When rolls are manufactured their cost is directly related to the precision of manufacture. Inexpensive metal and plastic rolls on the order of 25 millimeters in diameter may have a precision as poor as plus or minus 0.1 millimeters. Rubber rolls may have a precision as poor as plus or minus 0.5 millimeters. The wear and abuse of these rolls with continuing use can often further degrade their precision. This imprecision is actually beneficial for improving coating uniformity via a train of pick-and-place devices.

For driven rolls, the rotational period of a roll is influenced by its diameter and the mechanism used to drive the roll. The movement of a web past an undriven roll may turn the roll, negating the need for a drive motor. This is the least expensive and simplest mechanical configuration. In such cases factors such as the web speed, friction or traction forces between the web and the roll, and forces retarding rotation such as bearing friction or brake drag govern the rotational rate. When the angle of wrap of the web on a roll is low, there can be increased frictional slippage between the roll and web (or increased traction slippage if a liquid fills the contact area). If the rotational driving forces are nearly balanced by the retarding frictional forces then changes in the frictional forces will measurably influence the rotation speed of the roll. Variations may occur in the measured rotational period or in the instantaneous rate of rotation.

Typically, efforts to improve caliper uniformity with other coating methods have required very precise bearings and very careful control of line speeds, roll diameters and other variables. In contrast, the present invention demonstrates that some degree of imprecision in the diameters of pick-and-place rolls can be useful. Expressed more generally, imprecision in the rotational period of a set of pick-and-place devices, for whatever reason, may be useful. These variations have utility for improving coating uniformity. Even very small variations in the relative speeds or periodicity of a set of pick-and-place devices, or between one or more such devices and a substrate, are useful for enhancing performance. Random or controlled variations can be employed. For example, in a train of at least 3 rolls having nominally uniform periods, it can be desirable for at least 2 rolls to have actual variations in their periods between about 2% and about 10%. Likewise, in a train of at least 5 rolls having nominally uniform periods, it can be desirable for at least 2 rolls to have actual variations in their periods between about 0.1% and about 10%. Variation of the periods can be accomplished, for example, by independently driving the rolls or other devices using separate motors and varying the motor speeds. Those skilled in the art will appreciate that the speeds of rotation can also be varied in other ways, e.g., by using variable speed transmissions, belt and pulley or gear chain and sprocket systems where a pulley or sprocket diameter is changed, limited slip clutches, brakes, or rolls that are not directly driven but are instead frictionally driven by contact with another roll. Periodic and non-periodic variations can be employed. Non-periodic variations can include intermittent variations and variations based on linear ramp functions in time, random walks and other non-periodic functions. All such variations appear to be capable of improving the performance of an improvement station containing a fixed number of rolls. Improved results are obtained with variations as low as 0.2 percent of the average, and more preferably at least 0.4 percent of the average.

Figure 15:
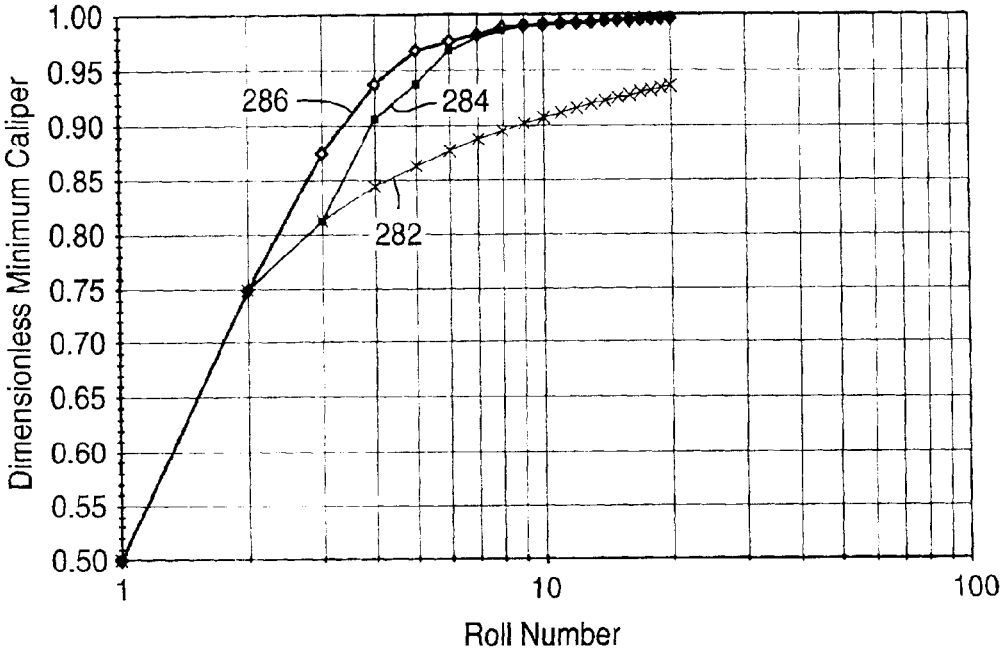
FIG. 15 is a graph illustrating the effect upon caliper uniformity of a set of 33 periodic pick-and-place devices having uniform periods or periods that randomly vary within the bounds of ±1%.

The advantages of such small variations can be better illustrated with the following example. In gravure coating inadequate flooding of the gravure roll prior to doctoring, or the entrainment of air bubbles in the coating liquid, can cause random voids in the coating. With a 300 mm diameter gravure roll, voids of 1 millimeter can be readily and inadvertently generated. The voids of this example are not periodically reoccurring. An improvement station containing a series of rubber-covered pick-and-place rolls having a nominal 200 mm circumference can dramatically reduce the defects caused by such voids. FIG. 15 illustrates the results obtained using a set of 33 rubber-covered rolls having a 200 mm circumference (63.7 mm diameter), driven only using web traction. The roll rotational periods were assumed to vary within the bounds of ±1%. FIG. 15 was prepared by simulating the coating caliper exiting from beneath each successive rubber-covered roll as a function of time and noting the lowest dimensionless minimum caliper as a length of web containing a void passes the rolls. Three cases are plotted in FIG. 15. While the results are actually discrete values (a non-integer number of rolls would not exist), the data points for each case are connected by curves as a means of identification. The first case employed exactly uniform periods. The locus of points for this case defines the curve 282. The second and third cases were selected by generating 20 different random sequences of roll periods between the limits of ±1% using the standard pseudo-random number generator available in BORLAND™ C++ 5.01 software (Borland International, Inc.). The worst case (curve 284) and best case (curve 286) for random sequence results were plotted in FIG. 15. As shown in FIG. 15, small random variations in the device periods facilitate achievement of excellent void-free uniformity. Dimensionless minimum calipers exceeding 0.95 are obtained after using only 5 to 6 rolls. Using rolls with exactly uniform periods, 33 rolls are required to obtain a similar result.

Figure 16:
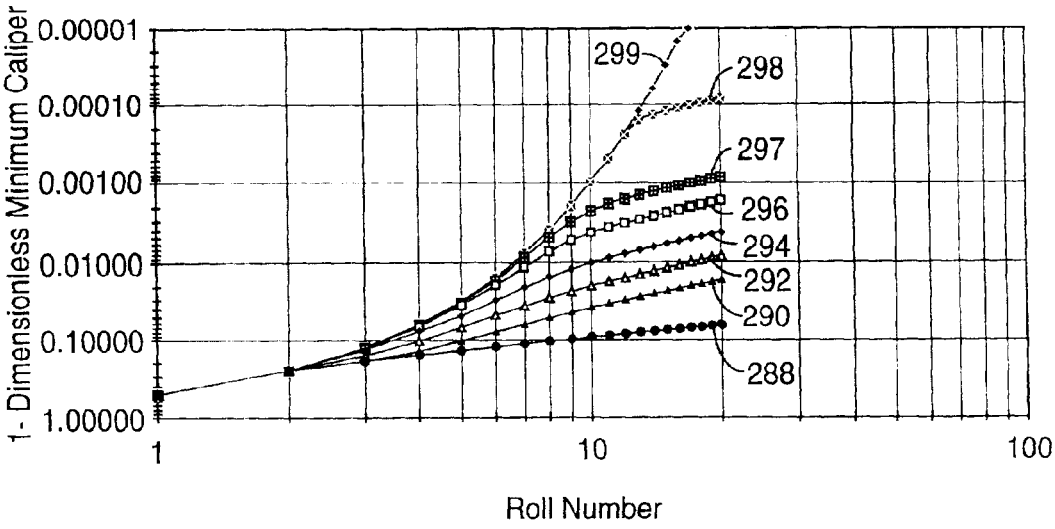
FIG. 16 is a graph illustrating the effect of the ratio of roll period variation to void size on the number of rolls required for coating uniformity.

Extensive modeling has yielded additional insights into the problem of healing random defects. Improvement in coating uniformity is governed in part by a ratio calculated by determining the absolute value of the maximum variation in the roll period from the average roll period, and dividing by the defect size. FIG. 16 shows the effect of this ratio on the number of rolls required for coating uniformity. The ordinate in FIG. 16 is 1 minus the dimensionless minimum coating caliper produced by an improvement station when a coating void passes through it. A perfect coating would have a value of 0. The abscissa in FIG. 16 is the result after passage by the indicated number of improvement rolls. The results for passage of a void through a 20 roll improvement are plotted in FIG. 16 as eight different series depicting the above-mentioned ratio. The data points for each case are connected by curves as a means of identification. The individual data points in each series were obtained using an average of ten different random combinations of roll periods within an assigned deviation range, prepared using the above-mentioned pseudo-random number generator. A series having a ratio of 0 (curve 288) has exactly uniform roll periods. The remaining ratios vary from 0.5 (curve 290) to 1000 (curve 299), and represent the maximum roll period deviation from the average roll period divided by the void size expressed in units of time. As shown in FIG. 16, when the ratio of the period deviation to the void size is large, uniform coatings are more quickly obtained than when the ratio is small. The presence of variation in the period is very helpful. After 20 rolls, a ratio of period deviation to void size of 1 (curve 292) gave nearly an order of magnitude improvement in ordinate value compared to 20 uniform rolls (curve 280). Similarly, ratios of 2 (curve 294), 5 (curve 296), 10 (curve 297) and 100 (curve 298) gave respective improvements of about 1.2, 1.5, 1.9 and 2.9 orders of magnitude compared to uniform rolls. FIG. 16 shows that using as few as three improvement rolls of substantially the same size can readily eliminate isolated random voids. Furthermore, caliper uniformity improvement can be enhanced by using small deviations in the nominal roll periods, with the deviations preferably being chosen to be larger than the void size. Deviation in a roll period is the difference between the maximum and the minimum roll rotational periods measured in time units. The void size is the length of the void measured as the time it takes to transit past a fixed observer. Both times are measured in the same units. Maintaining the ratio of the roll period deviation to void size so that the ratio is greater than one not only helps to reduce or eliminate voids, but can also help to eliminate or ameliorate other caliper upsets.

Small variations in the periods of pick-and-place devices can also heal repeating periodic defects. Such defects are often generated by operational problems with roll coating devices. For example, in gravure coating one or more cells of the patterned roll can become plugged. This can be caused by drying of a coating formulation on a portion of the gravure roll or filling of one or more of the cells with particulates. In either case, the plugged cell or cells can continuously produce a defective low coating weight spot on the web for each rotation of the gravure roll. In the worst case this results in periodic voids extending down web for the continued duration of the coating process.

Figure 17:
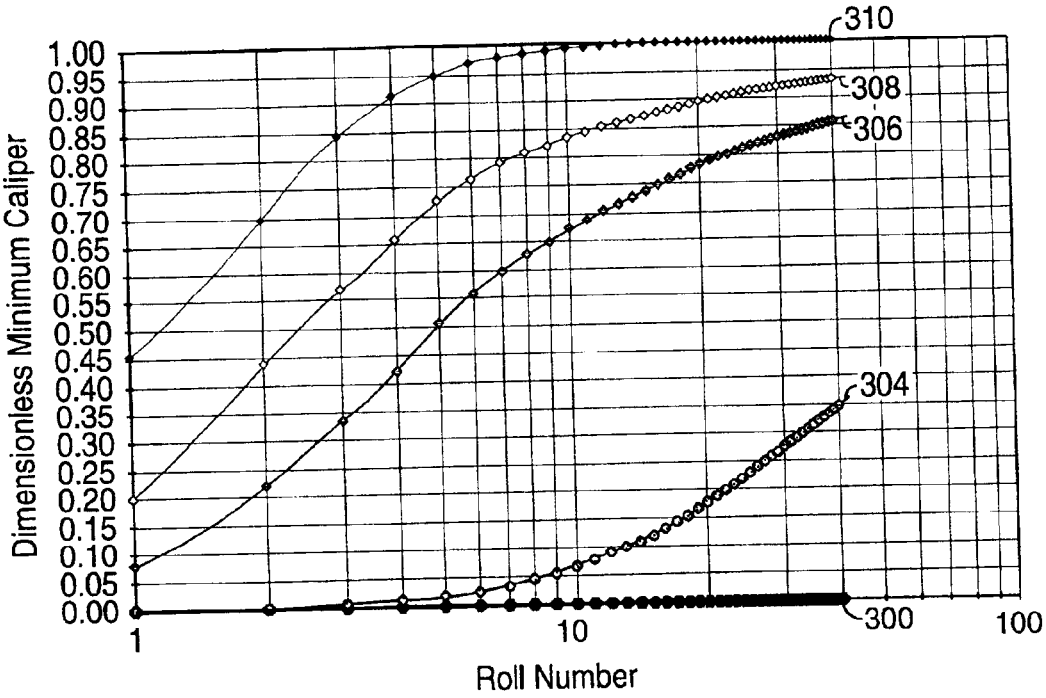
FIG. 17 is a graph illustrating a direct gravure coating simulation for a 1 cell wide repeating coating void caused by a contiguous group of plugged cells extending around 1% of the circumference of the gravure roll.

FIG. 17 illustrates a simulation of the improvement of a repeating defect occupying a single narrow lane of a coated web. The defect is generated by a defective gravure coating procedure, due to plugged cells on the gravure roll applicator. The plugged area is 1 cell wide and multiple contiguous cells long. The line of plugged cells extends in the circumferential direction on the gravure roll, and generates repeating voids on the coated web. The overall void length in the web direction is 1% of the gravure roll circumference. The correction is accomplished using improvement rolls. The period of rotation of the gravure roll and the nominal period of rotation of the improvement rolls are equal. The Y-axis and X-axis in FIG. 17 show the dimensionless minimum caliper after passage by a specified number of rolls. The results for passage of the void through a 40 roll improvement station are plotted in FIG. 17 as five different series for various values of maximum roll period deviations from the nominal roll period. The data points for each series are connected by curves as a means of identification. Rolls with exactly uniform roll periods are shown in curve 300. The remaining series include rolls that vary by 0.1% (curve 304), 0.5% (curve 306), 1% (curve 308) or 10% (curve 310) from the nominal roll period. The individual data points in each series were obtained using an average of ten different random combinations of roll periods within an assigned deviation range, prepared using the above-mentioned pseudo-random number generator. When the roll periods are exactly uniform, the repeating voids pass through a station of 40 rolls without improvement (because the exactly uniform rolls have a period exactly equal to the period of the repeating voids). However if the period of rotation varies by 0.5%, 1%, or 10%, a minimum dimensionless caliper above 0.85 is achieved with 38, 12 or 3 rolls, respectively. Even a variation as small as 0.1% produces a continuous void-free coating after as few as 3 or 4 rolls.

Figure 18:
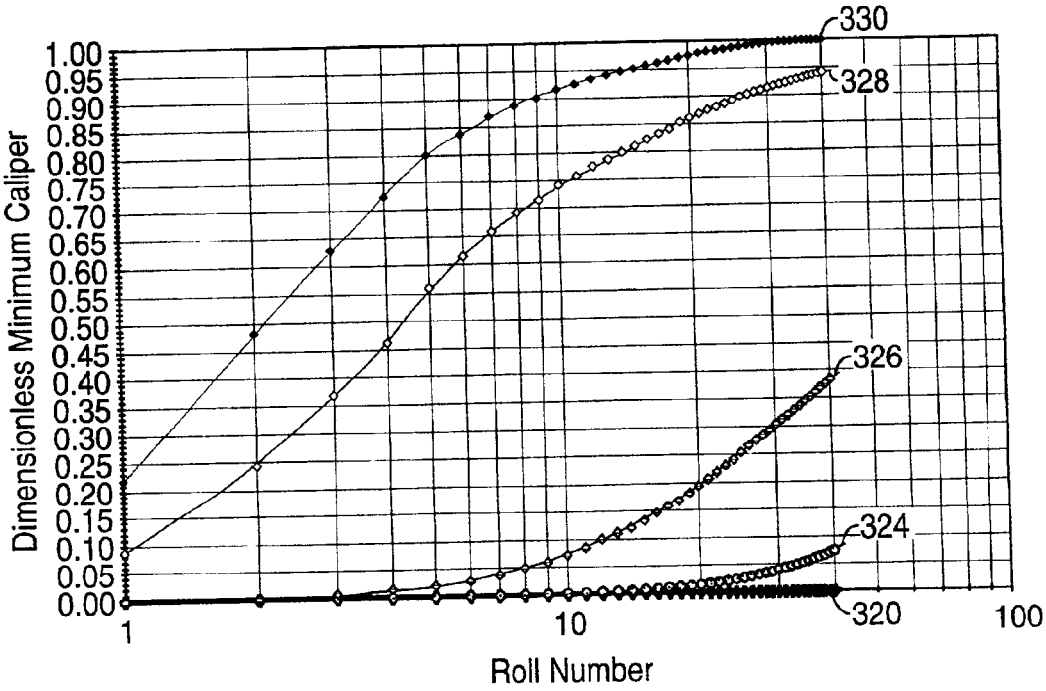
FIG. 18 is a graph illustrating a direct gravure coating simulation for a 1 cell wide repeating coating void caused by a contiguous group of plugged cells extending around 10% of the circumference of the gravure roll.

FIG. 18 illustrates a similar simulation for a longer void representing 10% of the gravure roll circumference. The results for passage of the void through a 40 roll improvement station are plotted in FIG. 18 as five different series. The data points for each series are connected by curves as a means of identification. The series range from exactly uniform roll periods (curve 320) to a series having a maximum deviation of 10% from the nominal roll period (curve 330). The remaining series vary by 0.5% (curve 324), 1% (curve 326) or 5% (curve 328) from the nominal roll period. When the roll periods are exactly uniform, the repeating voids pass through a station of 40 rolls without improvement. However if the period of rotation varies by 5% or 10%, a minimum dimensionless caliper above 0.85 is achieved with 19 or 7 rolls respectively. Despite the large size of the defect, a roll period variation as small as 0.5% produces a continuous void-free coating after as few as 11 rolls.

The period of a pick-and-place roll can be varied in a variety of ways besides initial imprecision in the roll diameter. For example, roll diameter can be statically changed (e.g., by replacing a roll, with or without interruption of a coating operation) or dynamically changed (e.g., by inflating or deflating or otherwise expanding or shrinking the roll while maintaining the roll's surface speed and without interrupting a coating operation). The rolls do not have to have constant diameters; if desired they can have crowned, dished, conical or other sectional shapes. These other shapes can help adjust the periods of a set of rolls. Also, the position of the rolls or the substrate path length between rolls can be varied during operation. One or more of the rolls can be positioned so that its axis of rotation is not perpendicular (or is not always perpendicular) to the substrate path. Such positioning can improve performance, because such a roll will tend to pick up coating and reapply it at a laterally displaced position on the substrate. All of the above variations are useful, and all can be used to affect and improve the performance of the improvement station and the uniformity of the caliper of the finished coating. For example, if partial plugging of a gravure roll pattern occurs during a coating run, then the resulting defects can be overcome without halting the run by using one of the above described variation techniques to impart an appropriate compensatory variation in rotational speed of one or more of the improvement rolls relative to the web.

In addition to varying the period of one or more pick-and-place devices as described above, coating uniformity can also be improved by varying the input period or size of a repeating defect. For example, the rotational speed of a gravure roll coater or other roll coating device can be changed to alter the input frequency of periodic defects associated with the roll coating device. Likewise, the period of a stripe coater can be changed to alter the stripe frequency or the interval between coating stripes. By monitoring the uniformity of the coating exiting the improvement station and making appropriate adjustments in the input defect period or size, overall coating uniformity can be significantly improved.

Figure 19A:
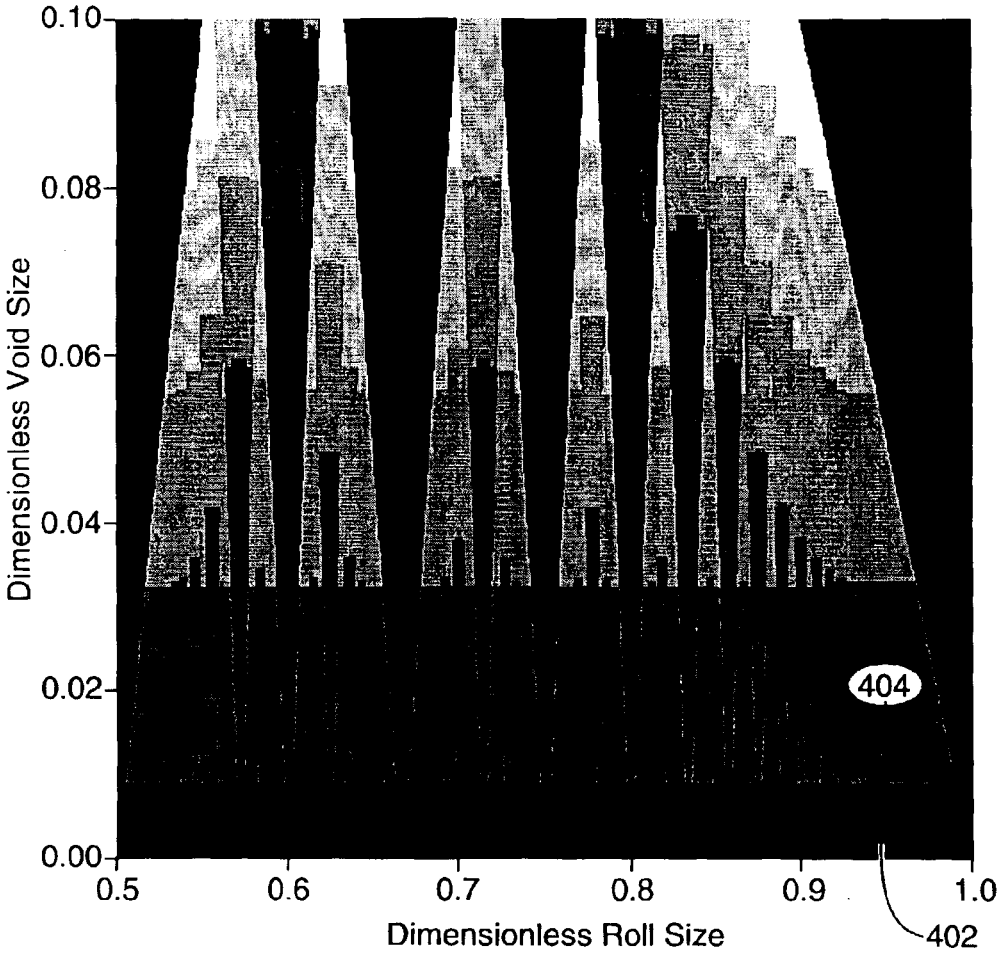
FIG. 19*a* through FIG. 19*d* are improvement diagrams illustrating the relationship between dimensionless roll size and dimensionless void size for improvement roll period variations of ±0, ±0.5, ±1 and ±5% of the void period.
Figure 19B:
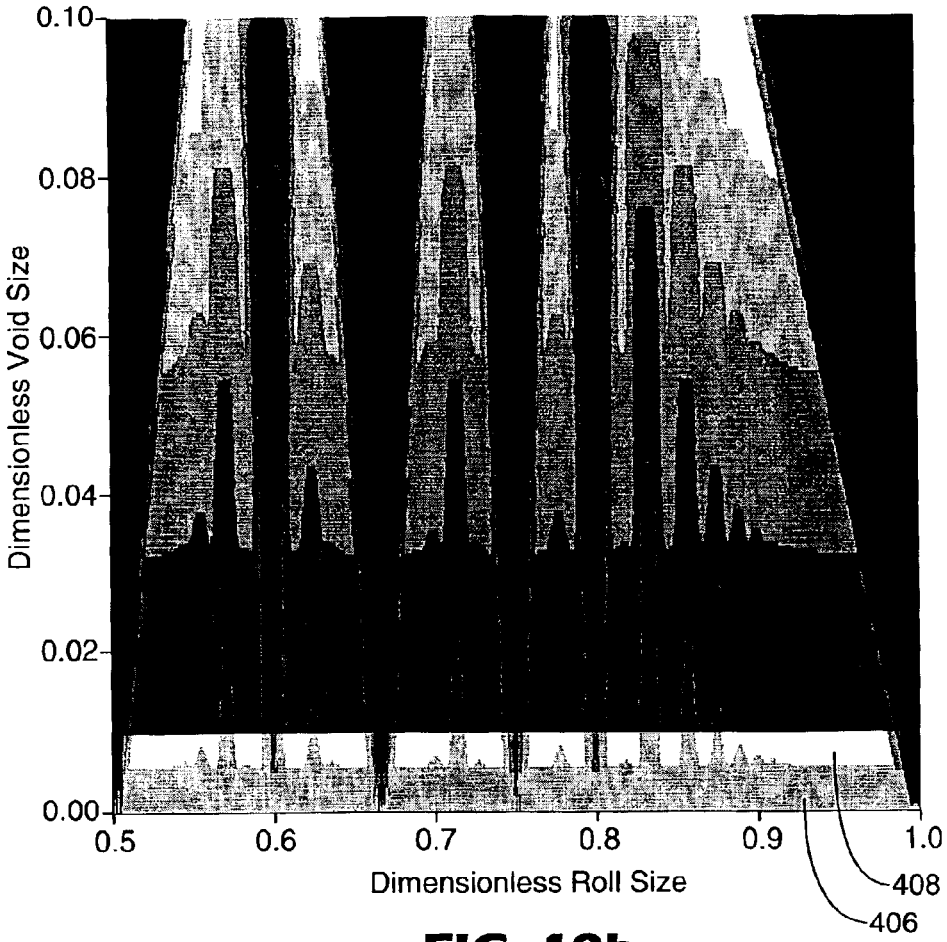
Figure 19C:
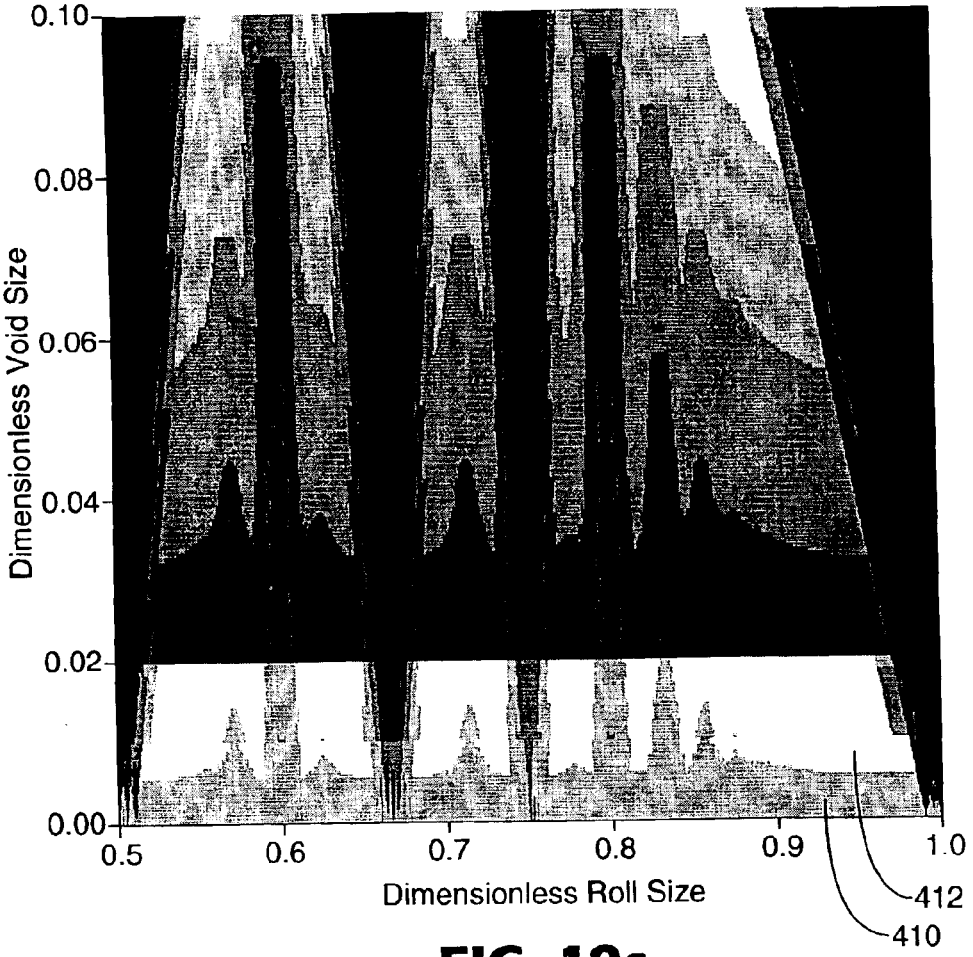
Figure 19D:
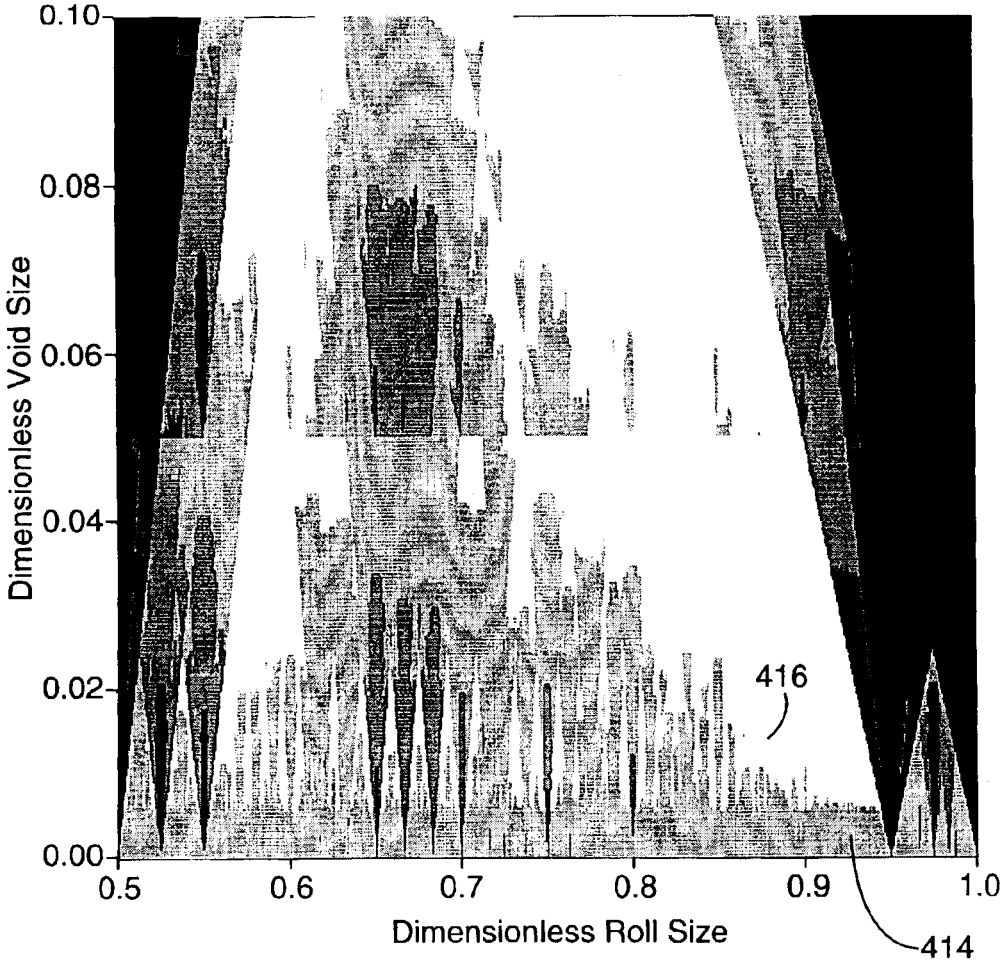

FIG. 19*a* through FIG. 19*d* illustrate the relationship between dimensionless roll size, dimensionless void size and dimensionless minimum caliper for an improvement station containing three substantially identical improvement rolls. The improvement diagrams in FIG. 19*a* through FIG. 19*d* are symmetric about a line drawn at X=0.5, and thus only the region from X=0.5 to X=1.0 is shown. In FIG. 19*a* through FIG. 19*d*, dimensionless minimum caliper is plotted as a function of dimensionless roll size and dimensionless void size. Dimensionless void size is the time of transit of a repeating void past a stationary observer divided by the period of the repeating defect. Dimensionless minimum caliper is shown using a six level gray scale, with black indicating a value of 0 to 0.8 and white indicating a value of 0.88 to 0.897. The intermediate ranges 0.8 to 0.82, 0.82 to 0.84, 0.84 to 0.86 and 0.86 to 0.88 are shown using four levels of gray ranging from very dark gray through dark gray, medium gray and light gray. In FIG. 19*a* the three rolls are identical with a period variation of ±0%. In FIG. 19*b* the first of the three rolls has a period equal to the nominal roll period, the second of the three rolls has a period equal to the nominal roll period minus 0.5% of the void period, and the third of the three rolls has a period equal to the nominal roll period plus 0.5% of the void period. FIG. 19*c* is similar but the respective second roll and third roll variations from the nominal value are +1% and −1% of the void period. FIG. 19*d* is similar but the respective second roll and third roll variations from the nominal value are +5% and −5% of the void period. In other words, for all roll sizes considered, the tolerance of their variations from their nominal sizes was held constant at a stated value expressed as a percentage of the length of the period of the repeating voids.

In FIG. 19*a* through FIG. 19*d*, improved uniformity is achieved when the dimensionless ratio of the void size to roll period deviation (maximum minus minimum) is less than one. In FIG. 19*b* white regions such as region 408 and a light gray region 406 exist for void sizes less than 0.01. Noting that white and light grey denote the best and second best uniformity levels, these regions can be contrasted to the very dark grey region 402 in FIG. 19*a* for the same roll size and void size combinations. In FIG. 19*c* white regions such as region 412 and a light gray region 410 exist for void sizes less than 0.02. These regions can be contrasted to the very dark grey region 402 and portions of the dark gray region 404 in FIG. 19*a* for the same roll size and void size combinations. In FIG. 19*d* white regions such as region 416 and a light gray region 414 exist for void sizes less than 0.02. This is in contrast to the very dark grey region 402 and portions of the dark gray region 404 in FIG. 19*a* for the same roll size and void size combinations.

If one knows or can measure the most probable size of a repeating defect, then it is possible to choose a set of rolls with deliberately chosen period deviations (size deviations) that provide a dimensionless void size to roll period deviation ratio less than one. Such a roll set will provide improved uniformity compared to a roll set in which the dimensionless void size to roll period deviation ratio is greater than one. Improved uniformity can also be attained by using other measures to reduce the dimensionless void size to roll period deviation ratio to a value less than one. For example, one can use rolls nominally of the same size but having larger dimensional tolerances. Another measure would be to vary slightly the rotational speeds of the rolls. If the rolls are not driven, then as mentioned above their traction with the web may be altered or frictional braking may be applied. If the rolls are constructed from thermally expanding materials, then the roll sizes (and the roll period deviation) can be modified by operating the rolls at differing temperatures.

Figure 20:
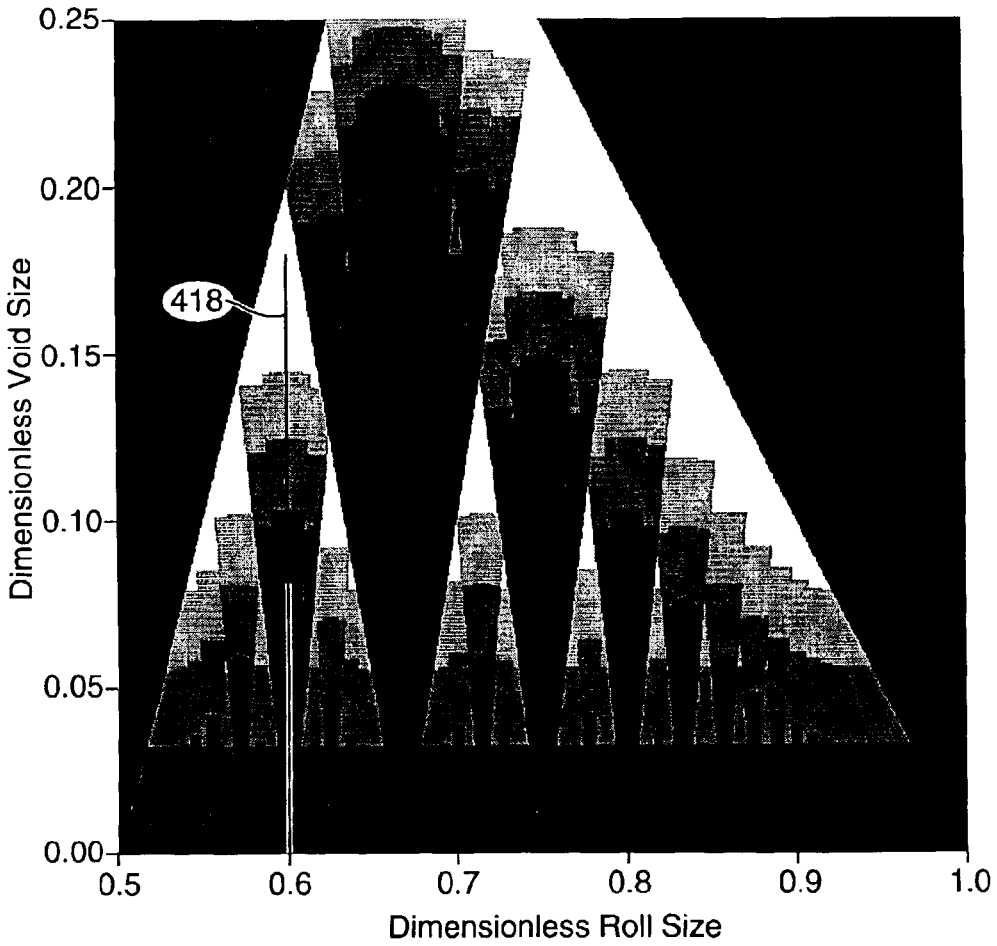
FIG. 20 through FIG. 24 are additional improvement diagrams illustrating the relationship between dimensionless roll size and dimensionless void size.

Detailed simulation investigations have also revealed that the performance of the improvement rolls of the invention can be altered in unexpected ways. For example, FIG. 20 through FIG. 24 show that bigger voids often can provide better results. The improvement diagrams in FIG. 20 through FIG. 24 are symmetric about a line drawn at X=0.5, and thus only the region from X=0.5 to X=1.0 is shown. Dimensionless minimum caliper is plotted as a function of dimensionless roll size and dimensionless void size, and indicated using a five level gray scale. FIG. 20 shows the results obtained using three rolls of exactly equal periods. In FIG. 20, black indicates a dimensionless minimum caliper from 0 to 0.82 and white indicates a value of 0.88 to 0.897. The intermediate ranges 0.82 to 0.84, 0.84 to 0.86, and 0.86 to 0.88 are indicated by three levels of gray ranging from dark gray through medium gray to light gray.

Figure 21:
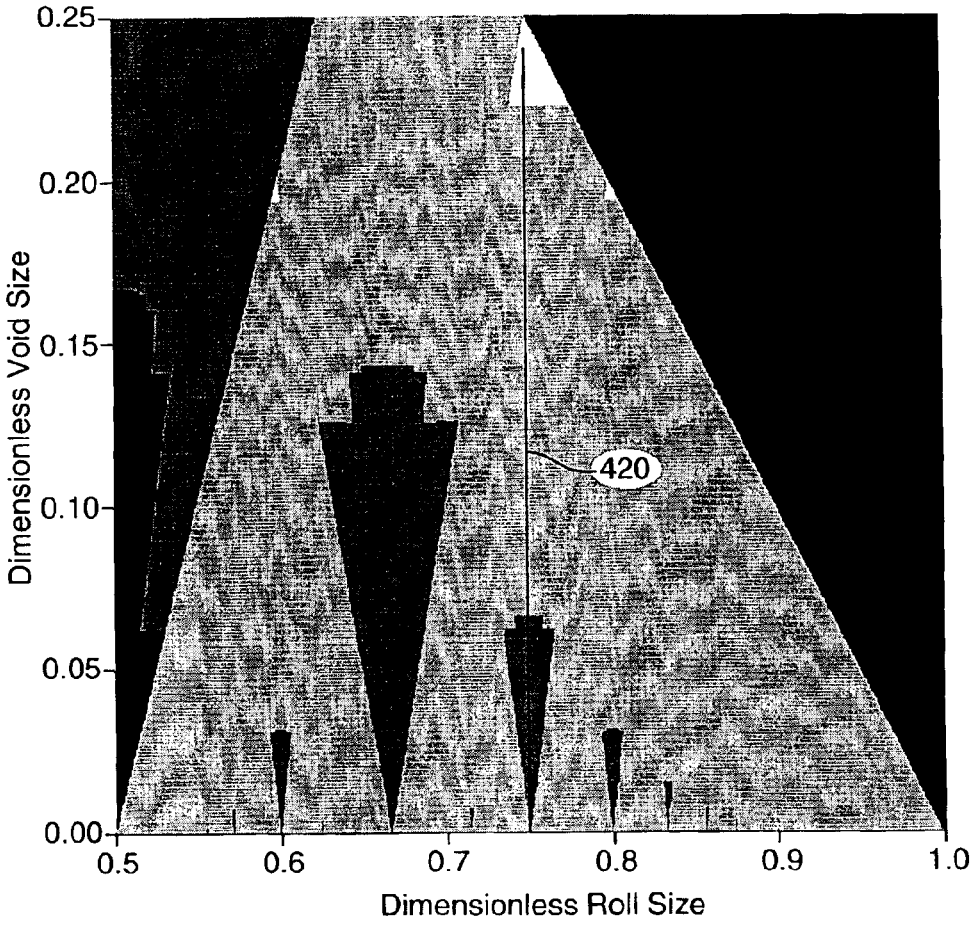

FIG. 21 shows the results obtained using only one improvement roll. Black indicates a dimensionless minimum caliper of 0 to 0.3 and white indicates a dimensionless minimum caliper of 0.6 to 0.622. The intermediate ranges 0.3 to 0.4, 0.4 to 0.5 and 0.5 to 0.6 are indicated by three levels of gray ranging from dark gray through medium gray to light gray.

Figure 22:
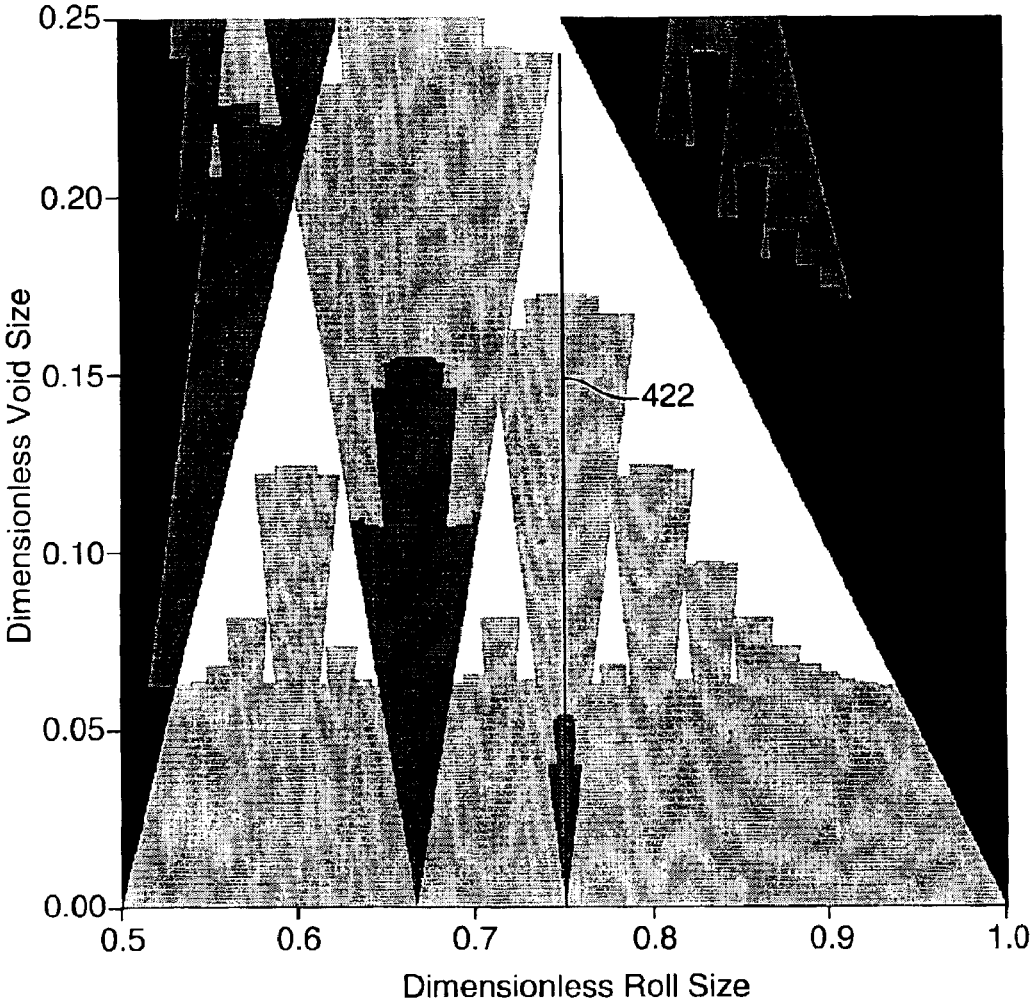

FIG. 22 shows the results obtained using two improvement rolls. Black indicates a dimensionless minimum caliper of 0 to 0.5 and white indicates a dimensionless minimum caliper of 0.8 to 0.833. The intermediate ranges 0.5 to 0.6, 0.6 to 0.7 and 0.7 to 0.8 are indicated by three levels of gray ranging from dark gray through medium gray to light gray.

Figure 23:
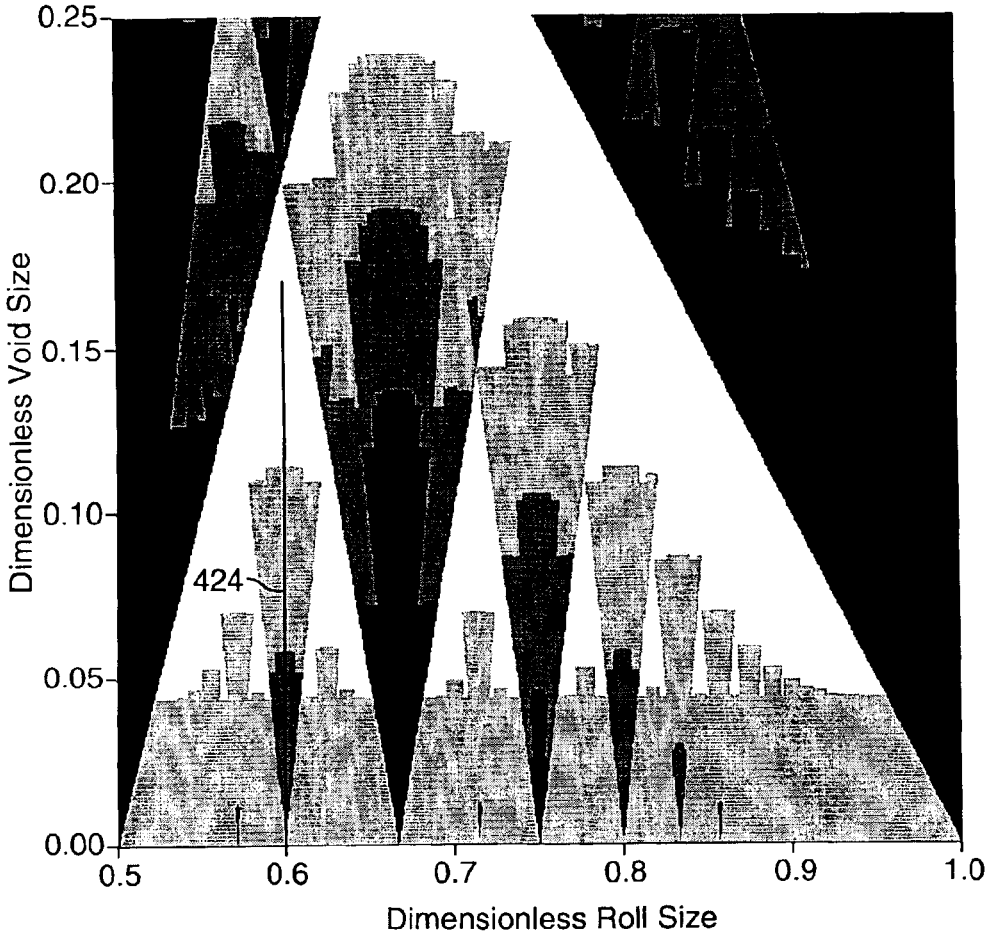

FIG. 23 shows the results obtained using three improvement rolls. Black indicates a dimensionless minimum caliper of 0 to 0.7 and white indicates a dimensionless minimum caliper of 0.85 to 0.9535. The intermediate ranges 0.7 to 0.75, 0.75 to 0.8 and 0.8 to 0.85 are indicated by three levels of gray ranging from dark gray through medium gray to light gray.

Figure 24:
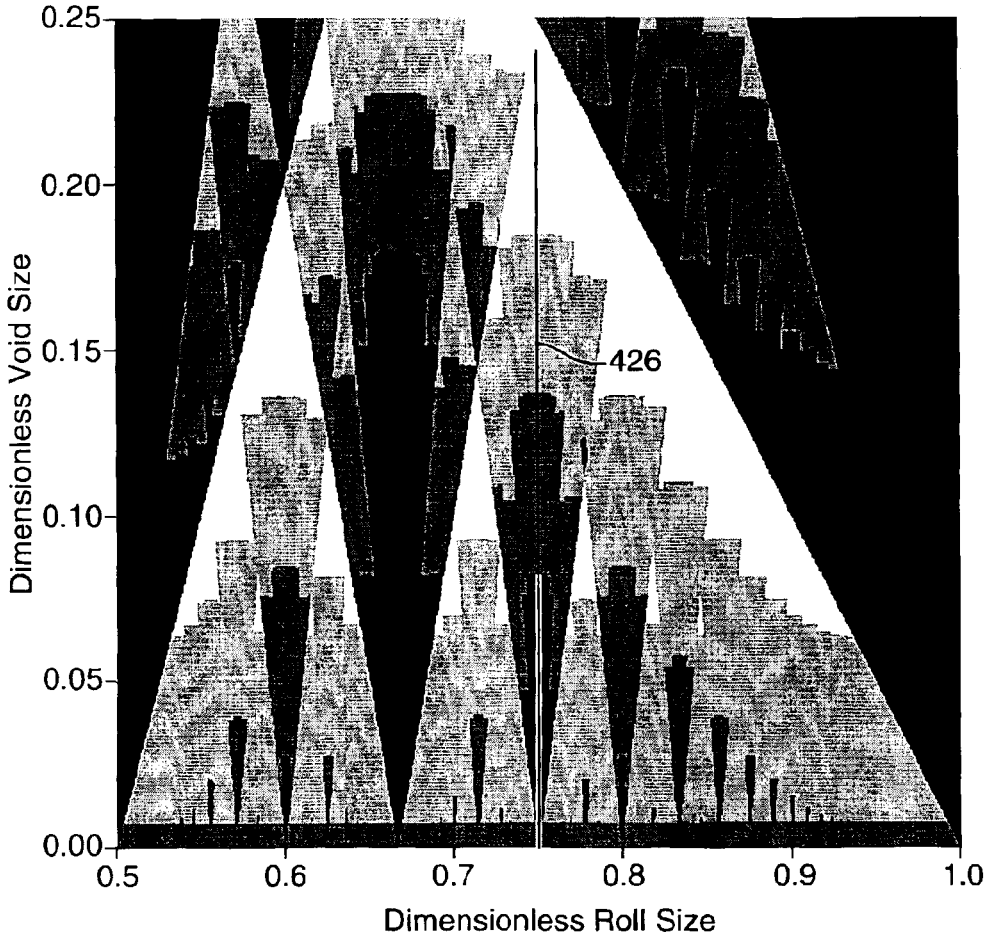

FIG. 24 shows the results obtained using four improvement rolls. Black indicates a dimensionless minimum caliper of 0 to 0.75 and white indicates a dimensionless minimum caliper of 0.9 to 0.9785. The intermediate ranges 0.75 to 0.8, 0.8 to 0.85 and 0.85 to 0.9 are indicated by three levels of gray ranging from dark gray through medium gray to light gray.

In each of FIG. 20 through FIG. 24 many regions occur where increasing the void size while maintaining all other variables constant produces improved uniformity over a broad range of void sizes. Examples include void size increases along the vertical line segments 418 (ranging from ordinate values of 0 to 0.18) in FIG. 20, 420 (ranging from ordinate values of 0 to 0.24) in FIG. 21, 422 (ranging from ordinate values of 0 to 0.24) in FIG. 22, 424 (ranging from ordinate values of 0.03 to 0.17) in FIG. 23 and 426 (ranging from ordinate values of 0 to 0.23) in FIG. 24. FIG. 20 through FIG. 24 also show that when correcting periodic voids, improvement roll performance can be bettered by determining the period and size of the defect and choosing an improvement roll period or periods based on examination of an improvement diagram such as those shown in FIG. 20 through FIG. 24. If the void size, void period and roll period are known or measured, any of these variables may be adjusted to enhance the operation of an improvement station of one, two, three, four or more rolls by moving to a more favorable combination of dimensionless roll and void sizes. For example, operation within or movement towards a light gray or more preferably a white region in FIG. 21 (for one roll), FIG. 22 (for two rolls), FIG. 23 (for three rolls), FIG. 24 (for four rolls), or their respective mirror images about the axis X=0.5, will produce more uniform coating caliper than operation within or movement towards darker areas of these improvement diagrams.

For coatings containing random rather than repeating voids and an improvement station employing 5 or more substantially uniform rolls, the improvement in uniformity is generally better if the substantially uniform rolls vary in size by an amount greater than 0.5 times the void size. For such random voids the average roll size will be unimportant. Instead, the number of rolls, the random void size and the roll period variations primarily influence the uniformity results. For example, as shown above in connection with FIG. 16, all other things being equal, the bigger the void in such a situation the worse will be the result.

A coating having random or periodic areas that are deficient in coating material can be analyzed by considering the coating to be made up of a uniform base coating underneath a voided coating of the same composition. The improvement devices described herein will act to remove and reposition the top voided coating in a manner similar to their action on a lone voided coating. Thus the teachings provided herein for a voided coating also apply to a non-voided but non-uniform coating containing coating depressions. In a similar manner periodic or random excesses in a coating can be analyzed by considering the coating to be made up of a uniform base coating underlying a discontinuous top coating. Thus the teachings provided herein for a voided coating also apply to a non-voided but non-uniform coating containing coating surges.

As mentioned above, another aspect of the invention is that the improvement station increases the rate of drying volatile liquids on a substrate. Drying is often carried out after a substrate has been treated by washing or by passage through a treating liquid. Here the main process objective is not to apply a liquid coating, but instead to remove liquid. For example, droplets, patches or films of liquid are commonly encountered in web processing operations such as plating, coating, etching, chemical treatment, printing and slitting, as well as in the washing and cleaning of webs for use in the electronics industry.

When a liquid is placed on or is present on a substrate in the form of droplets, patches, or coatings of varying uniformity and if a dry substrate is desired, than the liquid must be removed. This removal can take place, for example, by evaporation or by converting the liquid into a solid residue or film. In industrial settings drying usually is accomplished using an oven. The time required to produce a dry web is constrained by the time required to dry the thickest caliper present. Conventional forced air ovens produce uniform heat transfer and do not provide a higher drying rate at locations of thicker caliper. Accordingly, the oven design and size must account for the highest anticipated drying load.

The improvement stations of the invention substantially reduce the time required to produce a dry substrate, and substantially ameliorate the effect of coating caliper surges. The improvement station diminishes coating caliper surges for the reasons already explained above. Even if the coating entering the improvement station is already uniform, the improvement station greatly increases the rate of drying. Without intending to be bound by theory, the repeated contact of the wet coating with the pick-and-place devices is believed to increase the exposed liquid surface area, thereby increasing the rate of heat and mass transfer. The repeated splitting, removal and re-deposition of liquid on the substrate may also enhance the rate of drying, by increasing temperature and concentration gradients and the heat and mass transfer rate. In addition, the proximity and motion of the pick-and-place device to the wet substrate may help break up rate limiting boundary layers near the liquid surface of the wet coating. All of these factors appear to aid in drying. In processes involving a moving web, this enables use of smaller or shorter drying stations (e.g., drying ovens or blowers) down web from the coating station. If desired, the improvement station can extend into the drying station.

The methods and devices of the invention can be used to apply, make more uniform or dry coatings on a variety of flexible or rigid substrates, including paper, plastics, glass, metals and composite materials. The substrates can be substantially continuous (e.g., webs) or of finite length (e.g., sheets). The substrates can have a variety of surface topographies including smooth, textured, patterned, microstructured and porous surfaces (e.g., smooth films, corrugated films, prismatic optical films, electronic circuits and non-woven webs). The substrates can have a variety of uses, including tapes, membranes (e.g., fuel cell membranes), insulation, optical films or components, electronic films, components or precursors thereof, and the like. The substrates can have one layer or many layers under the coating layer. The invention is especially useful for converting a discontinuous coating (such as one applied using above-described stripe coater) into a continuous coating.

The invention is further illustrated in the following example, in which all parts and percentages are by weight unless otherwise indicated.

EXAMPLE

Using a modified coating machine equipped with an improvement station of the invention, a plastic web was coated with intermittent, periodic and sparsely applied cross web stripes of a coating liquid, then converted to a web having a continuous uniform coating. The web was 0.05 mm thick and 51 mm wide biaxially oriented polyester film. The coating liquid contained 2600 parts by volume of glycerin, 260 parts by volume of isopropyl alcohol, and 1 part by volume of a fluorochemical wetting agent (3M™ FLUORAD™ FC-129 fluorosurfactant, Minnesota Mining and Manufacturing Company, St. Paul, Minn.). The coating liquid was applied to a transfer roll and then transferred to the web. The coating station employed an air driven oscillating mechanism that stroked a flexible polypropylene needle back and forth across the transfer roll. The oscillating mechanism was a Model BC406SK13.00 TOLOMATIC™ Pneumatic Band Cylinder with a linear actuator (Tol-O-Matic, Inc., Hamel, Minn.). The coating liquid was premetered using a syringe pump obtained as model 55-1144 from Harvard Apparatus. The polypropylene needle had a 0.48 mm tip and was obtained as part number 560105 from I & J Fisnar Inc. Interconnection between the syringe pump and the needle was made using flexible, 4 mm OD plastic tubing. The needle was positioned so that the needle tip contacted with the transfer roll.

The transfer roll was 62.7 mm in diameter and was driven by contact with and movement of the web. Using a web speed of 7.77 meters per minute, a liquid flow rate of 0.5 ml/min., a stroke rate of 120 per minute and a stroke length of 127 mm, a pattern of narrow, crosshatched stripes was premetered onto the web at a rate sufficient to provide an overall average coating caliper of 0.5 micrometers.

The coated web was then brought into contact with an improvement station containing 25 undriven corotating rolls. The improvement station rolls were obtained from Webex Inc. as dynamically balanced aluminum dead shaft rolls with smooth anodized roll faces, a face length of 355.6 mm, and nominal diameters of 50.8 mm. Actual measurements of the roll diameters showed that 1 roll had a diameter of 49.42 mm, 3 rolls had a diameter of 49.40 mm, 2 rolls had a diameter of 49.36 mm, 13 rolls had a diameter of 49.34 mm, 1 roll had a diameter of 49.33 mm and 5 rolls had a diameter of 49.28 mm. The resulting set thus had an average diameter of 49.36 mm, with 5 rolls in the set having a diameter that was 0.2% less than the average diameter and 1 roll in the set having a diameter that was 0.1% more than the average diameter. Each roll was wrapped by the web for at least 30 degrees of the roll circumference. Using a hand held mechanical tachometer, no variation in roll versus web speed could be found.

Following passage through the improvement station, the very discontinuous initially applied coating was transformed to a continuous, void-free but patterned coating. As observed using the unaided naked eye, the pattern exhibited crosshatched overlapping areas of heavy coating with areas of lighter coating in between. Evaluated visually, the overall variation appeared to be approximately ±50% of the average caliper. In order to obtain a more uniform coating, the web was next passed around a 76.2 mm diameter air turn bar positioned so that its axis was coplanar with but angled to the axis of the preceding improvement roll. One 360° revolution around the air turn bar produced a sideways offset for the web path greater than the width of the web. By using several transitional idler rolls to turn the web back in the direction of the improvement station, the coated web could be brought back into contact with the improvement station rolls on a path parallel to but not overlapping the original web path. The net result was to enable the coated side of the web to make contact and re-contact 50 times with nearly identical rolls. Following this second pass through the improvement rolls, the coated web appearance was visibly void-free, pattern free, and uniform. Accordingly, the improvement station provided a significant increase in coating uniformity.

Various modifications and alterations of this invention will be apparent to those skilled in the art without departing from the scope and spirit of this invention. This invention should not be restricted to that which has been set forth herein only for illustrative purposes.

What is claimed is:

1. A method for improving the uniformity of a wet coating on a substrate having a direction of motion comprising contacting and re-contacting a coating having coating caliper defects that repeat in the direction of motion, the defects including surges, depressions and voids, with wetted surface portions of a sufficient number of pick-and-place devices having periods of contact with the substrate within ±1% of one another so that the coating caliper defects are converted to range from 85% to 115% of the average coating caliper.

2. A method according to claim 1 wherein all the pick-and-place devices have the same period of contact.

3. A method according to claim 1 wherein all the pick-and-place devices have periods of contact within ±1% of one another and enable a reduction in the magnitude of coating caliper surges, depressions or voids that repeat in the direction of motion.

4. A method according to claim 3 wherein the device periods are within ±0.05% within ±0.5% of one another.

5. A method according to claim 3 wherein the device periods are within ±0.05% of one another.

6. A method according to claim 3 wherein the device periods are within ±0.01% of one another.

7. A method according to claim 1 further comprising at least one pick-and-place device having a period of contact that differs by more than 1% from the average period of contact of the other devices.

8. A method according to claim 1 further comprising at least one pick-and-place device having a period of contact that differs by more than 5% from the average period of contact of the other devices.

9. A method according to claim 1 wherein coating voids are converted to be at least 90% of the average coating caliper.

10. A method according to claim 1 wherein coating excesses of up to 200% of the average coating caliper are converted to be no more than 110% of the average coating caliper.

11. A method according to claim 1 wherein the wet coating has a caliper variation, and wherein the period of the caliper variation, the size of the caliper variation or the period of contact of at least one device is changed to reduce or minimize coating defects.

12. A method according to claim 11 wherein the coating is applied to the substrate as a pattern of stripes interspersed with depressions and the pick-and-place devices comprise rolls.

13. A method according to claim 12 wherein the depressions comprise voids.

14. A method according to claim 12 wherein the coating is applied atop a previously applied wet coating.

15. A method according to claim 1 wherein the coating is converted to a void-free or substantially void-free coating having a thickness less than 5 micrometers.

16. A method according to claim 1 wherein the coating is converted to a void-free or substantially void-free coating having a thickness less than 0.5 micrometers.

17. A method for improving the uniformity of a wet coating on a substrate having a direction of motion comprising contacting and re-contacting a coating having bands of light or heavy coating extending transverse to the direction of motion with wetted surface portions of at least five periodic pick-and-place devices having periods of contact with the substrate within ±1% of one another.

18. A method according to claim 17 wherein all the pick-and-place devices have the same period of contact.

19. A method according to claim 17 wherein all the pick-and-place devices have substantially the same periods of contact and enable a reduction in the magnitude of coating caliper surges, depressions or voids that repeat in the direction of motion.

20. A method according to claim 19 wherein the device periods are within ±0.05% of one another.

21. A method according to claim 19 wherein the device periods are within ±0.01% of one another.

22. A method according to claim 17 further comprising at least one additional pick-and-place device having a period of contact that differs by more than 1% from the average period of contact of the other devices.

23. A method according to claim 17 further comprising at least one additional pick-and-place device having a period of contact that differs by more than 5% from the average period of contact of the other devices.

24. A method according to claim 17 wherein the pick-and-place devices comprise at least 10 rolls.

25. A method according to claim 17 wherein the pick-and-place devices comprise at least 20 rolls.

26. A method for coating a moving web comprising applying thereon a wet coating having a lengthwise caliper variation; contacting and re-contacting the wet coating with wetted surface portions of one or more rolls having a period of contact with the web; and changing the period of the caliper variation, to reduce or minimize coating defects.

27. A method according to claim 26 wherein the wet coating is applied as cross web stripes separated by voids.

28. A method for coating a moving web comprising applying thereon a wet coating of cross web stripes and contacting and re-contacting the wet coating with wetted surface portions of one or more rolls having a period of contact with the web, wherein the dimensionless stripe width and dimensionless roll size are sufficient to provide a coating having a dimensionless minimum caliper of at least 0.3.

29. A method for coating a moving web comprising applying thereon a wet coating of cross web stripes and contacting and re-contacting the coating with wetted surface portions of at least two rolls having the same or substantially the same period of contact with the web, wherein the dimensionless stripe width and dimensionless roll sizes are sufficient to provide a coating having a dimensionless minimum calmer of at least 0.6.

30. A method for coating a moving web comprising applying thereon a wet coating of cross web stripes and contacting and re-contacting the coating with wetted surface portions of at least three rolls having the same or substantially the same period of contact with the web, wherein the dimensionless stripe width and dimensionless roll sizes are sufficient to provide a coating having a dimensionless minimum caliper of at least 0.8.

31. A method for coating a moving web comprising applying thereon a wet coating of cross web stripes and contacting and re-contacting the coating with wetted surface portions of at least four rolls having the same or substantially the same period of contact with the web, wherein the dimensionless stripe width and dimensionless roll sizes are sufficient to provide a coating having a dimensionless minimum caliper of at least 0.8.

32. A method for improving the uniformity of a wet coating on a substrate having a direction of motion comprising contacting and re-contacting a coating having coating caliper defects in the direction of motion, the defects including voids having a complete absence of coating or surges having an excess of as much as 200% of the average coating caliper, with wetted surface portions of a sufficient number of periodic pick-and-place devices having periods of contact with the substrate within ±1% of one another so that the coating caliper defects are converted to range from 85% to 115% of the average coating caliper.

* * * * *

UNITED STATES PATENT AND TRADEMARK OFFICE

CERTIFICATE OF CORRECTION

PATENT NO. : 6,878,408 B2
DATED : April 12, 2005
INVENTOR(S) : Leonard, William K. et al.

It is certified that error appears in the above-identified patent and that said Letters Patent is hereby corrected as shown below:

Column 11,
Line 34, delete “web Out” and insert -- web out --.
Line 58, delete “shaded” before “plot”.

Column 33,
Lien 4, after “are” delete “within ± 0.05%”.

Column 34,
Line 34, delete “calmer” and insert -- caliper --.

Signed and Sealed this

Twenty-third Day of August, 2005

JON W. DUDAS
*Director of the United States Patent and Trademark Office*